US009739087B2

(12) United States Patent
Teuscher

(10) Patent No.: US 9,739,087 B2
(45) **Date of Patent: *Aug. 22, 2017**

(54) BLIND ASSEMBLY

(71) Applicant: Jason B. Teuscher, New York, NY (US)

(72) Inventor: Jason B. Teuscher, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/062,900

(22) Filed: Mar. 7, 2016

(65) Prior Publication Data

US 2016/0186490 A1 Jun. 30, 2016

Related U.S. Application Data

(63) Continuation-in-part of application No. 14/932,300, filed on Nov. 4, 2015, which is a continuation-in-part (Continued)

(51) Int. Cl.

| | |
|---|---|
| ***E06B 9/262*** | (2006.01) |
| ***E06B 9/36*** | (2006.01) |
| ***E06B 9/388*** | (2006.01) |
| ***E06B 9/40*** | (2006.01) |
| *E06B 9/24* | (2006.01) |

(52) U.S. Cl.

CPC ..... *E06B 9/262* (2013.01); *E06B 9/36* (2013.01); *E06B 9/362* (2013.01); *E06B 9/364* (2013.01); *E06B 9/367* (2013.01); *E06B 9/388* (2013.01); *E06B 9/40* (2013.01); *E06B 2009/2423* (2013.01); *E06B 2009/2441* (2013.01); *E06B 2009/2622* (2013.01); *E06B 2009/2627* (2013.01)

(58) Field of Classification Search

CPC .... E06B 9/36; E06B 9/262; E06B 2009/2627; E06B 2009/2622; E06B 2009/2625; E06B 2009/2441; E06B 2009/2423; E06B 9/367; E06B 9/388; E06B 9/362; E06B 9/364; E06B 9/40

USPC ..... 160/84.01, 88, 120

See application file for complete search history.

(56) References Cited

U.S. PATENT DOCUMENTS

| | | | |
|---|---|---|---|
| 591,918 | A | 10/1897 | Friedrich |
| 1,557,058 | A | 10/1925 | Johansen |

(Continued)

FOREIGN PATENT DOCUMENTS

| | | | |
|---|---|---|---|
| CA | 2510265 | * | 5/2006 |
| CA | 2510265 | | 3/2009 |

(Continued)

*Primary Examiner* — Blair M Johnson

(74) *Attorney, Agent, or Firm* — Cesari and McKenna, LLP

(57) ABSTRACT

A modular shade includes at least one module that consists of a head rail unit, a foot rail unit, at least one intermediate rail unit, and a plurality of slat components. A top slat may be coupled to the head rail unit and the intermediate rail unit, and a bottom slat component may be coupled to the intermediate rail unit and the foot rail unit. Further, additional intermediate rail units and intermediate slat components may be added to the module to alter the shape and size of the module, and the module may be coupled to one or more additional modules to change the overall shape and size of the modular shade.

20 Claims, 39 Drawing Sheets

Related U.S. Application Data of application No. 14/489,002, filed on Sep. 17, 2014, now Pat. No. 9,260,913, which is a continuation-in-part of application No. 13/963,683, filed on Aug. 9, 2013, now Pat. No. 9,322,211, which is a continuation-in-part of application No. 13/575,083, filed as application No. PCT/US2011/000588 on Apr. 1, 2011, now Pat. No. 8,851,142.

(60) Provisional application No. 61/322,981, filed on Apr. 12, 2010.

(56) References Cited

U.S. PATENT DOCUMENTS

| | | | | |
|---|---|---|---|---|
| 2,100,976 | A | 11/1937 | Norton | |
| 2,207,720 | A | 7/1940 | Cole et al. | |
| 2,370,794 | A | 3/1945 | Houmere | |
| 2,636,556 | A | 4/1953 | Light et al. | |
| 2,855,241 | A | 10/1958 | Walter | |
| 3,075,805 | A | 1/1963 | Golde et al. | |
| 3,946,788 | A | 3/1976 | Van Muyen | |
| 4,641,700 | A | 2/1987 | Zveibil | |
| 4,813,468 | A | 3/1989 | Fraser | |
| 5,010,940 | A * | 4/1991 | Marocco | E06B 9/36 160/168.1 R |
| 5,090,466 | A | 2/1992 | Hong | |
| 5,231,708 | A | 8/1993 | Hansen | |
| 5,690,156 | A * | 11/1997 | Ruggles | E06B 9/262 160/84.04 |
| 5,791,390 | A | 8/1998 | Watanabe | |
| 6,502,619 | B1 * | 1/2003 | Kraeutler | E06B 9/0692 160/84.01 |
| 6,561,251 | B1 | 5/2003 | Prosch | |
| 6,668,899 | B1 | 12/2003 | Thomas, Jr. | |
| 6,899,156 | B2 | 5/2005 | Tyner | |
| 7,631,682 | B2 | 12/2009 | Lamers et al. | |
| 8,235,086 | B2 * | 8/2012 | Smith | E06B 9/54 160/120 |
| 8,353,325 | B2 | 1/2013 | Chen et al. | |
| 8,544,522 | B2 * | 10/2013 | Lin | E06B 9/262 160/178.3 |
| 9,493,981 | B2 | 11/2016 | Bishop et al. | |
| 2006/0249260 | A1 | 11/2006 | Nien | |
| 2006/0289122 | A1 | 12/2006 | Lin | |
| 2007/0163723 | A1 * | 7/2007 | Liang | E06B 9/262 160/84.01 |
| 2007/0235147 | A1 * | 10/2007 | Zakowski | E06B 9/262 160/84.04 |
| 2012/0031569 | A1 | 2/2012 | Elinson | |
| 2012/0102707 | A1 * | 5/2012 | Chen | E06B 9/262 29/428 |
| 2012/0103539 | A1 * | 5/2012 | Chen | E06B 9/24 160/113 |
| 2012/0227910 | A1 * | 9/2012 | Lin | E06B 9/262 160/84.01 |
| 2013/0068401 | A1 | 3/2013 | Birkestrand | |
| 2014/0027070 | A1 | 1/2014 | Birkestrand | |
| 2015/0275571 | A1 * | 10/2015 | Guhl | E06B 9/327 160/172 R |

FOREIGN PATENT DOCUMENTS

| | | | |
|---|---|---|---|
| JP | 04070490 A * | 3/1992 | |
| KR | 100 817 245 B1 | 3/2008 | |

* cited by examiner

BLIND ASSEMBLY

CROSS-REFERENCE TO RELATED APPLICATION

The present application is a continuation in part application of U.S. patent application Ser. No. 14/932,300, filed Nov. 4, 2015 which is a continuation in part application of U.S. patent application Ser. No. 14/489,002, filed Sep. 17, 2014, which is a continuation in part application of U.S. patent application Ser. No. 13/963,683, filed Aug. 9, 2013, which is a continuation in part application of U.S. patent application Ser. No. 13/575,083, filed Jul. 25, 2012, which is a 371 application of International Application No. PCT/US2011/000588 filed on Apr. 1, 2011, which claims the benefit of Provisional Application Ser. No. 61/322,981, filed Apr. 12, 2010, the contents of each of which are hereby incorporated by reference herein.

BACKGROUND OF THE INVENTION

This invention relates to blinds. It relates especially to a modular vertical window blind assembly which can be custom fitted to a variety of different window or opening shapes and sizes. We will describe the invention in the context of a window blind. However, it should be understood that the invention is also applicable to a blind for a door having a light and even to a blind or curtain for an opening such as a doorway or passageway to control the amount of hot or cold air entering or leaving a room.

Conventional vertical window blinds have vertical slats on louvers suspended from a head rail that can be mounted at the top of a window so that the slats extend down to the bottom of the window. By turning a wand, the slats can be rotated in unison about their vertical axes between a closed position wherein the slats lie almost parallel to the window essentially forming a single panel which blocks the light and an open position wherein the slats are oriented at right angles to the window, thus allowing a maximum amount of light to pass through the blind. The slats can also be set at any angle between those two extremes. However, even when slats of the prior blinds are in their fully open position, they still occlude the window to some extent in that an observer sees the edges of the slats when looking out the window.

Some vertical blinds are also disadvantaged in that they are usually fabricated in relatively few widths to fit standard window sizes. Therefore, they may not be suitable for windows that do not conform to those standards.

SUMMARY OF THE INVENTION

Accordingly, the present invention aims to provide an improved vertical blind assembly which is of a modular construction so that it can be made to fit substantially any size window.

Another object of the invention is to provide an assembly of this type whose vertical slats can be raised and lowered in unison like a window shade for any shape or sized window, such as a square, round, or semi-round windows.

A further object of the invention is to provide such an assembly whose vertical slats can be rotated about their vertical axes, even when the slats are partially raised. The vertical slats may be rotated manually, or using an electric motor that is housed in one or more of the assemblies, where the electric motors can be used for all individual units with or without a remote control including a bevel gear which may turn all the individual assemblies/units in unison. The use of the electric motor may be particularly advantageous for windows that have heights that are too high or too long in length that would be difficult for a user to reach by hand.

Another object of the invention is to provide a vertical window blind assembly whose slats are easily replaceable when damaged or for decorative reasons.

Still another object of the invention is to provide a window blind assembly which is devoid of the unsightly cords and travelling slat supports required in conventional horizontally drawn blinds.

An additional object of the invention is to provide a window blind assembly which is easy to put up and take down, making it especially suitable for renters.

Another object of the invention is to provide a vertical window blind assembly where each blind can be cleaned upon raising and lowering the blind.

Another object of the invention is to provide a vertical window blind assembly where each blind can be individually sized to surround or accommodate objects placed in the window.

Another object of the invention is to provide a vertical window blind assembly where at the bottom of each blind is coupled to an additional blind that may extend and retract.

The invention accordingly comprises the features of construction, combination of elements and arrangement of parts which will be exemplified in the following detailed description and the scope of the invention will be indicated in the claims.

In general, my vertical blind assembly has a head rail for mounting horizontally in an opening and a vertically extensible blind, including slats and a foot rail, suspended from the head rail. The head rail and blind are composed of a sufficient number of similar modules connected together side by side to span the opening. Each module includes a head rail unit coupled to at least one adjacent head rail unit, a housing pivotally connected by an axle to the associated head rail unit, an elongated flexible slat coiled in the associated housing with an end of the slat projecting from the housing enabling the slat to be extended from and retracted back into the housing, and a foot rail unit connected to at least one adjacent foot rail unit and being pivotally secured along its width to the projecting end of the associated slat. The head rails may be in a modular format to ensure mounting for round or square windows, or any sized window. The pivot axis of the foot rail unit is collinear to the axle so that when the blind is extended to position the foot rail at any selected distance from the head rail, the slats of all of the modules may be turned between closed positions wherein the slats are parallel to the head and foot rails and block the openings and open positions wherein the slats are perpendicular to the head and foot rails and expose the opening. A turning mechanism in the head rail unit of each module connects to similar turning mechanisms in the other module(s) to turn the slats of all the modules in unison between their respective open and closed positions.

In an alternative embodiment, the head rail unit may be mounted to a side wall that is adjacent to the opening, or to a top wall that is above the opening. This head rail unit may be a venetian accordion type blind that may be connected to the head rail unit or secured to the head rail in a manner known by those skilled in the art. The venetian accordion blind may be raised or lowered by lifting or pulling the foot rail.

Further, the foot rail unit may house an additional slat that may extend from the foot rail to provide a wider range of uses for the blind assembly. Specifically, for a large window, the slat extending to the foot rail may stay at a fixed position, while the additional slat from the foot rail unit to an additional foot rail unit may be raised or lowered. The additional foot rail unit may have its own turning mechanism, or the turning mechanism in the head rail unit may be utilized to turn the slat and the additional slat in unison.

Moreover, the head rail unit may house, for example, an electric motor that may be utilized to rotate the blind assemblies in unison using a bevel gear for example, wherein the electric motor may be controlled by a remote control. The use of the electric motor may be particularly advantageous for windows that have heights that are too high or too long in length that would be difficult for a user to reach by hand. Further, in alternative embodiments, electric motors may be utilized to raise/lower the blinds.

In a further embodiment, a modular roman shade includes at least one module that consists of a head rail unit, a foot rail unit, at least one intermediate rail unit, and a plurality of slat components. In addition, a top slat may be coupled to the head rail unit and the intermediate rail unit, and a bottom slat component may be coupled to the intermediate rail unit and the foot rail unit. Further, additional intermediate rail units and intermediate slat components may be added to the module to alter the shape and size of the module. Alternatively, two slat components may be attached to each other, through use of an attachment, such as a zipper or a securing mechanism, so that the attachment provides rigidity to the modular roman shade and where the attachment acts at the intermediate rail. In addition, the module may be coupled to one or more additional modules to change the overall shape and size of the modular roman shade. Each slat component may be individually removed between the individual rail units. For example, the individual slat components may be removed to be cleaned, or to be substituted with a different slat component (e.g., having a different pattern or being of a different material). For example, a user may desire to have a particular design make up the entire modular roman shade and thus may select particular materials and/or patterns for each slat component of the modular roman shade. In an embodiment, excess material associated with a slat component may be folded back and attached to a back portion of the slat component, to, for example, accommodate or account for an angled or otherwise irregularly shaped window. Specifically, an attachment mechanism may be utilized to attach the excess material to the back of the slat component.

Thus, by employing an appropriate number of modules, the assembly can be fitted to a window of practically any width. Even bow or bay windows may be accommodated by employing flexible couplings between the adjacent modules as will be described in detail later.

As will also be seen, the modules are easy to assemble and the assembly as a whole is easy to install in a window or other opening. Therefore, the assembly should find wide application, particularly in the apartment rental market.

BRIEF DESCRIPTION OF THE DRAWINGS

For a fuller understanding of the nature and objects of the invention, reference should be made to the following detailed description taken in connection with the accompanying drawings, in which.

DESCRIPTION OF ILLUSTRATIVE EMBODIMENTS

Figure 1A:
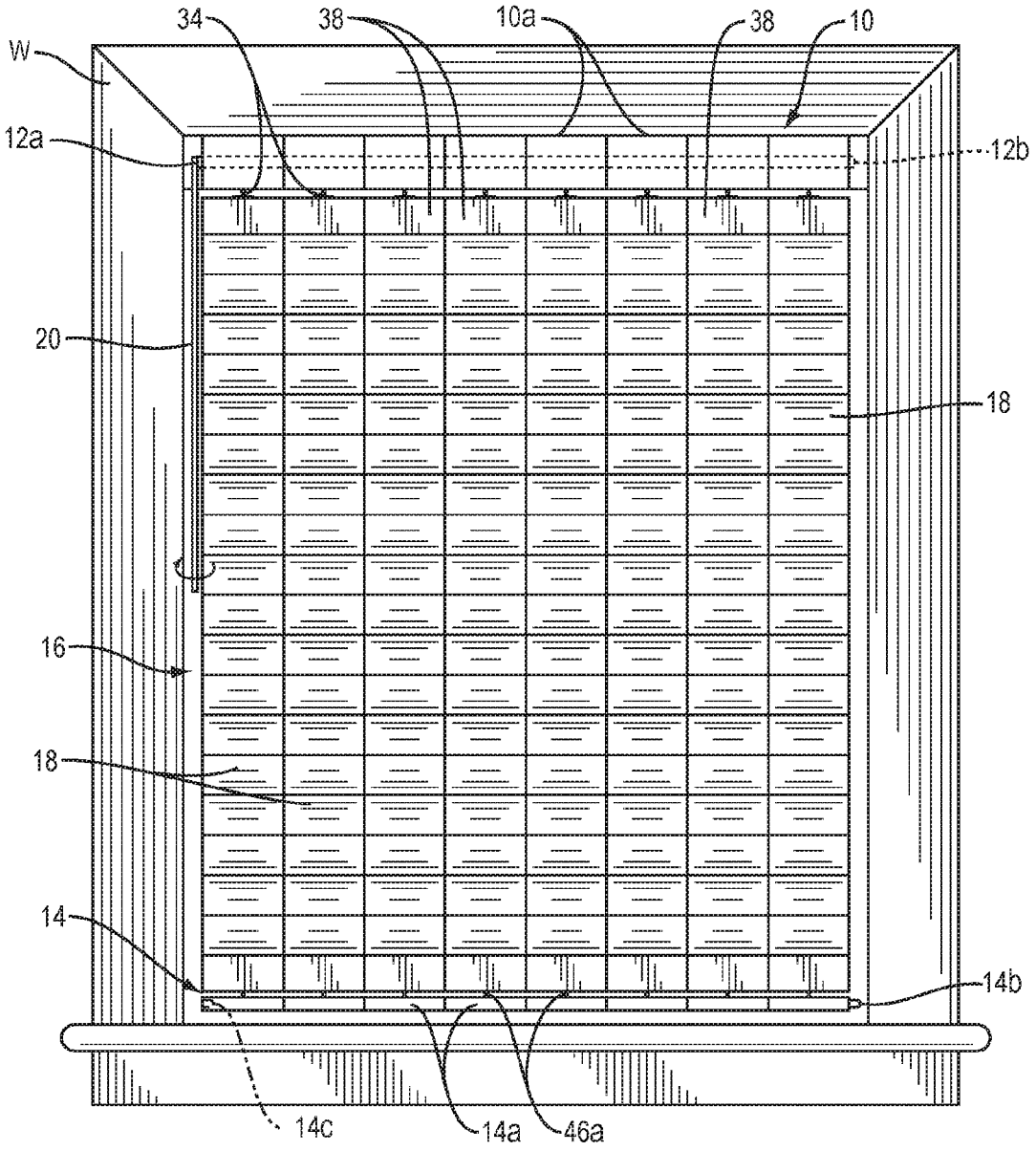
FIG. 1A is a front elevational view of my modular window blind assembly whose blind, composed of a plurality of modules, is in a fully extended or lowered position in a window and with the slats of the blind shown in their fully closed positions thus preventing light from passing through the blind.
Figure 1B:
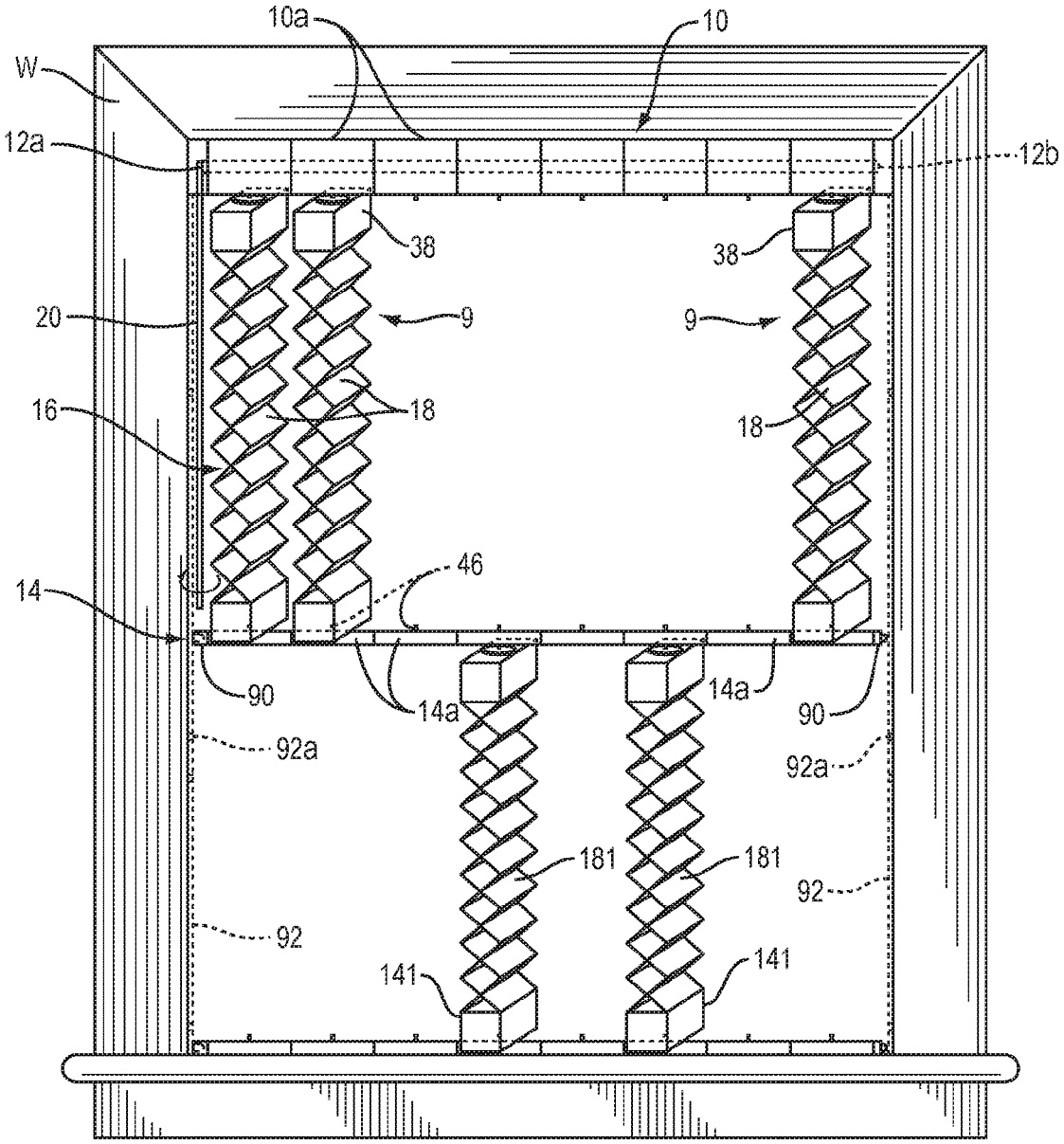
FIG. 1B is a similar view of the assembly showing the blind in a partially raised position with the slats partially open so that a desired amount of light can pass through the blind.

As shown in FIGS. 1A and 1B, my vertical blind assembly comprises a head rail 10 mounted at the top of a window W by means of brackets 12*a* and 12*b* which support the opposite ends of the head rail. The assembly also includes a foot rail shown generally at 14, and extending between the head rail and the foot rail is a window blind 16 comprised of a plurality of vertical slats or louvers 18. By pulling down or lifting up the foot rail 14, the blind 16 may be moved from a fully extended or lowered position shown in FIG. 1A to a partially retracted or raised position shown in FIG. 1B and then to a fully raised or retracted position, not shown, wherein the foot rail 14 lies just under the head rail 10 so that the blind 16 does not obstruct the view through the window. Furthermore, by turning a wand 20 in one direction or the other, the slats 18 of blind 16 can be rotated about their vertical axes from a fully closed position as shown in FIG. 1A wherein the slats lie parallel to the head and foot rails and the window forming a panel that covers the window, through a partially open position shown in FIG. 1B so that a selected amount of light can pass through the blind to a fully open position wherein the slats 18 are perpendicular to the head and foot rails and window so that light can pass through the extended length of blind 16. In an alternative embodiment, an electric motor (not shown) may be housed in the head rail 10, where the electric motor can be used for all individual units, with or without a remote control, including a bevel gear which may turn all the individual assemblies/units in unison. The use of the electric motor may be particularly advantageous for windows that have heights that are too high or too long of lengths that would be difficult for a user to reach by hand.

Thus, my window blind assembly is quite versatile in that when blind 16 is in its fully raised position, there is substantially no visual obstruction of the window W. Also, when the blind is in a partially raised position as shown in FIG. 1B, the slats 18 can still be oriented so that they prevent direct sunlight from entering the room through the upper portion of the window, yet an observer can look through the lower area of the window without having to see slat edges, as is the case with conventional vertical window blind assemblies. For especially tall windows, it is even possible to mount two of the illustrated assemblies in the same window, one at the top and the other, say, halfway down the window so that the amount of light entering through the upper and lower halves of the window can be controlled separately.

In addition, and as shown in FIG. 1B, additional slat 181 may extend from each foot rail unit 14*a* to additional foot rail unit 141. Advantegously, the slat 18 may be raised or lowered by extending or lowering foot rail unit 14*a* and/or slat 181 may be raised or lowered by extending or lowering foot rail unit 141. It is noted that each of the slats 18 and 181 may be configured to individually pivot or pivot in unison. In addition, it is noted that additional foot rail 141 may be secured to the exterior of the window by brackets similar to brackets.

Figure 1C:
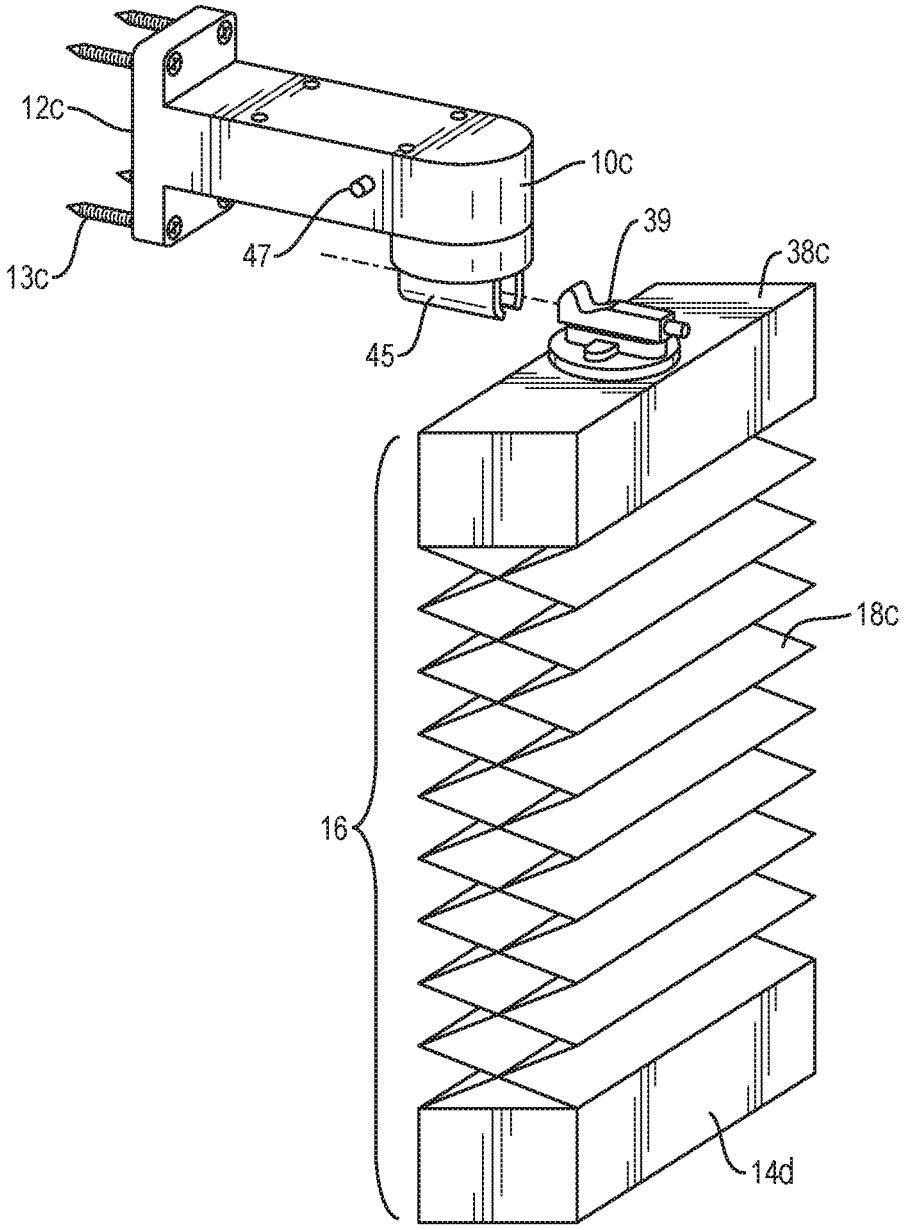
FIG. 1C is a front elevation view of my module window blind assembly whose blind may be secured to the side or top of an opening and may include a venetian accordion type blind, wherein the blind may be connected to or attached to the head rail unit.

As shown in FIG. 1C, my vertical blind assembly may comprise a head rail unit 10*c* mounted to the side of a window W by means of a back bracket 12*c*, utilizing screws 13*c* for example, which supports the head rail unit 10*c*. The head rail unit 10*c* may have a fixed arm shape, for example as seen in FIG. 1C. The assembly 300 includes a foot rail shown generally as 14*d* that is at a bottom of the window blind 16. Window blind 16 includes a venetian accordion slat 18*c*. By pulling down or lifting up the foot rail 14*cd* the venetian accordion slat 18*c* may be moved from a fully extended or lowered position (e.g., open accordion configuration) to a partially retracted or raised position and then to a fully raised or retracted position, wherein the foot rail 14*d* lies just under housing unit 38*c* of blind 16 so that the venetian accordion slat 18*c* does not obstruct the view through the window.

Figure 1D:
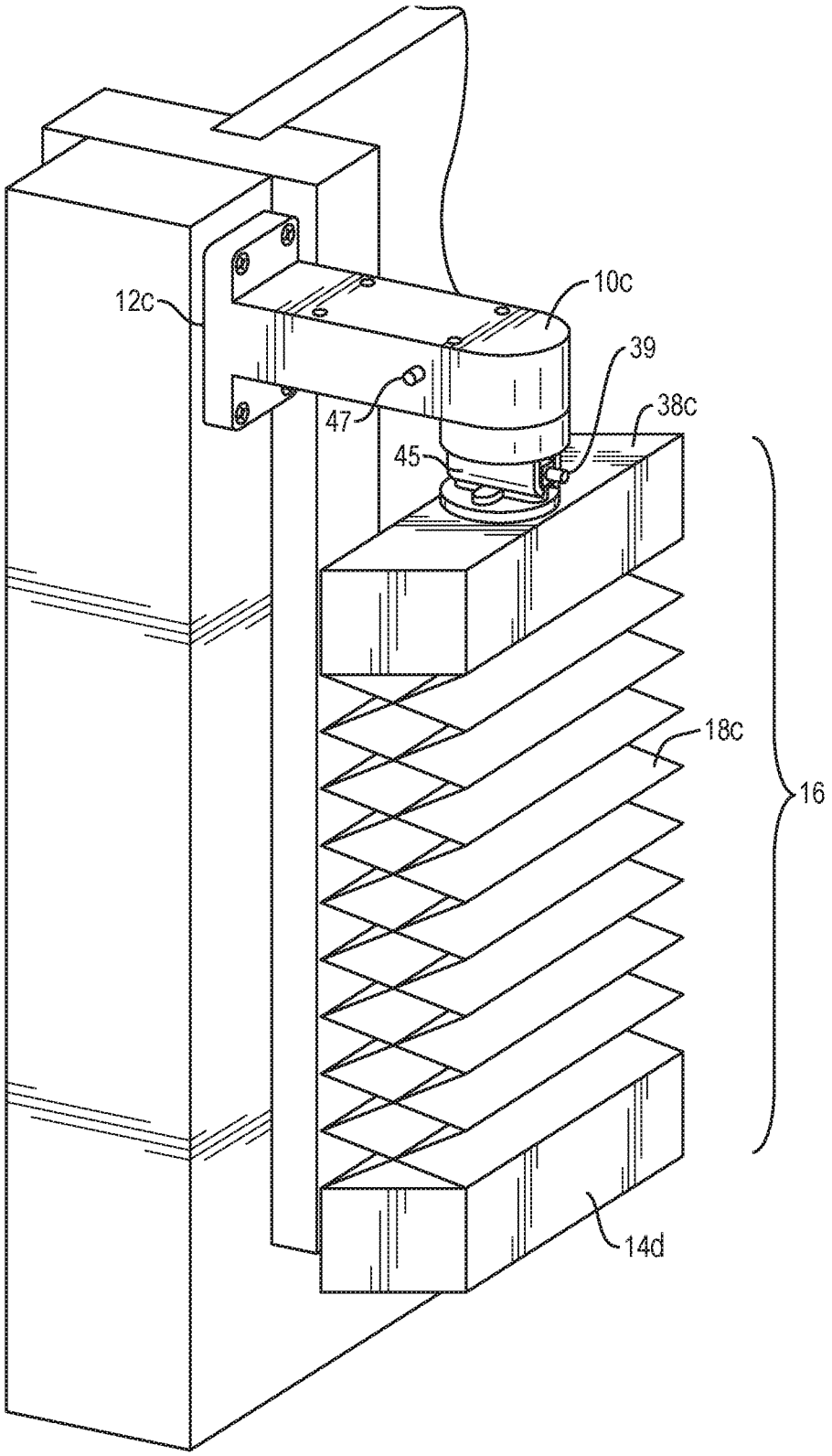
FIG. 1D is a front elevation view of my module window blind assembly whose blind may be secured to the side or top of an opening and may include a venetian accordion type blind, wherein the blind is in a fully extended or lowered position in a window and with the slats of the blind shown in their fully open positions thus permitting light to enter through the blind.
Figure 1E:
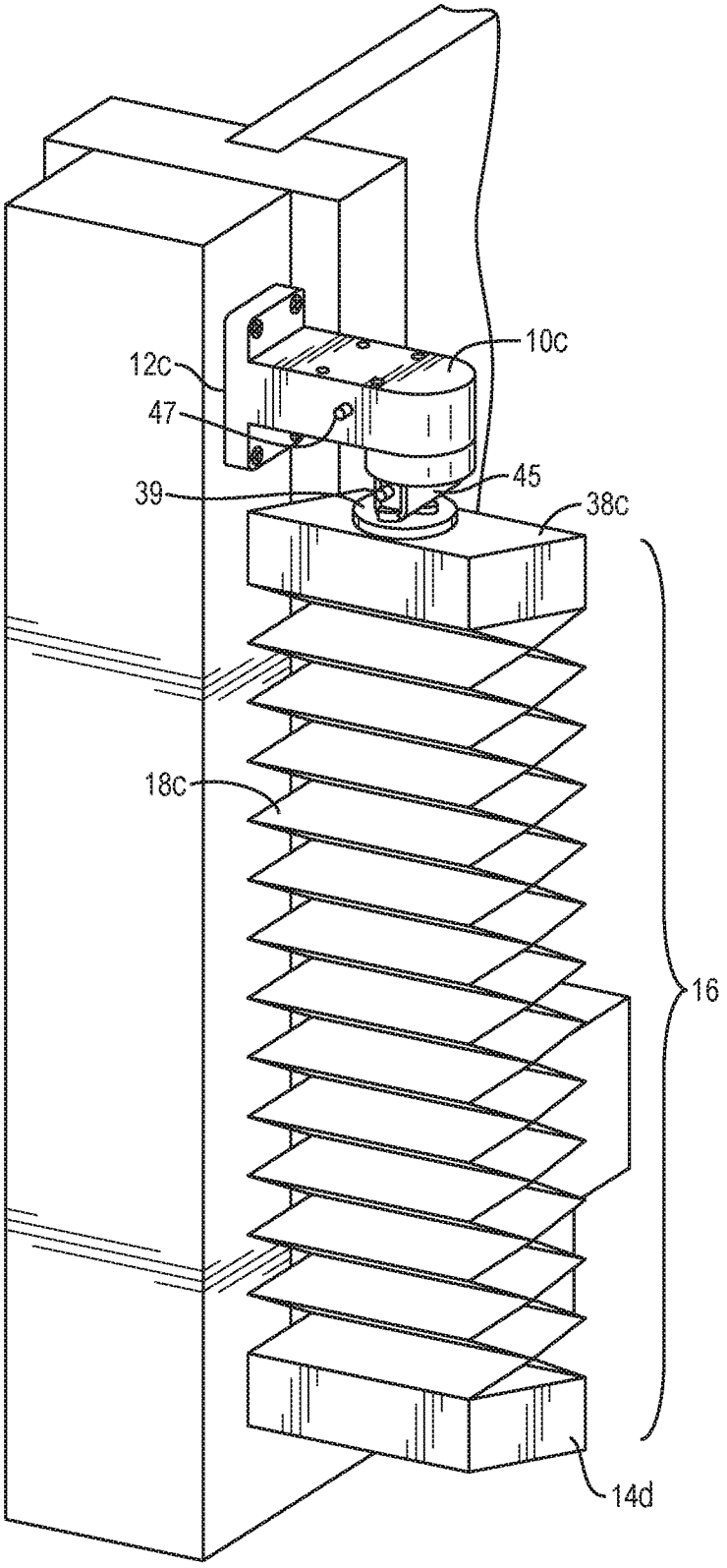
FIG. 1E is a front elevation view of my module window blind assembly whose blind may be secured to the side or top of an opening and may include a venetian accordion type blind, wherein the blind is in a fully extended or lowered position in a window and with the slats of the blind shown in their fully open positions thus permitting light to enter through the blind.

Furthermore, by turning, either clockwise or counter clockwise, pin 47 extending from head rail unit 10*c*, the blind 16 can be rotated about its axis to a fully closed position as shown in FIG. 1D. Further, the venetian vertical slat 18*c* of blind 16 can be rotated, again utilizing pin 47, about its axis to a partially open position, not shown, so that a selected amount of light can pass through the blind, to a fully open position as shown in FIG. 1E so that light can pass through the extended length of blind 16. Further, it is noted that the one or more slats 18*c* may be rotated or turned, while other slats 18*c* may remained stationary. In addition, it is noted that a turning mechanism may extend from the foot rail or be housed in the foot rail unit 14*a* to turn or rotate slat 181 about its axis to a partially open position, closed position, etc.

In an alternative embodiment, the housing unit 38*c* may house, for example, an electric motor that may be utilized to rotate the blind assemblies in unison using a bevel gear for example, wherein the electric motor may be controlled by a remote control. The use of the electric motor may be particularly advantageous for windows that have heights that are too high or too long in length that would be difficult for a user to reach by hand. Further, in an alternative embodiment, slat 18*c* may be a roller blind, instead of a venetian accordion blind, that may be controlled by the electric motor in housing unit 38*c*. Specifically, the electric motor may allow the roller blind to roll up and down to cover or expose the window.

It is noted that the weight of the blind is centered so any connection to the housing will have ample room to ensure the blind is parallel to the base of the window sill.

Each blind 16 includes the housing unit 38*c*, wherein connector 39, on a top portion of housing unit 38*c*, can be "snapped" into an accepting connector 45 of head rail unit 10*c*. It is noted that any other securing mechanism may be utilized to attach or connect the top of the housing unit 38*c* to head rail unit 10*c*. Advantegously, blind 16 can be quickly and easily replaced. Further, it is noted that housing unit 38*c* and foot rail 14*d* of blind 16 may be angled, so that when pin 47 is turned to configure the blind 16 in a closed position, the head rail unit 10*c* and foot rail 14*d* of blind 16 will form a seal with the head rail unit 10*c* and foot rail 14*d* of other blinds. This is advantageous when respective head rail units 10*c* may be connected to form a rail, as described below, that is long enough to span the window opening. Each housing 38*c* of blind 16 holds a bail retraction mechanism, not shown, to allow for the venetian according slat 18*c* to be retracted or raised, by pulling or lifting foot rail 14*d*, as known by those skilled in the art. Specifically, and with reference to FIG. 1E, the assembly may be a cordless balanced venetian blind or shade with consistent variable spring motion. Advantageously, minimal force (e.g., by pulling or lifting) is required to position the blind 16 at the desired height (e.g., open, closed, midway) with no required "snapping" or "locking mechanism."

Further, foot rail 14*d* may be different sizes and depths and the depiction of 14*d* is simply exemplary in nature. For example, foot rail 14*d* may be extremely thin and shorter in height than that of head rail unit 38*c*.

Figure 1F:
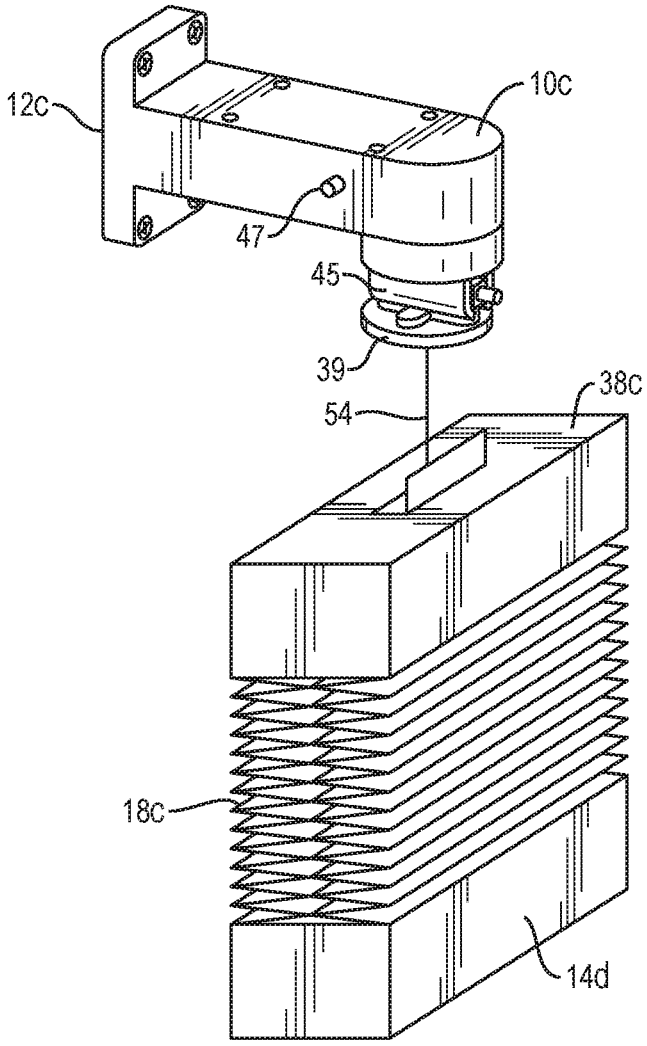
FIG. 1F is a view of the assembly that utilizes a string or tape measure within the head unit to only protect a lower portion of a window opening from light.

FIG. 1F shows an alternative embodiment where a string 54 of a pulley mechanism for example, or other hanging type of apparatus such as a tape measure configuration, may be provided and coiled in head unit 10*c*. The other end of the string 54 or tape measure may also be attached to connector 39. Thus, by allowing string 10*c* to uncoil from head rail unit 10*c* that is attached to connector 39, blind 16 can be moved in a downward direction to block a lower portion of the window W from light and to permit light to enter an upper portion of window W. It is noted that although this embodiment is described with reference to FIG. 1C-1E, this embodiment may be applied to the assembly as described in FIGS. 1A and 1B and those assemblies described below.

Figure 1G:
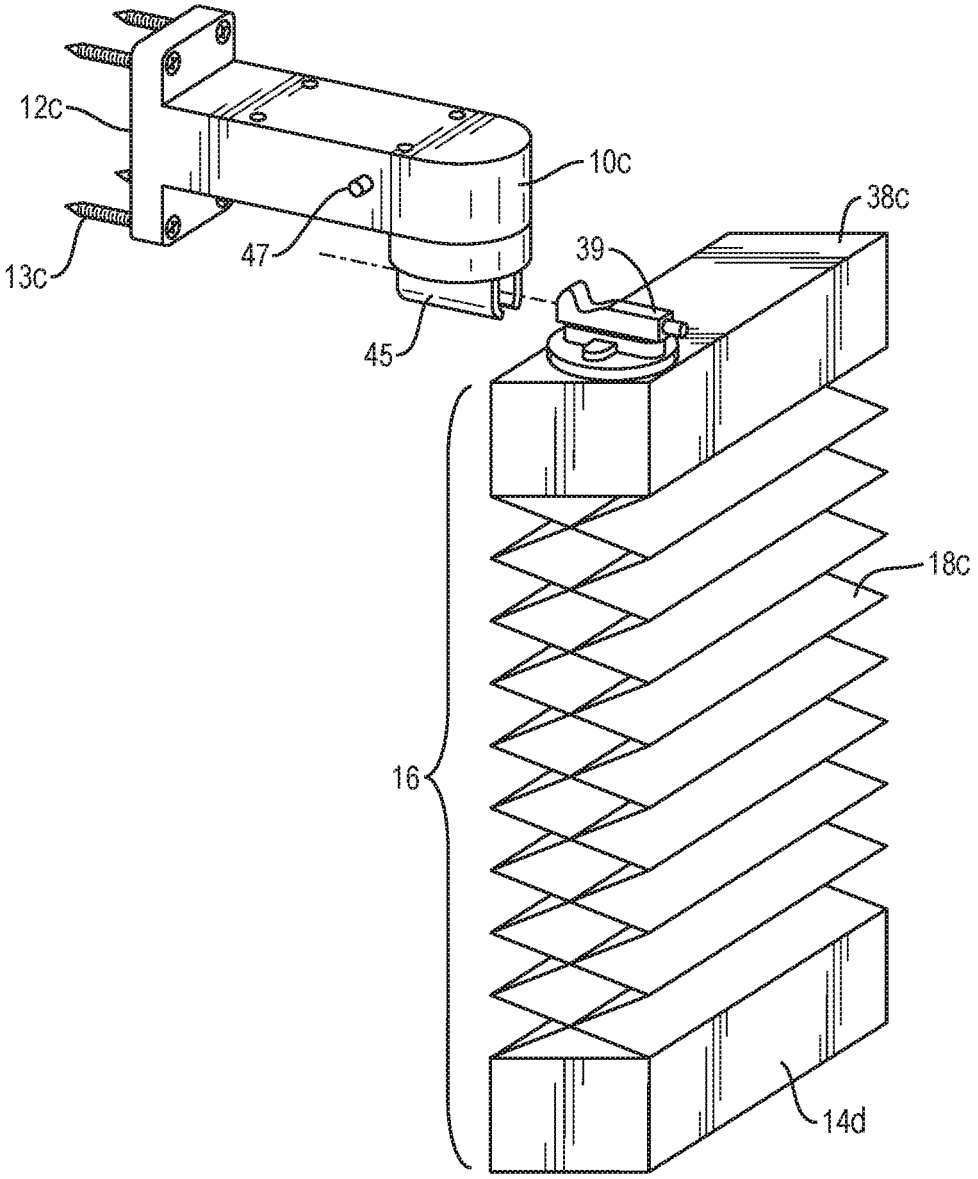
FIG. 1G is a view of the assembly where the connector is located at an end of the housing unit.

FIG. 1G is a view of the assembly where the connector 39 is located at an end of the housing unit 38*c*. This type of configuration allows for the blind 16 to be closer to the window when it is attached to head rail unit 10*c*. The attachment between head rail unit 10*c* and connector 39 has a firm connection to handle the extra weight and force exerted on the connector 39 and head rail unit 39, since it is not balanced as it would be with the connector 39 in the middle of head rail unit 38*c*. Further, it is noted that connector 39 can be positioned at any location on head rail unit 38*c* and the depiction in FIG. 1G is exemplary in nature.

Figure 2A:
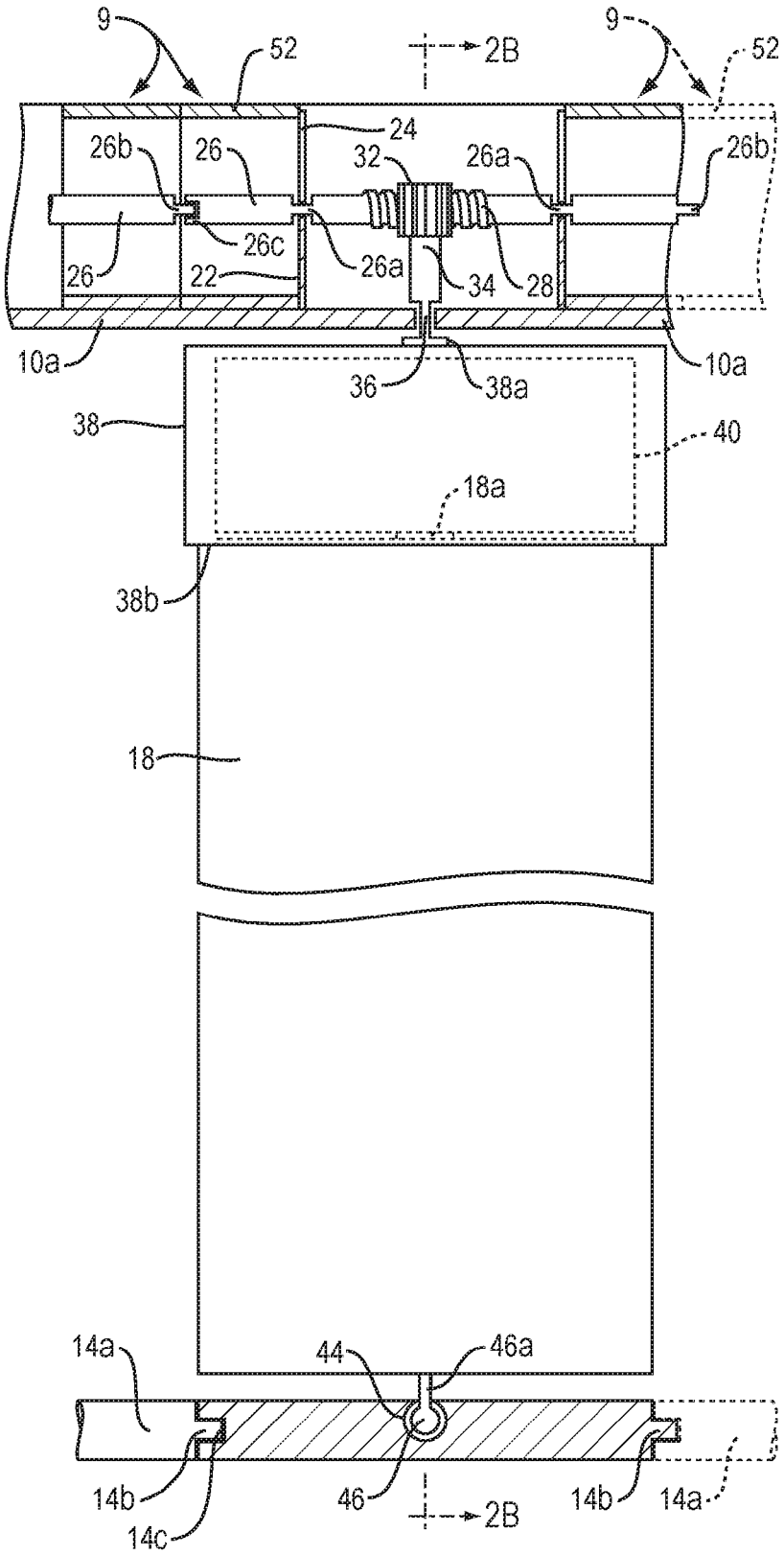
FIG. 2A is a front elevational view with parts broken away, on a larger scale, showing a module of the FIG. 1A assembly in greater detail.
Figure 2B:
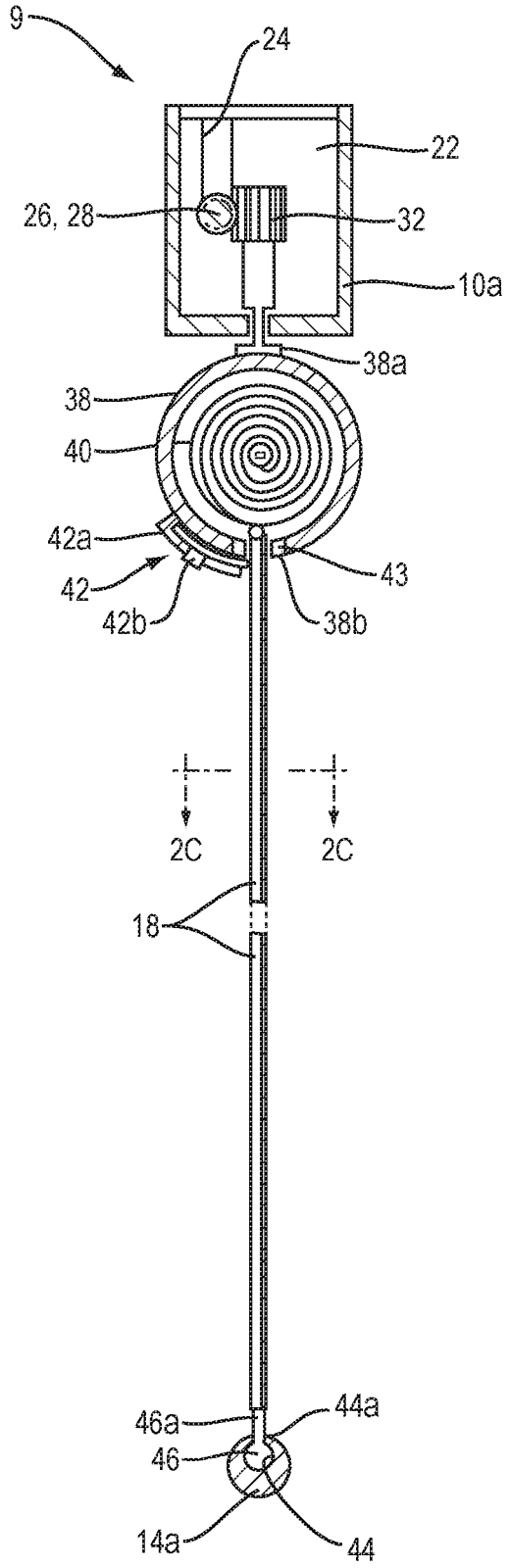
FIG. 2B is a sectional view taken along line 2B-2B of FIG. 2A.

Referring now to FIGS. 1A, 2A and 2B, the blind assembly is illustratively composed of a plurality of substantially identical modules 9, one for each slat 18. Each module includes a head rail or segment 10*a* which can be connected end to end to the units or segments 10*a* of adjacent modules 9 to form a head rail 10 that is long enough to span the window opening. Each unit 10*a* has a generally U-shaped cross-section and is provided with a pair of interior partitions 22 spaced apart along its length, each partition being formed with a vertical slot 24. The two slots 24 are aligned and adapted to receive a shaft segment 26 whose length is more or less the same as that of unit 10*a*. The shaft segment is necked down at 26*a* where it contacts the edges of the slots so that when the shaft 26 bottoms in the slots, it is captured axially by the slot walls, yet is free to rotate about its axis. One end of shaft segment 26 is formed with a key 26*b*, and a keyway 26*c* is present at the other end of the shaft segment. Also, a worm gear 28 is located midway along the segment.

Worm gear 28 meshes with a gear 32 at the upper end of an axle 34 forming a motion converter. The axle is rotatably mounted at 36 to the bottom wall of unit 10*a* so that axle 34 is fixed in the axial direction but free to rotate. Mounted to the lower end of axle 34 is a cylindrical housing 38 which contains a spring mechanism 40 similar to the one present in a conventional tape measure. Preferably, the housing 38 is releasably secured to the lower end of axle 34 so that it can be removed and replaced easily. For example, the lower end of axle 34 may have a non-circular cross section and plug into a similarly shaped socket 38*a* at the top of the housing. A spring-loaded ball 41 (FIGS. 4A and 4B) present near the end of axle 34 releasably engages in a groove to retain the shaft end in the socket.

Figure 2C:
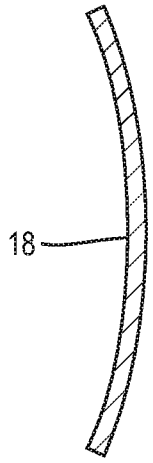
FIG. 2C is a sectional view on a still larger scale taken along line 2C-2C of FIG. 2B.

The upper end of the corresponding slat 18 is releasably connected at 18*a* to that mechanism 40 so that the slat can be wound up into a coil inside the housing. Slat 18 is similar to the tape in a conventional tape measure except that it is wider. That is, the slat is made of a springy metal or plastic material and has a camber as shown in FIG. 2C so that the slat may be rolled up in, and dispensed from, the housing 38 via a slot 38*b* therein located opposite axle 34, yet the slat is relatively stiff when extended much like the metal tape of a tape measure. In other words, when each slat 18 is pulled down via foot rail 14, it is drawn from the associated housing 38 in opposition to the bias of spring mechanism 40 therein and when the slat is pushed up, it is automatically wound up inside the housing by that mechanism.

A manually adjustable brake shown generally at 42 may be mounted to the outside of housing 38 adjacent to slot 38*b*. As best seen in FIG. 2B, the brake includes a slide 42*a* integral to the outside of the housing and a slider 42*b* movable along the slide. When the slider 42*b* is slid toward slat 38*b*, an end thereof frictionally engages the face of slat 18. The slider can be adjusted so that it exerts just the right amount of drag on slat 18 so that the slat will remain at the elevation to which it is set by the user.

Also, if desired, the edges of the housing slot 80*b* may be lined with a flock or brush material 43 so that the slat 18 is automatically dusted when moved in and out of the housing 38.

Each module 9 of the assembly also includes a foot rail unit 14*a* in the form of a generally cylindrical rod which may be connected end to end to the foot rail units 14*a* of adjacent modules to form the complete foot rail 14 shown in FIGS. 1A and 1B. To achieve this objective, one end of each unit 14*a* has a key 14*b* and the other end is formed with a keyway 14*c*. Each unit 14*a* also has a keyhole-type socket 44 midway along its length. The socket is shaped and adapted to accept a ball 46 affixed via a stem 46*a* to the lower end of the associated slat 18 so that once the ball is inserted into the socket via a socket mouth 44*a* (FIG. 2B), it is locked therein but still free to rotate about a vertical axis that is collinear to the axle 34 of that module 9.

Figure 1H:
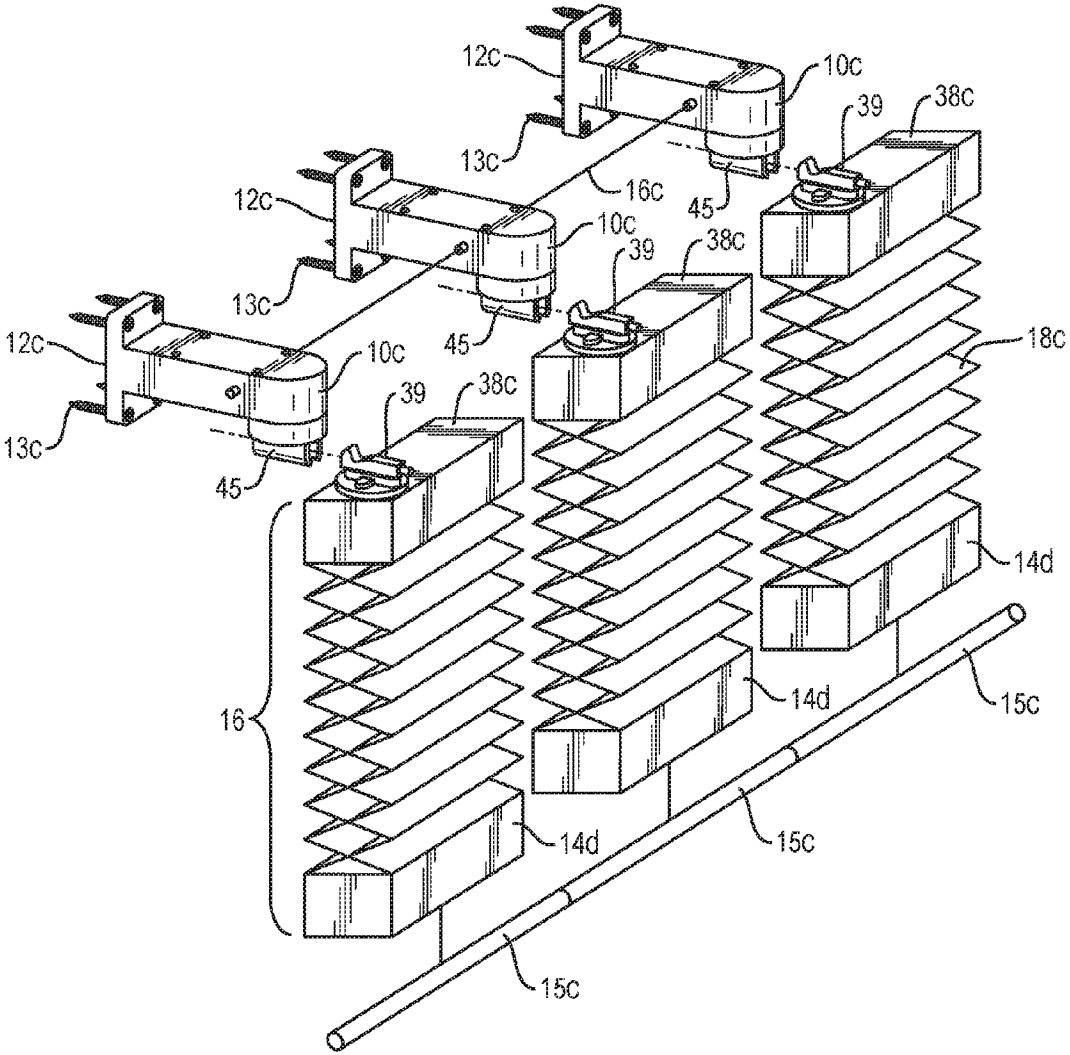
FIG. 1H that shows a plurality of assemblies that are connected to one another.

Similarly, and with reference to FIG. 1H that shows a plurality of assemblies that are connected to one another, rails 15*c* may be utilized to connect foot rails 14*d* of adjacent assemblies. Specifically, each rail 15*c* may be attached to the underside of foot rail 14*d*, and the rails 15*c* may be joined together as shown in FIG. 1H. Rail 15*c* may further be utilized to move all adjacent assemblies in unison to a desired height by pulling or pushing rail 15*c* in a particular direction. In an alternative embodiment, a first set of window assemblies may be connected together using rails 15*c*, while other assemblies may not be connected. This allows a user to raise or lower the connected assemblies without modifying the height of the assemblies that are not connected, or vice versa. Further, and as shown in FIG. 1H, a wire attachment 16*c* may be utilized to pivot or rotate the blind 16 of adjacent assemblies in unison. Further, it is noted that foot rails 14*d* of adjacent assemblies may be joined utilizing rail 15*c* regardless of the fact that adjacent assemblies may be different sizes.

Figure 1I:
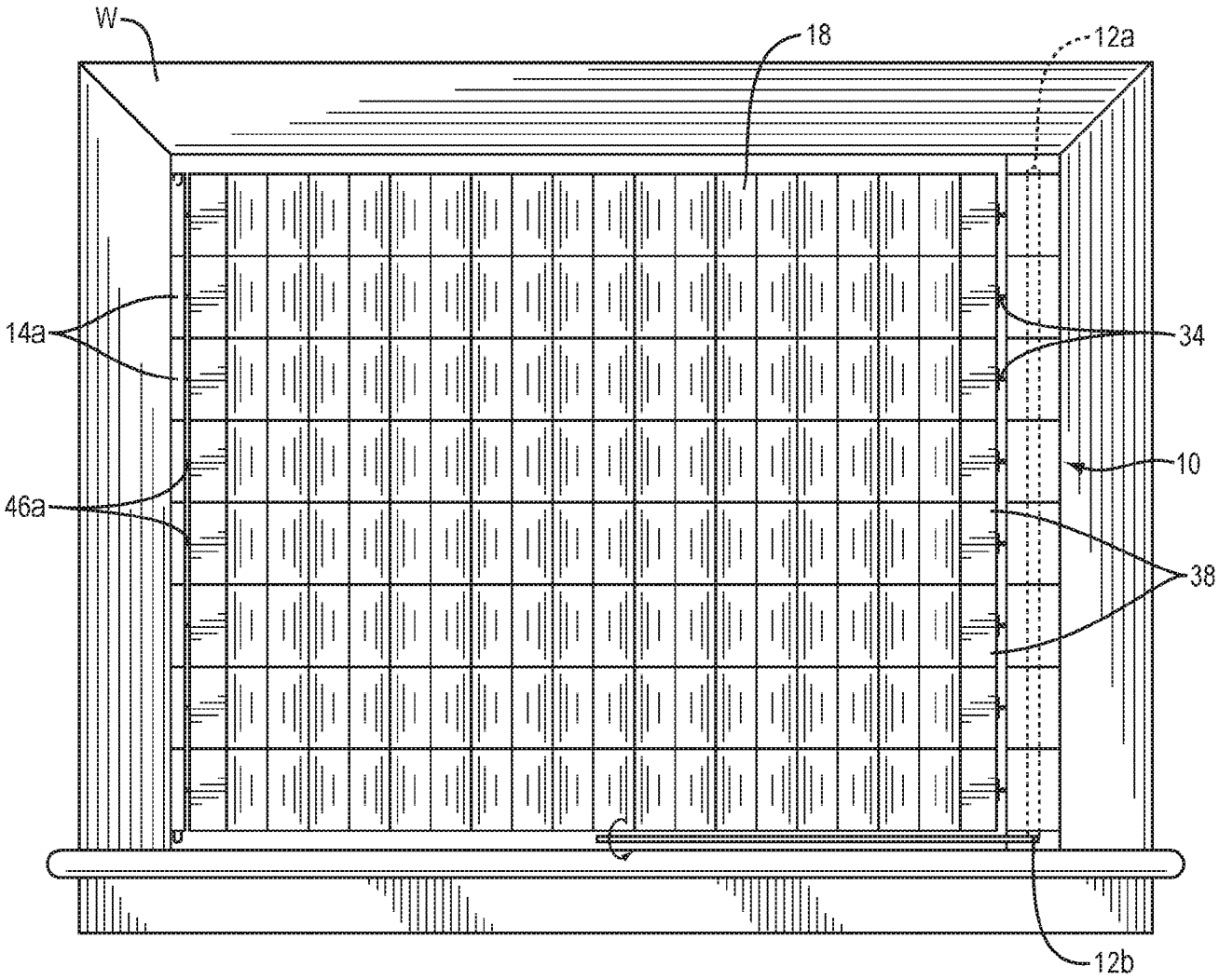
FIG. 1I is a front elevational view of my modular window blind assembly whose blind, composed of a plurality of modules, that can be manipulated to and from a fully retracted position and a fully extended position.

As shown in FIG. 1I my vertical blind assembly may include a head rail 10 mounted at a side of the window W by means of brackets 12*a* and 12*b* which support the opposite ends of the head rail. The assembly also includes a foot rail shown generally at 14, that extends on the other side of the window W and between the head rail and the foot rail is a window blind 16 comprised of a plurality of vertical slats or louvers 18. It is noted that foot rail 14 may be secured to the exterior of the window by brackets similar to brackets 12*a* and 12*b*. By extending or lowering the foot rail 14 to and away from the head rail 10, the blind 16 may be moved from a fully extended or retracted position shown in FIG. 1I to a partially retracted or extended position, not shown, and then to a fully extended or retracted position, not shown, wherein the foot rail 14 lies next to the head rail 10 so that the blind 16 does not obstruct the view through the window. Furthermore, by turning a wand 20 in one direction or the other, the slats 18 of blind 16 can be rotated about their horizontal axes from a fully closed position as shown in FIG. 1I, through a partially open position shown not shown so that a selected amount of light can pass through the blind to a fully open position not shown wherein the slats 18 are perpendicular to the head and foot rails and window so that light can pass through the extended length of blind 16. In an alternative embodiment, an electric motor (not shown) may be housed in the head rail 10, where the electric motor can be used for all individual units, with or without a remote control, including a bevel gear which may turn all the individual assemblies/units in unison. The use of the electric motor may be particularly advantageous for windows that have heights that are too high or too long of lengths that would be difficult for a user to reach by hand.

Figure 1J:
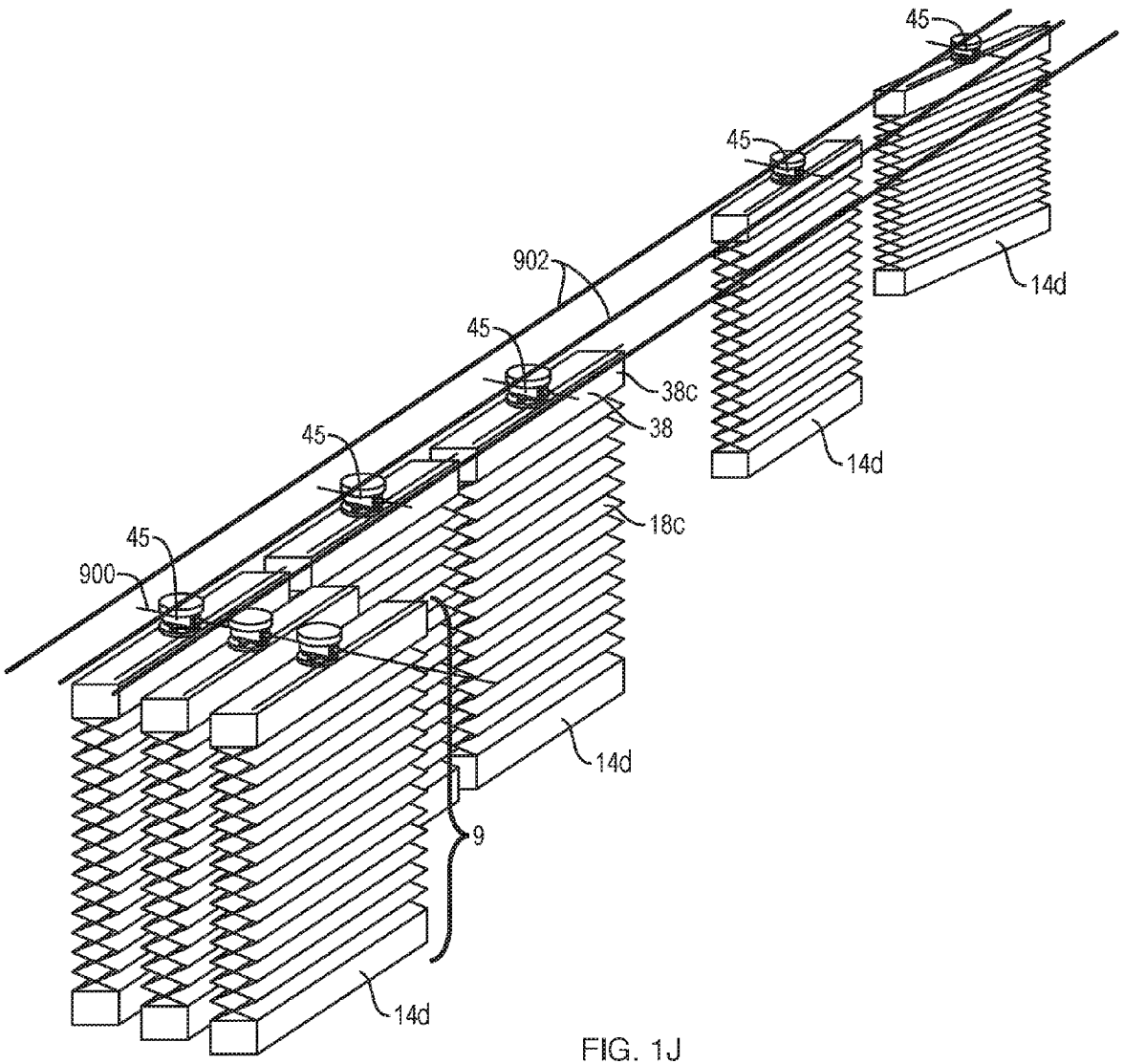
FIG. 1J is a front elevation view of my modular window blind assembly whose blind, composed of a plurality of modules, are stacked at one end.

As shown in FIG. 1J, my vertical blind assembly may comprise a plurality of modules 9 stacked on extension 900 located at the end of a window. Specifically, when the modules are moved or positioned to one side of the window, for example, on rail(s) 902, the modules 900 can be stacked, one in front of the other to save space and for organization purposes. Specifically, each module may be recessed on a rod or extension 900 that exists on the side of the window.

As noted above, each module 9 may be joined to adjacent similar modules. More particularly, as shown in FIG. 2A, each head rail unit 10*a* may be connected to an adjacent head rail unit by a tubular coupling 52 which slides into the ends of the abutting units 10*a*, until it is stopped by partitions 22. When this connection is made, the key 26*b* of the shaft segment 26 in one unit 10*a* may be inserted into the keyway 26*c* of the shaft segment 26 of the adjacent unit 10*a*. In addition, the foot rail units 14*a* of the adjacent modules 9 being joined together may be linked by inserting the key 14*b* of one unit or segment 14*a* into the keyway 14*c* of the abutting unit 14*a*. Preferably, the keys 14*b* and keyways 14*c* are designed so that when the units 14*a* are keyed together, all of the sockets 44 face upwards as shown in FIGS. 1A and 2A.

Thus, when all of the modules 9 are joined together, head rail units 10*a* collectively form a common, straight rigid head rail 10 and the foot rail units 14*a* collectively form a common, straight foot rail 14. Also, the shaft segments 26 of all the modules 9 are keyed together end to end to form a common shaft which may be rotated from one end. As best seen in FIG. 2A, when the shaft segments 26 are rotated in one direction or the other, their worm gears 28 turn the corresponding gears 32 which, via axles 32, rotate housings 38 and the slats 18 extending therefrom in unison about the longitudinal axes of the slats. The slats are free to rotate relative to the straight foot rail 14 by virtue of the ball and socket connections between the individual slats and their associated foot rail units or segments 14*a*. In this way, the slats can be turned in unison between their respective open and closed positions.

In the window blind assembly depicted in FIGS. 1A and 1B, the housings 38, slats 18 and foot rail segments 14*a* have the same width as head rail segments 10*a*. Resultantly, when the blind 16 is in its closed condition shown in FIG. 1A, the slats 18 are arranged edge to edge. In some applications, the blind may be designed so that when it is closed, the adjacent slats 18 overlap to some extent. For this, the housings 38, slats 18 and foot rail units 14*a* are made, say, 10% wider than the head rail units 10*a* so that when the blind 16 is fully closed, the overlapping housings 38, slats 18 and foot rail units 14*a* are oriented at a small angle, e.g., 10-15°, which assures that there will be no gaps between the slats when blind 16 is closed.

Figure 3:
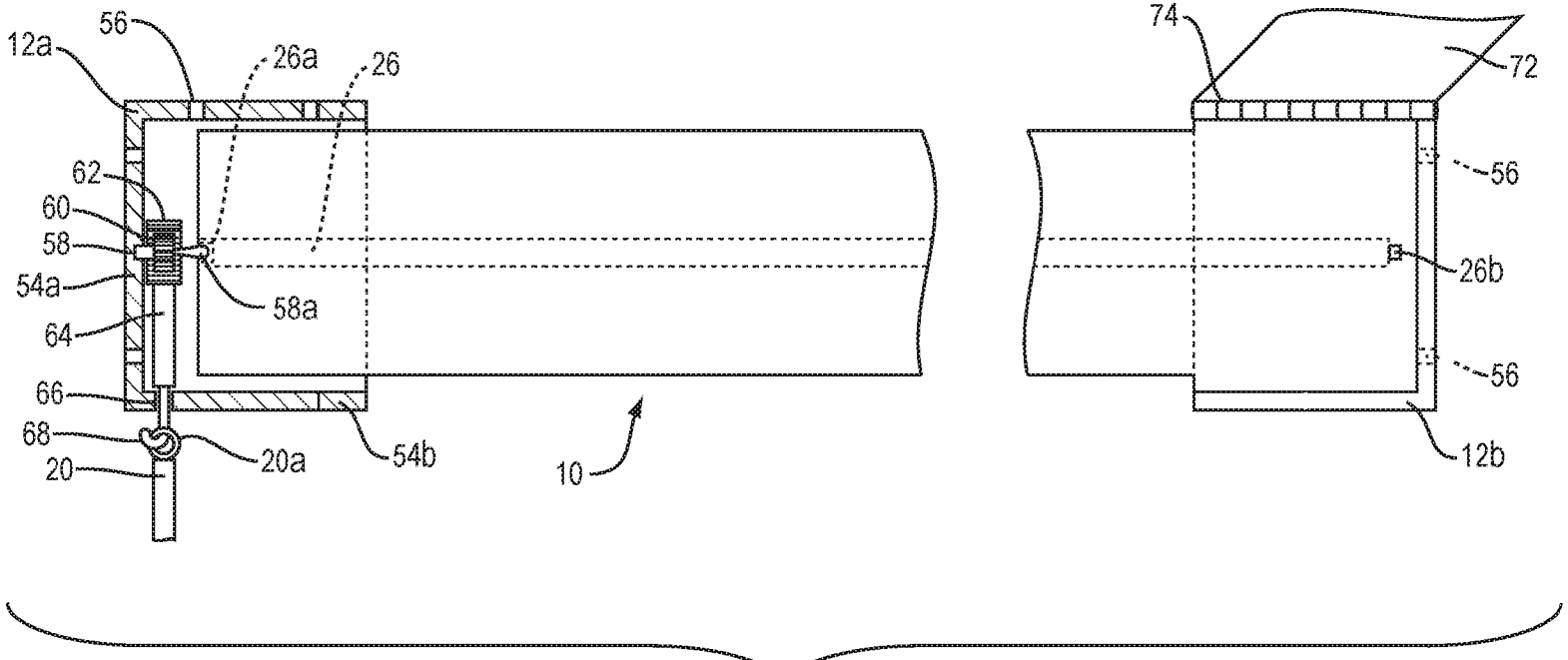
FIG. 3 is a longitudinal sectional view, with parts broken away, showing the ends of the FIGS. 1A and 1B assembly in greater detail.

Turning now to FIG. 3, as noted above, the head rail 10 is supported by brackets 12*a* and 12*b*. Bracket 12*a* is formed as a rectangular cap lying on its side. That is, it has an end wall 54*a* and fastener holes 56 for mounting the bracket to the casing of window W (FIG. 1A). Rotatably mounted to that wall is one end of an axle 58 whose other end is formed as a key 58*a* which keys into the keyway 26*c* of the shaft 26 at the left end of head rail unit 10 when that end is inserted into bracket 12*a*. Axle 58 carries a gear 60 which meshes with a worm gear 62 at the upper end of a shaft 64 rotatably mounted at 66 in the lower wall 54*b* of bracket 12*a*. The lower end of shaft 64 extending down from the bracket terminates in a hook 68 which hooks through an eye 20*a* at the upper end of wand 20. Thus, when the wand 20 is rotated about its axis, that motion is transmitted to the worm gear 62 which, in turn, rotates all of the shaft segments 26 and thus all of the gears 32 and slats 18 in unison.

The other bracket 12*b* supporting the right end of head rail 10 has a configuration similar to that of bracket 12*a* except that it has a front wall or corner 72 that is hinged at 74 to the top wall of the bracket so that the cover can be swung up to allow the right end of head rail 10 to be inserted into bracket 12*b* after the left end of the head rail has been plugged into bracket 12*a* as just described. After the right end of the rail 10 is seated in bracket 12*b*, the cover 72 may be swung down to close the front of the bracket. The lower end of the cover 72 may be formed with a lip (not shown) which underhangs the lower wall of bracket 12*b* to retain the corner in its closed position.

It will be appreciated from the foregoing that the modular construction of my assembly enables modules 9 to be joined so that the blind assembly as a whole can be made to fit a window of almost any size. Also, if one or another of the slats 18 should become damaged, it is easily replaced by disconnecting its upper end connection 18*a* at the associated housing 38 and disconnecting its ball 46 from the associated foot rail unit 14*a*. Alternatively, the housing may be separated at its socket 38*a* from the associated axle 34 and the associated foot rail segment 14*a* detached from its neighboring segments 14*a*. In a similar fashion, the slats 18 may be changed easily to suit a particular user's decorative intent.

It is apparent from the foregoing that the various modules 9 are easy to assemble and the overall assembly is easy to install in, and take down from, a window so that the blind assembly is particularly useful to people who move frequently or who rent apartments. When the assembly is in place, its blind 16 can be raised and lowered easily by lifting up and pulling down the foot rail 14 and even when the blind 16 is in a partially raised or extended position, the slats 18 still can be oriented to allow the desired amount of light to pass through the blind.

Figure 4B:
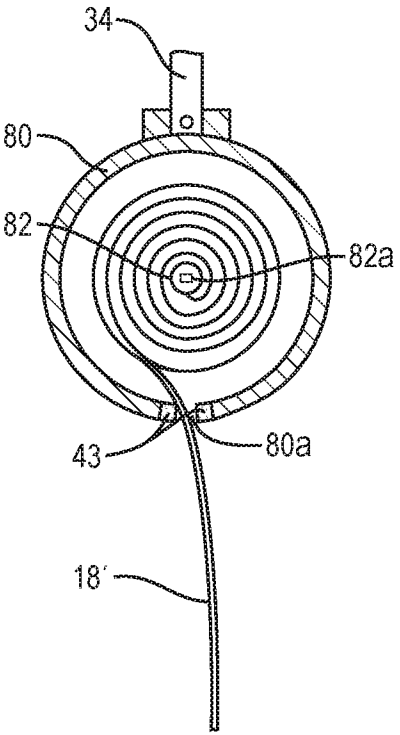
FIG. 4B is a sectional view taken along line 4B-4B of FIG. 4A.
Figure 4A:
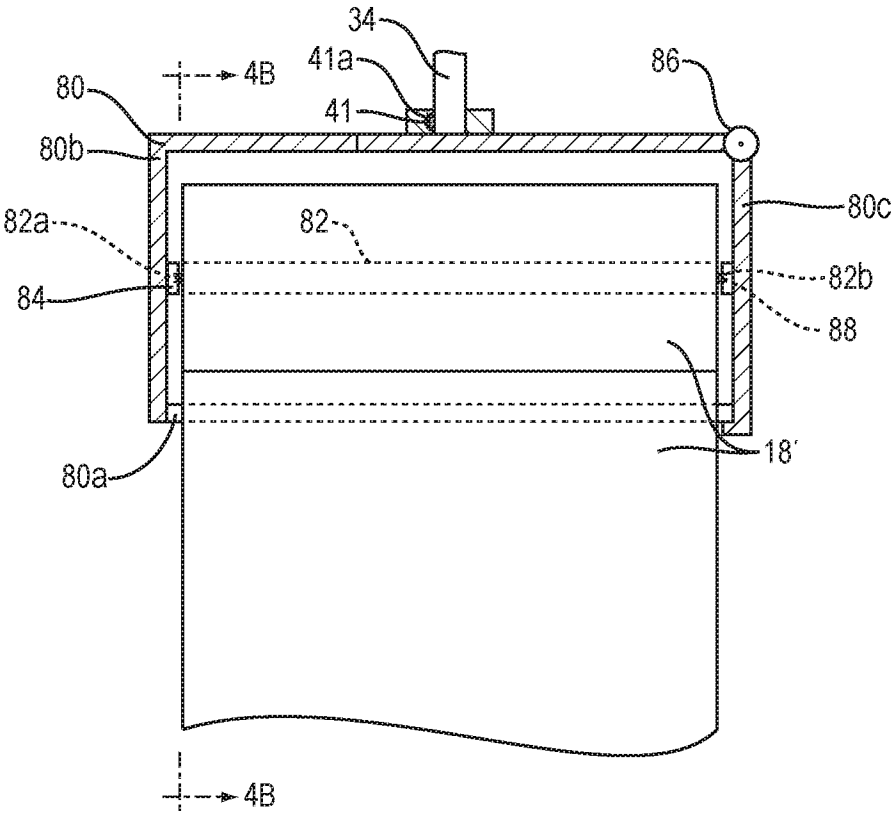
FIG. 4A is a front elevational view, with parts in section, of an alternative module embodiment for use in the FIGS. 1A and 1B assembly.

Referring now to FIGS. 4A and 4B, in some applications it may be desirable for the blind 16 (FIG. 1A) to comprise slats 18' of a non-springy fabric or plastic material. In alternative embodiments, slats 18' may be a bendable material such as bendable electronic display that allows for the display of video, television, and/or pictures. Advantageously, presentations or advertisements or other digital pictures, may be displayed on slats 18'. Further, the bendable material may be bendable solar panels, mirrors, and/or mosquito netting, as well as other bendable materials as known by those skilled in the art. Such a slat may be dispensed through a slot 80*a* of a cylindrical housing 80 comparable to housing 38 in FIGS. 2A and 2B. In this case, however, housing 80 contains a roller 82 around which the slat 18' may be wound. Roller 82 is similar to a conventional window shade roller except that it is quite short commensurate with the narrow width of the slat 18'. The roller 82 does contain the usual spring and ratchet found in a standard window shade roller so that the slat 18' can be drawn from, and rolled up on, the roller.

Housing 80 has an end wall 80*b* formed with a rectangular hole 84 for receiving the usual flat end of the ratchet axle 82*a* projecting from one end of roller 82. The other end wall 80*c* of housing 80 is hinged at 86 to the top of the housing so that it can be opened, enabling roller 82 to be inserted into the housing. The wall 80*c* is formed with a round hole 88 so that when the door is closed, hole 88 receives the round axle 82*b* that projects from the adjacent end of roller 82. Thus, when the wall 80*c* is closed, roller 82 is rotatably supported within the housing 80 and when it is rotated to dispense slat 18', the roller spring is wound up so that there is an upward bias on the slat 18'. However, upward movement of the slat is prevented by the ratchet in the roller unless the ratchet is released by pulling down, and then releasing, the slat as is done with the panel of a conventional window shade. The ratchets in the rollers 82 of all modules comprising the assembly should be aligned initially so that they all operate substantially in unison when blind 16 is raised and lowered. A window blind 16 incorporating the flexible slats 18' can be adjusted to open and close the slats even when the blind is in a partially raised position in the same manner described above in connection with the assembly depicted in FIGS. 1A and 1B.

In some instances, it may be desirable to positively secure the foot rail 14 when the shade 16 is at a desired elevation in window W particularly when the blind comprises fabric slats 18'. For this, one or more foot rail extensions 90 may be added to the opposite ends of the foot rail 14 as shown in FIG. 1B to extend the foot rail to the sides of the window casement. Also, a vertical strip 92 formed with a series of spaced apart keys or keyways 92*a* may be adhered or otherwise secured to the interior side walls of the window casement as shown in phantom in FIG. 1B. In FIG. 1B, the right hand strip 92 carries keyways to receive the key 14*b* at the extended right end of the foot rail 14 and the strip 92 at the left side of that figure has keys which can project into the keyway 14*c* at the extended left end of the foot rail 14. In this way, the blind 16 can be secured at a variety of different elevations in the window W. Of course, when the shades are secured in this fashion, the brake and ratchet mechanisms in the housings 38 and 80 for controlling the vertical movement of the slats would not be required.

Figure 5:
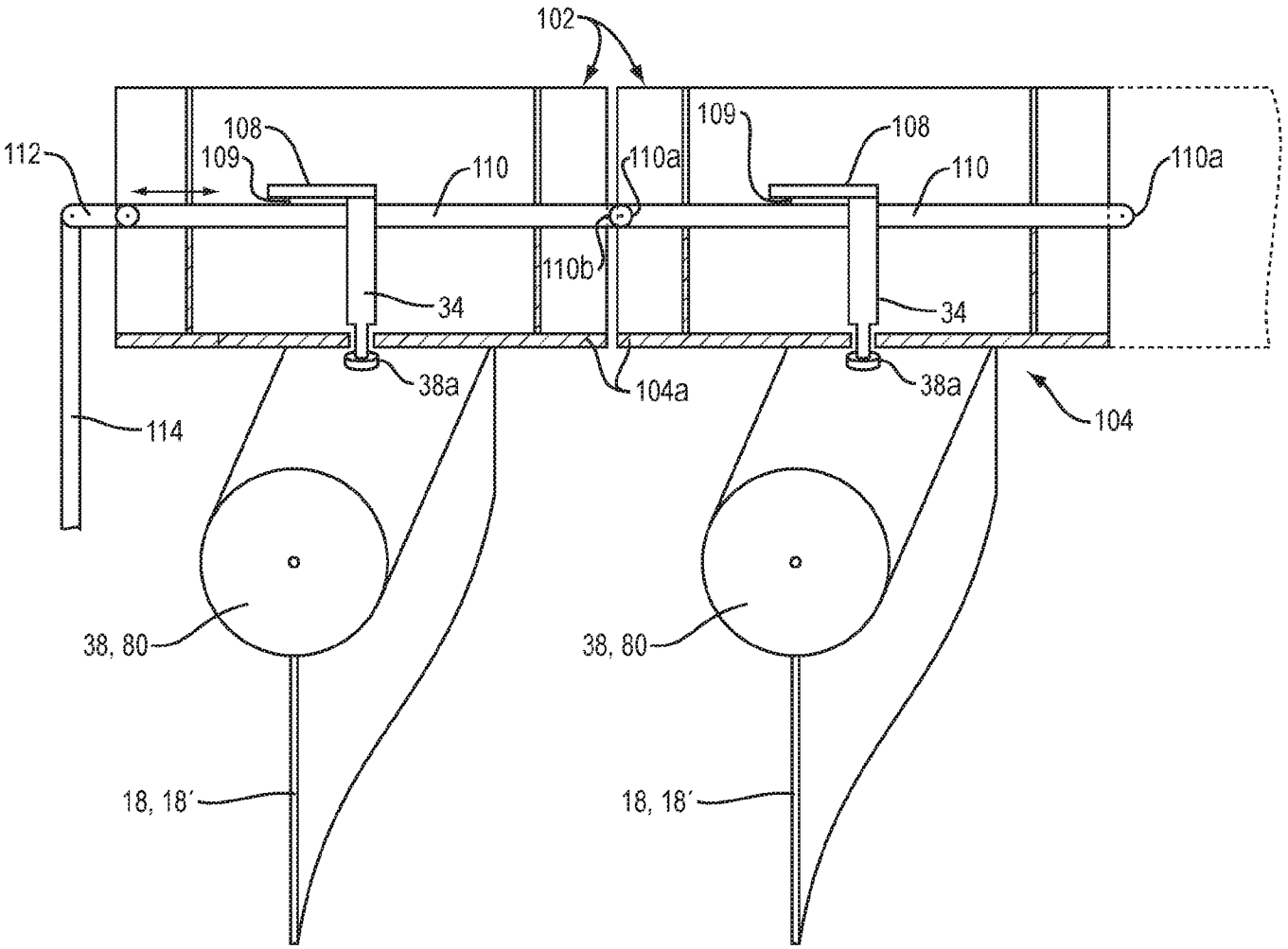
FIG. 5 is an isometric view with parts cut away showing still another module embodiment for use in the FIGS. 1A and 1B assembly.

Refer now to FIG. 5 illustrating another embodiment of my window blind assembly which includes a somewhat different mechanism for rotating the slats 18 or 18'. This embodiment is comprised of identical modules shown generally at 102, each of which includes a channel-shaped head rail unit or segment 104*a* similar to unit 10*a* described above. The couplings 52 for joining adjacent units to form a complete head rail 104 have been omitted for ease of illustration. As before, each module 102 also includes a slat housing 38 or 80 pivotally connected by an axle 34 to the bottom wall of each unit 104*a* midway along its length. However, instead of providing a worm gear at the upper end of axle 34 to form the motion converter, that axle is topped off by a short lever arm 108 which extends laterally within the head rail unit or segment 104*a*. The free end of the lever arm 108 is pivotally connected at 109 to an actuator unit or segment 110 which extends along the length of that unit 104*a* and is slidably supported by slotted partitions 111. Each actuator unit 110 is formed with a hook 110*a* at one end and an eye 110*b* at its opposite end, the hook and eye being adapted to mate with the eye and hook, respectively, of adjacent actuator units 110. When the actuator units or segments 110 are secured together and moved one way or the other along the head rail 104, the slats 18 or 18' are rotated in unison between their open and closed positions as described above.

To facilitate moving the actuator units, an actuator extension 112 may be connected to the actuator unit at an end of the head rail 104, e.g. the left end as shown in FIG. 5. The other end of the extension 112 connects to a vertical wand 114 by which a user may open and close the slats 18 or 18', even when the slats are partially raised. Thus, the FIG. 5 embodiment has all of the advantages described above in connection with the blinds depicted in the other drawing figures. It has an additional advantage in that it is less expensive to make than those other embodiments because it requires no gears.

Figure 6:
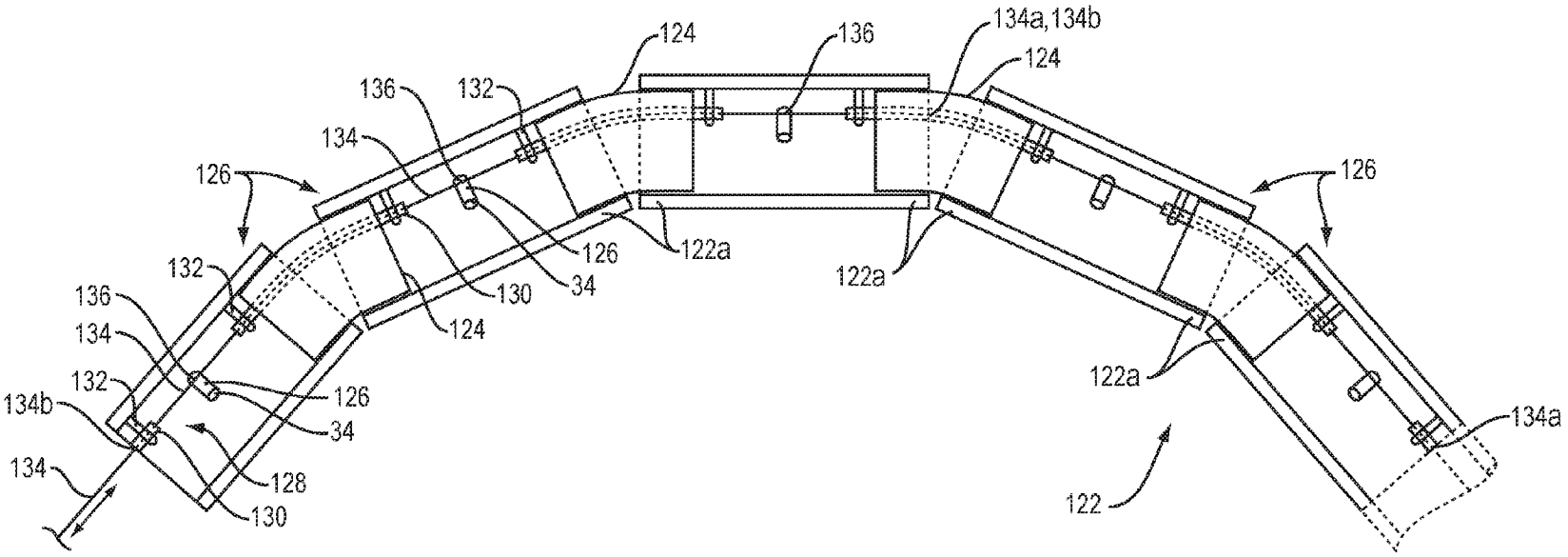
FIG. 6 is a top plan view of a modular blind assembly embodiment suitable for a bow window.

Refer now to FIG. 6, which illustrates an embodiment of my window blind assembly which may be fitted to a bow window having substantially any curvature. This embodiment comprises a plurality of similar modules indicated at 120, each of which includes a channel-shaped head rail unit or segment 122*a*. The units 122*a* of adjacent modules may be secured together by flexible couplings 124 to form a complete head rail 122. A slat housing 38 or 80 (not shown) is suspended from each head rail unit by an axle 34, which in this case is topped off by a lever arm 126.

Positioned inside each head rail unit 122*a* is a segment 128 of coaxial cable similar to a speedometer cable. That is, cable segment 128 has a flexible outer sheath 130 which is secured at two points 132 along the sheath to the associated unit 122*a* and a flexible inner wire 134 which is movable relative to sheath 130, both rotationally and longitudinally. The sheath 130 is cut away between points 132 to allow a connection at 136 of the cable wire 134 to the free end of the lever arm 126 in that unit or segment 122*a*. Preferably, each connection 136 is adjustable, e.g. a sleeve at the end of the lever arm with a set screw, so that the connections 136 can be adjusted along the wires 134. In this way, the open and closed positions of all of the slats in the blind can be set, depending on the curvature of the bow window, so that all the slats open and close together.

Still referring to FIG. 6, the wire component 134 of the cable segment 128 in each head rail unit or segment 122*a* is formed with a hook 134*a* at one end and an eye 134*b* at the other end, enabling those wires to be hooked to the eyes and hooks, respectively, of the wires 134 in the adjacent head rail units 122*a* comprising the head rail 122. A wire extension 138 may be hooked to the wire 134 at one end of the head rail, e.g. the left end shown in FIG. 6, that extension leading to a wand (not shown), enabling a user to move all of the wires 134 in one direction or the other to rotate all of the housings 38 or 80 in unison to open and close the slats 18 or 18', as described above. Due to the presence of the bow, the edges of adjacent slots may be spaced apart to some extent. However, the blind will still block most of the sunlight incident on the blind. To avoid such gaps, the slats can be designed to overlap as described above.

Of course, if each wire 134 were fitted with a worm gear along its length for meshing with a gear mounted to the top of axle 34 of the associated module 120, the common wire could be rotated to turn the slats 18 or 18' in the same manner described above in connection with FIGS. 2A and 2B.

Figure 6B:
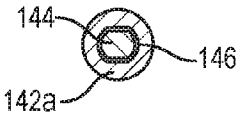
FIG. 6B is a sectional view taken along line 6B-6B of FIG. 6A.
Figure 6A:
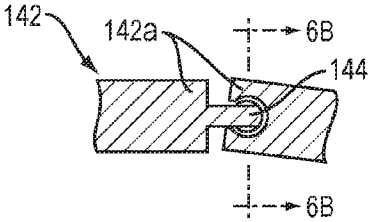
FIG. 6A is a fragmentary longitudinal sectional view showing a segment of a curved foot rail for use in the FIG. 6 embodiment.

Since the blind assembly shown in FIG. 6 has a curved head rail, it should also have a curved foot rail as shown generally at 142 in FIG. 6A. Rail 142 is composed of straight foot rail units or segments 142*a* which are similar to unit 14*a* depicted in FIG. 2A except that the key and keyways at the ends of the unit are replaced by a ball 144 and socket 146, both of which have flats at their tops and bottoms as shown in FIGS. 6A and 6B so that the adjacent keyed-together units 142*a* can pivot in a horizontal direction but not in a vertical direction.

Figure 7:
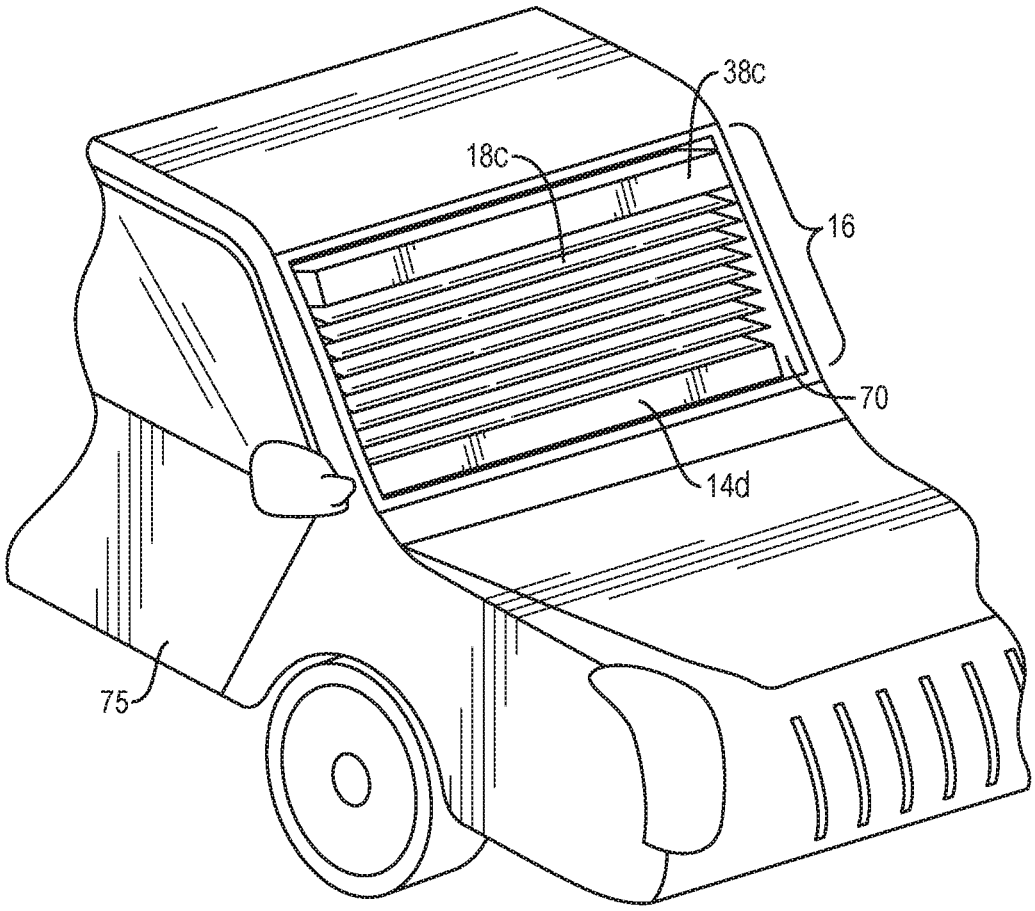
FIG. 7 is a venetian accordion blind that may be utilized in a motor vehicle.

FIG. 7 is a venetian accordion blind that may be utilized in a motor vehicle 75, such as a car or boat, to deflect heat or provide privacy. It is noted that blind 16 can be adjusted in a similar manner, as described above, to be sized to fit within a windshield 70 by simply pulling or pushing foot rail 14*c* to a certain height.

Figure 8:
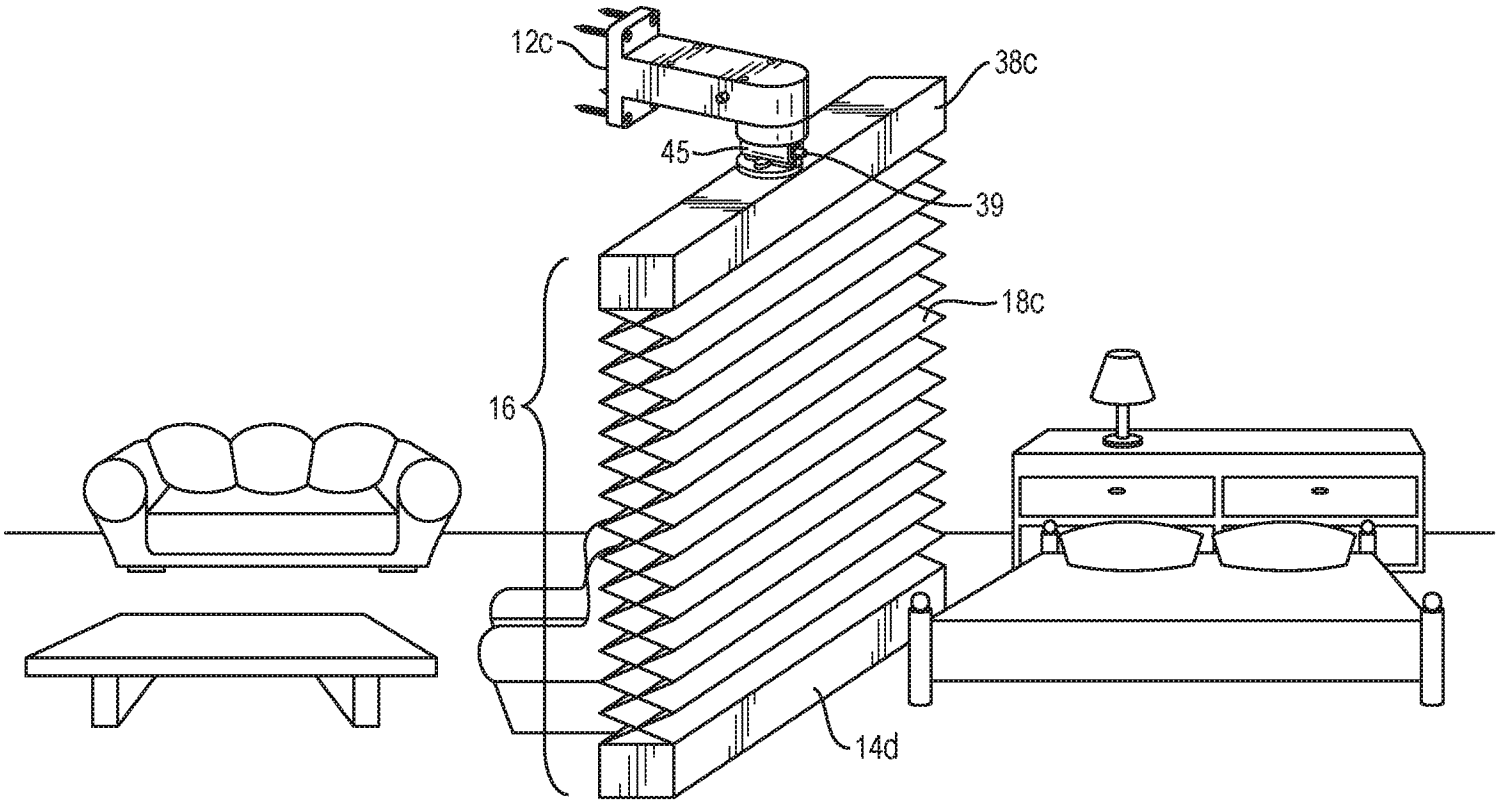
FIG. 8 is a venetian accordion blind that may be utilized as a door or a room divider.

FIG. 8 is a venetian accordion blind that may be utilized as a door or a room divider. Specifically, different materials may be utilized for the slats 18, 18*c*, and a user may attach head rail 10 or head rail unit 10*c* to a ceiling or wall. Advantageously, a user can join a plurality of assemblies and can utilize the venetian accordion blind(s) to divide or split a room or space. When the user does not wish to divide the room, the user can raise the foot rails 14 of the joined assemblies, as described above. It is noted that the blinds may be controlled by the electric motor, as described above, to easily and quickly allow the user to expose or hide the room divider.

Figure 9:
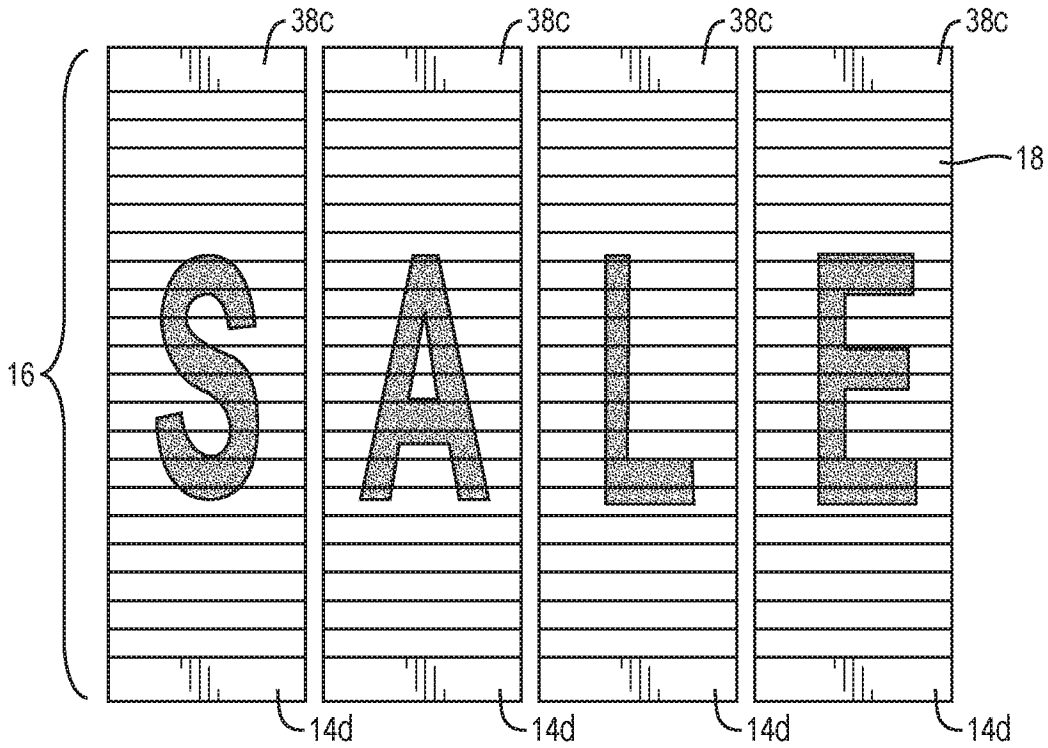
FIG. 9 is a venetian accordion blind that may be utilized as a banner or advertisement.

FIG. 9 are venetian accordion blinds that may be utilized as a banner or advertisement. Specifically, the head rails 10 or head rail units 10*c*, may be pivoted in unison to expose or show the advertisement. For example, the advertisement may be displayed in a window, that for example, may be rounded, or from light posts that require a rounded view. Each assembly may be in the "open" position, so that the banner or advertisement is not shown. However, and as shown in FIG. 9, when the assemblies are pivoted, the banner or advertisement 94 that reads "SALE" may be displayed or exposed. It will be appreciated that in alternative embodiments, differing text may be utilized. As such, the description of the banner reading "SALE" should be taken as exemplary only. In alternative embodiments and as described above, one or more slats 18*c*, may be a bendable electronic display to display the banner or advertisement digitally or utilizing a television, projector, or other device as known by those skilled in the art.

Figure 10:
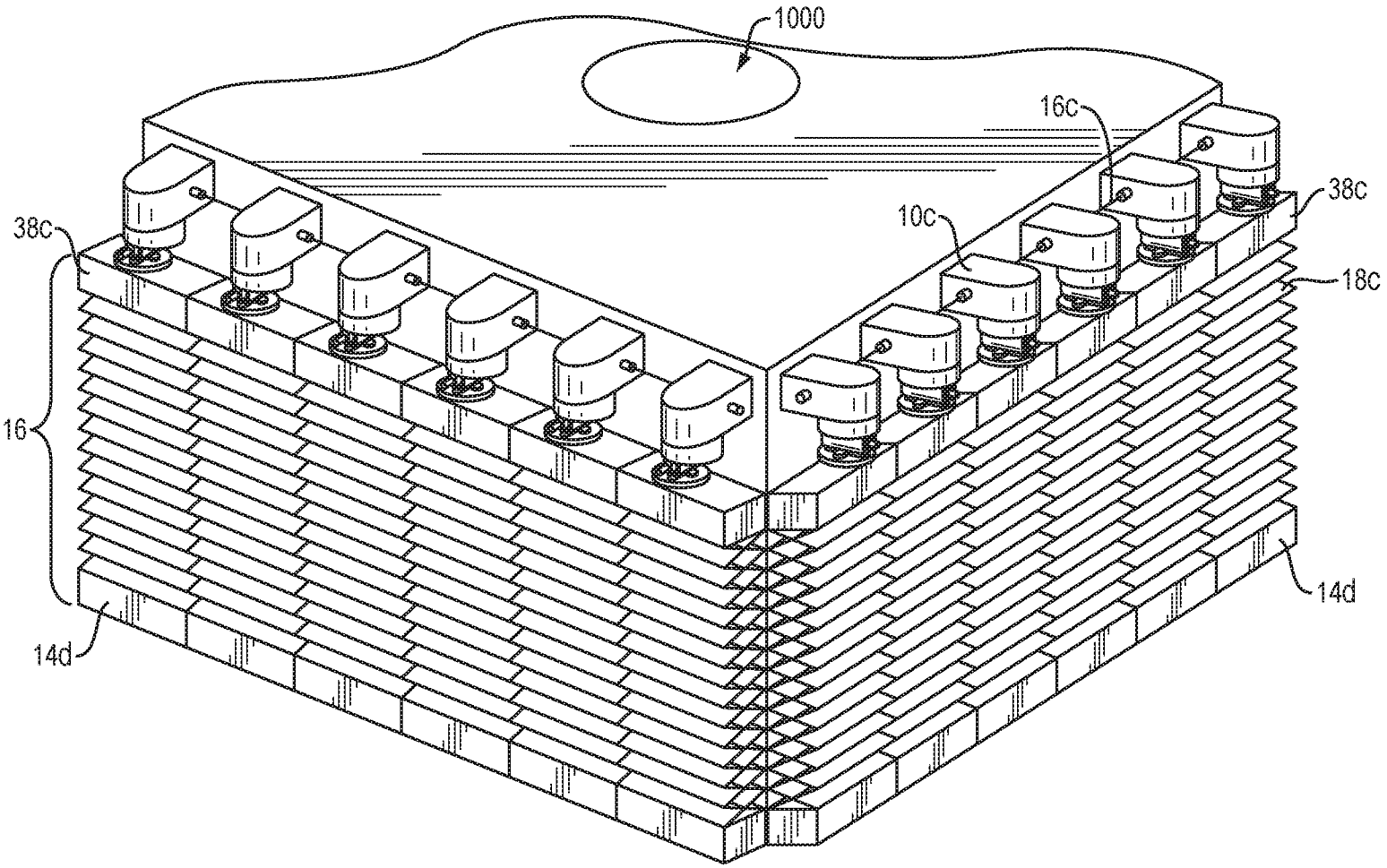
FIG. 10 is a venetian accordion blinds that may be utilized as a lamp or light shade.

FIG. 10 are venetian accordion blinds that may be utilized as a lamp or light shade. Specifically, the head rail or head rail units 10*c* may be joined to make a square, circle or other shape that may surround a light source, such as a recessed light, lamp or light fixture 1000. Specifically, and as seen in FIG. 10, the length of the blinds can be altered by raising rail 14*d*. Further, more light may be emmitted or allowed to travel outwardly by pivoting the assembling utilizing string 16*c*, or different mechanism such as a tape measure style arrangement, that allows the assemblies to rotate or pivot in unison.

Figure 11:
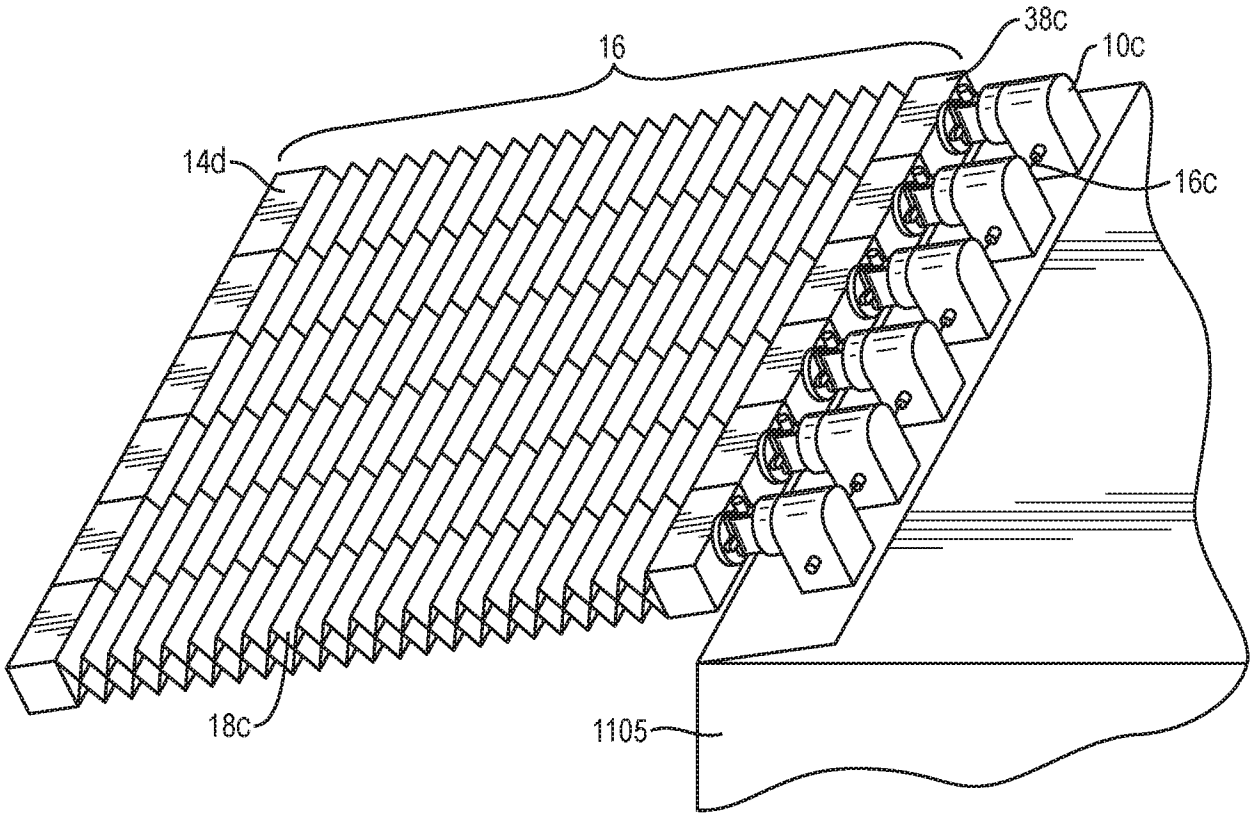
FIG. 11 is a venetian accordion blinds that may be utilized as an awning.

FIG. 11 are venetian accordion blinds that may be utilized as an awning. Specifically, the head rail or head rail units 10*c* may be joined and attached to a home or building or other frame 1105 as shown in FIG. 11 to block or shade the sun.

Figure 12:
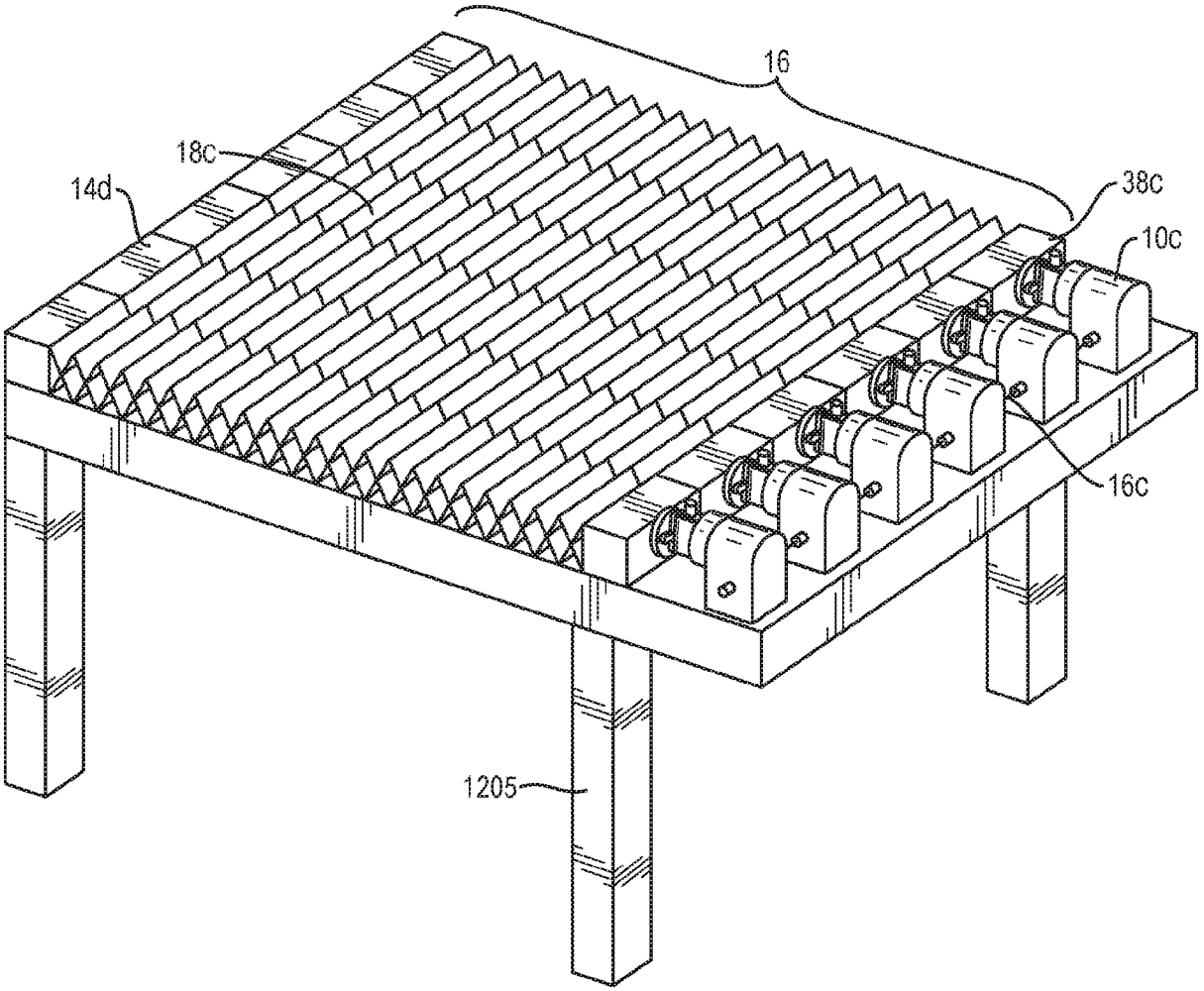
FIG. 12 is a venetian accordion blinds that may be utilized as a sunshade.

FIG. 12 are venetian accordion blinds that may be utilized as a sunshade. Specifically, the head rail or head rail units 10*c* may be joined and attached to frames 1205 to block or shade the sun. It is noted that the slats 18 may be opened to allow sun to enter.

Figure 13:
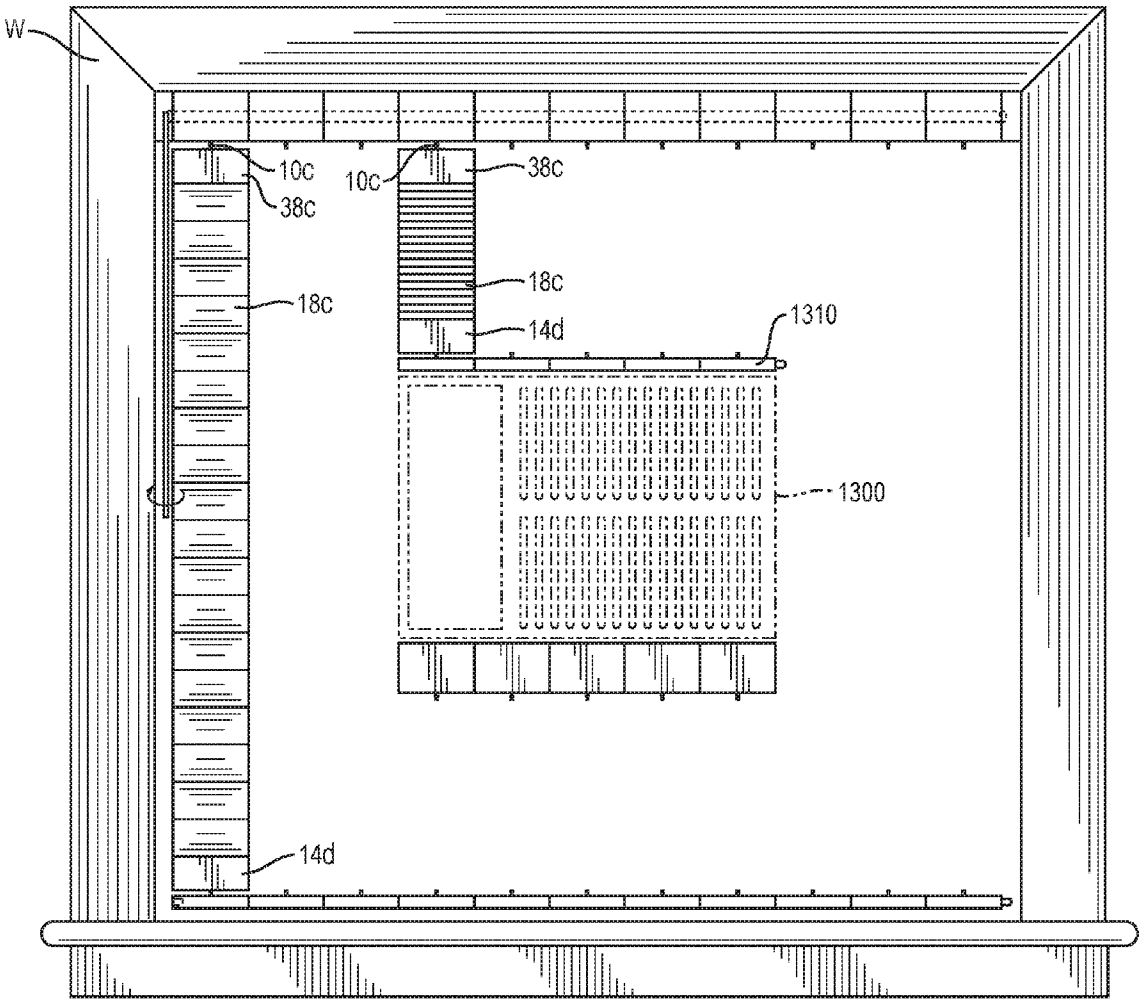
FIG. 13 is a venetian accordion blinds that may be utilized to accommodate an object placed in a window.

FIG. 13 are venetian accordion blinds that may be utilized to accommodate an object placed in a window. In FIG. 13, the object in the window is an air conditioning system 1300. It is noted that one slat 18*c* or a plurality of slats 18*c* may be utilized to accommodate the air conditioning system 1300. For example, a single slat 18*c* may be sized, (e.g., width and/or length), to accommodate the air conditioning system 1300 (not shown). Alternatively, and as shown in FIG. 13, a plurality of slats 18*c* may be of different sizes (e.g., width and/or length) to accommodate the air conditioning system 1300. It is noted that housing unit 38*c* and/or 14*d*, may, in an embodiment, be secured to rail 1310 that is attached to the air conditioning system 1300. It is also noted that the blinds of FIG. 13 may be connected to a preexisting window shade or blind to then accommodate the air conditional system 1300, or any device or object in the window space.

Figure 14:
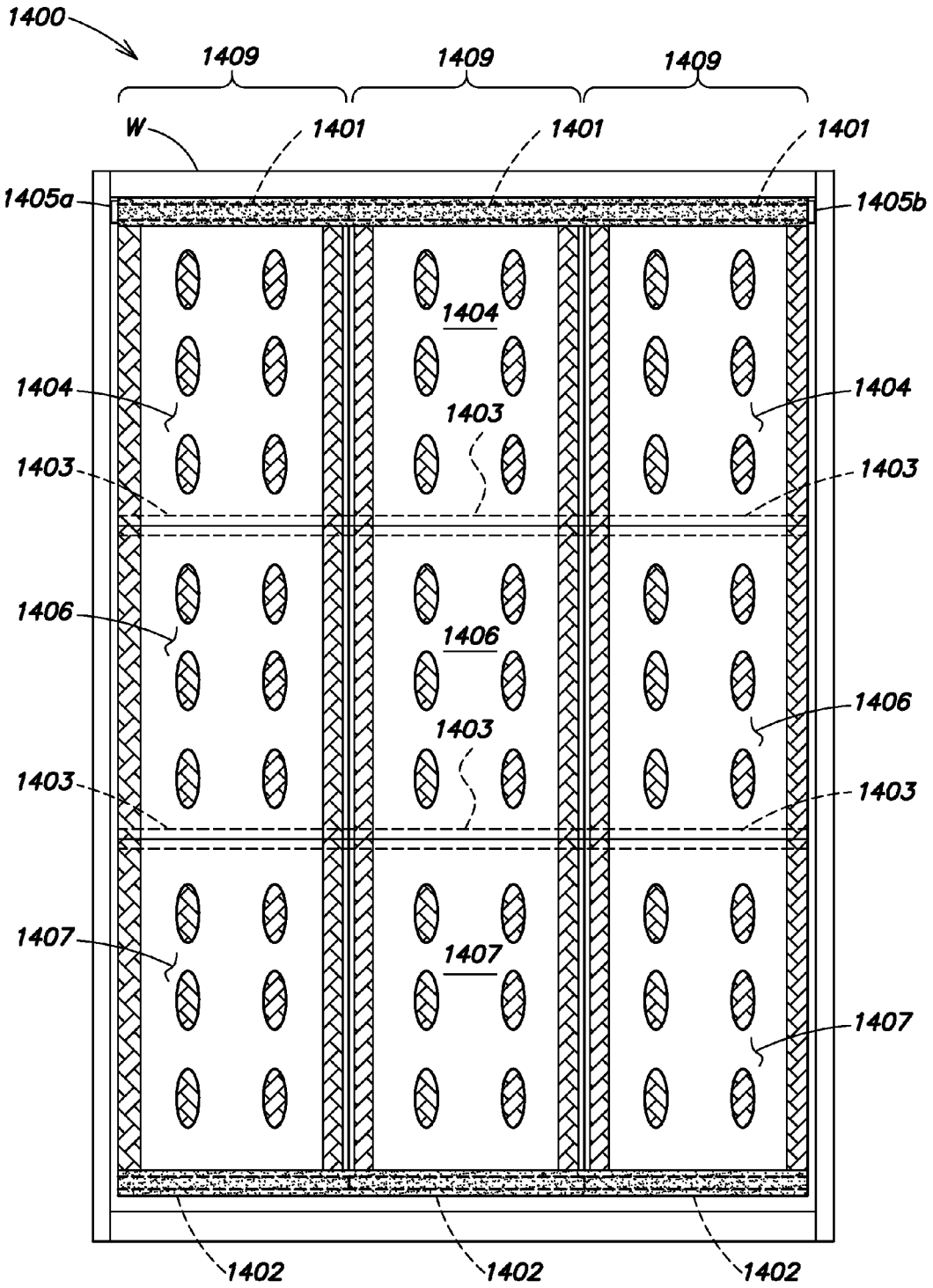
FIG. 14 is a elevational view of a modular roman shade in accordance with an illustrative embodiment of the present invention.

FIG. 14 is a front view of a modular roman shade 1400 that may be mounted at the top of a window W by means of brackets 1405*a* and 1405*b*. The modular roman shade 1400 includes a head rail unit 1401, a foot rail unit 1402, at least one intermediate rail unit(s) 1403, and a plurality of slat components. Each head rail unit 1401 is coupled to a top slat component 1404. For example, the head rail unit 1401 may be a tube, and portions of a first end of the top slat component 1404 may be inserted inside the head rail unit 1401, as will be described in further detail with respect to FIG. 16A. Alternatively, the first end of the top slat component 1404 may be clipped, or otherwise attached to the head rail unit 1401 in a variety of different ways, as known by those skilled in the art. The other end ("second end") of top slat component 1404 may be coupled to the intermediate rail unit 1403 (as shown in phantom), and a first end of the intermediate slat component 1406 may also be coupled to the intermediate rail unit 1403. For example, and as will be described in further details with respect to FIG. 16A, the intermediate rail unit 1403 may be a tube wherein portions of the second end of the top slat component 1404 and the first end of the intermediate slat component 1406 may be inserted into the intermediate rail unit 1403. The coupling of the top slat component 1404 and the intermediate slat component 1406 to the intermediate rail unit 1403 allows for the transition from the top slat component 1404 to the intermediate slat component 1406 to appear seamless and also appear as a single piece of fabric with a simple crease.

In addition, and as depicted in FIG. 14, a second end of the intermediate slat component 1406 may be coupled to an additional intermediate rail unit 1403, and a first end of a bottom slat component 1407 may also be coupled to the additional intermediate rail unit 1403. The intermediate slat component 1406 and the bottom slat component 1407 may be coupled to the additional intermediate rail unit 1403 in a similar manner as described above with reference to the coupling of the top slat component 1404 and the intermediate slat component 1406 to the intermediate rail unit 1403. In addition, the coupling of the intermediate slat component 1406 and the bottom slat component 1407 to the additional intermediate rail unit 1403 allows for the transition from the intermediate slat component 1406 to the bottom slat component 1407 to appear seamless and also appear as a single piece of fabric with a simple crease. A second end of the bottom slat component 1407 may be coupled to the foot rail unit 1402 in a similar manner as described above with reference to the coupling of the first end of the top slat component 1404 to the head rail unit 1401.

Thus, the modular roman shade 1400 includes at least one module 1409 that consists of the head rail unit 1401, at least one intermediate head rail unit 1403, and the foot rail unit 1402. It is expressly contemplated that the head rail unit 1401, at least one intermediate rail unit 1403, and foot rail unit 1402 may be any size and/or shape, and that the individual rail units may be different sizes. For example, the head rail unit 1401 may be a different shape and/or size than that of the foot rail unit 1402 and further the foot rail unit 1402 may be a different size and/or shape than the at least one intermediate rail unit 1403. In addition, although the modular roman shade 1400 as depicted in FIG. 14 includes two intermediate rail units 1403 and a single intermediate slat component 1406, it is expressly contemplated that the modular roman shade 1400 may include a single intermediate rail unit 1403 with no intermediate slat component where the top slat component 1404 and the bottom slat component 1407 are coupled to a single intermediate rail unit 1403. Alternatively, any additional number of intermediate rail units 1403 and intermediate slat components 1406 may be added to the module 1409 of the modular roman shade 1400. Further, although the modular roman shade 1400 as depicted in FIG. 14 includes three modules 1409 that are coupled together, as will be described in further detail with respect to FIG. 15, it is expressly contemplated that the modular roman shade 1400 may include one module 1409, or any number of modules 1409 coupled with one or more adjacent modules 1409.

Each slat component (e.g., the top slat component 1401, the bottom slat component 1406, and the intermediate slat component 1407) may be individually removed between the individual rail units. For example, the individual slat components may be removed to be cleaned, or to be substituted with a different slat component (e.g., having a different pattern and/or being of a different material). For example, a user may desire to have a particular design make up the entire modular roman shade 1400 and thus may select particular materials and/or patterns for each slat component of the modular roman shade 1400. Further, it is expressly contemplated that each slat component may be different sizes and/or shapes to fit any windows or enclosures.

In addition, it is noted that each head rail unit 1401 and foot rail unit 1402 may include a mechanism for attachment, such as an adhesive component or a hook and loop fastener (e.g., Velcro®) on a front portion of the head rail unit 1401 and a front portion of the foot rail unit 1402, as will be described in further detail below. The adhesive component or hook and loop fastener, may, for example, be utilized to allow a user to add a design to the top and bottom of the modular roman shade 1400 in the form of a valence.

Figure 15A:
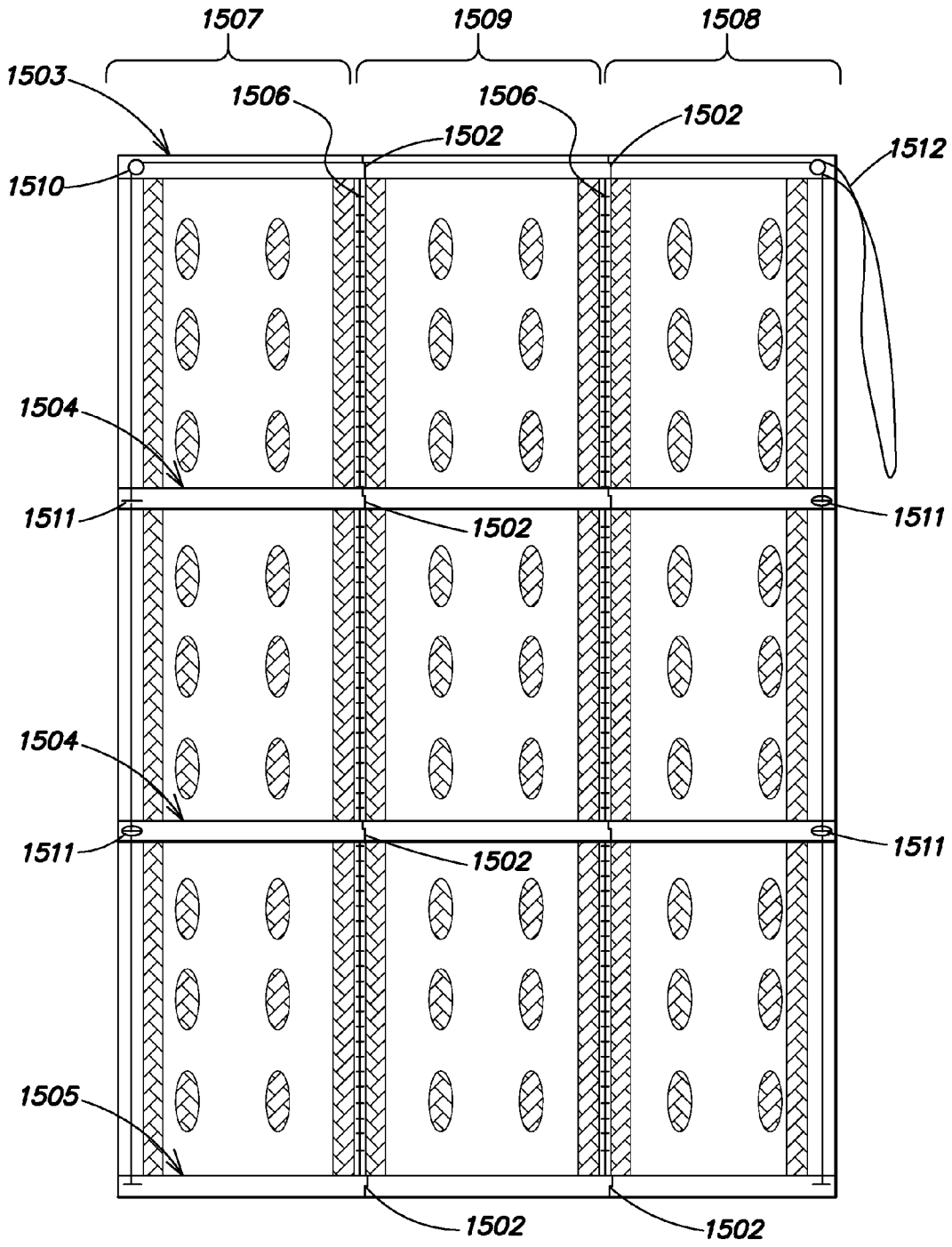
FIG. 15A is a rear view of a modular roman shade in accordance with an illustrative embodiment of the present invention.

FIG. 15A is a rear view of the modular roman shade 1400. It is noted that the modular roman shade 1400 includes three modules (e.g., 1507, 1508, and 1509), where respective components of the three modules are coupled to make up the single modular roman shade 1400. It is expressly contemplated that although the modular roman shade 1400 depicted in FIG. 15A includes three modules, it is expressly contemplated that the modular roman shade 1400 may include a single module or additional modules. In addition, although the modular roman shade 1400 includes two intermediate rails (e.g., 1504), it is expressly contemplated that the modular roman shade 1400 may include a single intermediate rail or any other number of intermediate rails. Specifically, a user may add any number of intermediate rail units to change the overall size and shape of the modular roman shade 1400. For example, for a window that is long in length, the user may add a particular number of intermediate rail units and additional intermediate slats to change the size of the modular roman shade 1400. Further, for a window that is extremely wide, the user may add additional modules to increase the overall width of the modular roman shade 1400. Furthermore, if the window is bow shaped, or a different shape, the user may customize the modular roman shade 1400 by adding or removing particular slat components and rail units. Advantageously, a user can alter the size (e.g., length and/or width) and/or shape of the modular roman shade 1400 in an efficient and easy manner.

As depicted in FIG. 15A, each head rail unit may be connected to or coupled to one or more adjacent head rail units utilizing a rail unit fastener 1502 to form a single head rail 1503. Specifically, and as depicted in FIG. 15A, the head rail unit of the left most module 1507 and the head rail unit of the right most module 1508 are coupled to opposing ends of the head rail unit of the middle module 1509 through use of respective rail unit fasteners 1502. In addition, adjacent foot rail units and adjacent intermediate rail units may also be coupled utilizing rail unit fasteners 1502 to form one or more single intermediate rails 1504 and a single foot rail 1505.

It is noted that the respective head rail units, foot rail units, and the intermediate rail units 1403 may be made of any type of material, such as, but not limited to, metal, wood, bamboo, plastic, etc. In addition, the rail unit fasteners 1502 may comprise any of a variety of fastener, such as, but not limited to, a male/female coupling system, clips, zipper(s), adhesive, etc. As further depicted in FIG. 15A, each slat component may be coupled to an adjacent slat utilizing slat fasteners 1506. The slat fasteners 1506 may be a variety of fastener, such as, but not limited to, a male/female coupling system, clips, zipper(s), adhesive, etc. Thus, when the adjacent rail units and adjacent slat components are coupled utilizing respective rail unit fasteners 1502 and slat fasteners 1506, to couple the components of the adjacent modules (e.g., 1507, 1508, and 1509), the modular roman shade 1400 is formed.

In addition, the modular roman shade 1400 may include a pulley system 1510 that is housed in the single head rail 1503 that may be utilized to raise and lower the modular roman shade 1400. Specifically, the pulley system 1510 may include a string that may be threaded from the single head rail 1503, through a connector 1511, such an eye hook connector, of the one or more single intermediate rails 1504, and eventually to the single foot rail 1505. Thus, and in operation, a user may pull on initiator cord 1512 of the pulley system 1510 to cause the string to coil up or uncoil to raise and lower the modular roman shade 1400, thus allowing light to enter/leave the window area, for example. Alternatively (not shown), the pulley system 1510 may not be attached to the single foot rail 1505 and may be coupled to the one or more single intermediate rails 1504, thus raising the modular roman shade 1400 at a position of the particular single intermediate rail 1504 at which the pulley system 1510 is ultimately connected to. Advantageously, the modular roman shade 1400 can be raised or lowered to any height, utilizing, for example, the pulley system 1510. It is expressly contemplated that a variety of mechanisms may be utilized to raise and lower the modular roman shade 1400, as known by those skilled in the art.

Alternatively, the single head rail 1503 may hold a bail retraction mechanism, not shown, to allow for the modular roman shade 1400 to be raised or lowered, by pulling or lifting the single foot rail 1505, as known by those skilled in the art. Specifically, the modular roman shade 1400 may be a cordless balanced roman shade with consistent variable spring motion. Advantageously, minimal force (e.g., by pulling or lifting) is required to position the modular roman shade 1400 at the desired height (e.g., open, closed, midway) with no required pulley system or "locking mechanism."

Figure 15B:
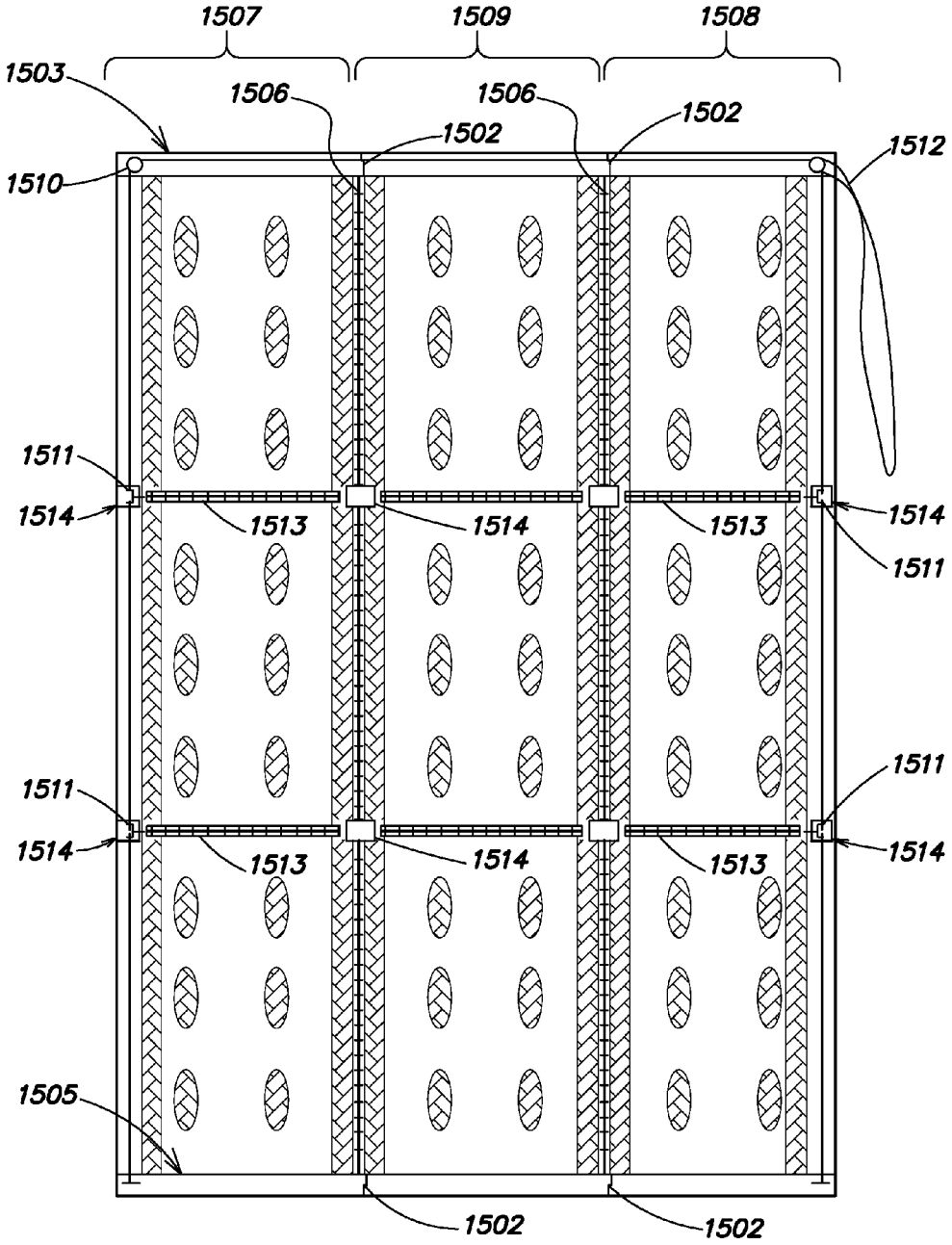
FIG. 15B is a rear view of a modular roman shade in accordance with an illustrative embodiment of the present invention.

FIG. 15B is a rear view of the modular roman shade 1400 where intermediate rail units pieces are utilized, and wherein the intermediate rail units do not form a single rail. Specifically, the modular roman shade 1400 may include a single head rail 1503, a single foot rail 1505, intermediate rail unit pieces 1514, and slat components. As depicted in FIG. 15B, intermediate rail unit pieces 1514 may be positioned at the ends and also positioned where two slat components meet. Specifically, the intermediate rail unit pieces 1514 on the ends of the modular roman shade 1400 may include the eye hook 1511, while the intermediate rail unit pieces 1514 on the interior of the modular roman shade 1400 may be a fastener to connect two adjacent slat components. The intermediate rail unit pieces 1514 may be, for example, a variety of fasteners utilized to provide rigidity or structure to the overall modular roman shade 1400. In addition, the slat components that utilize the intermediate rail unit pieces 1514 (e.g., a top slat component and an intermediate slat component) may be coupled to each other utilizing, for example, zipper mechanism 1513 to provide further rigidity or structure. Although reference is made to zipper mechanism, it is expressly contemplated that a variety of coupling mechanisms may be utilized. Thus, and in operation, a user may pull on initiator cord 1512 of the pulley system 1510 to cause the string to coil up or uncoil to raise and lower the modular roman shade 1400, thus allowing light to enter/leave the window area, for example.

Although FIG. 15B is described to include single foot rail 1505, it is expressly contemplated that the modular roman shade 1400 may include a single head rail 1503, intermediate rail unit pieces 1514, and slat components. As such, the bottom portions of the bottom most slat component may be rigid or include a material that provides structure to the bottom of the overall modular roman shade 1400. That is, in alternative embodiments, a modular roman shade 1400 may be constructed without a single foot rail 1505. In such embodiments, the description of the single foot rail 1505 should be construed as any structure that provides structure to the bottom of the overall modular roman shade 1400.

Figure 16A:
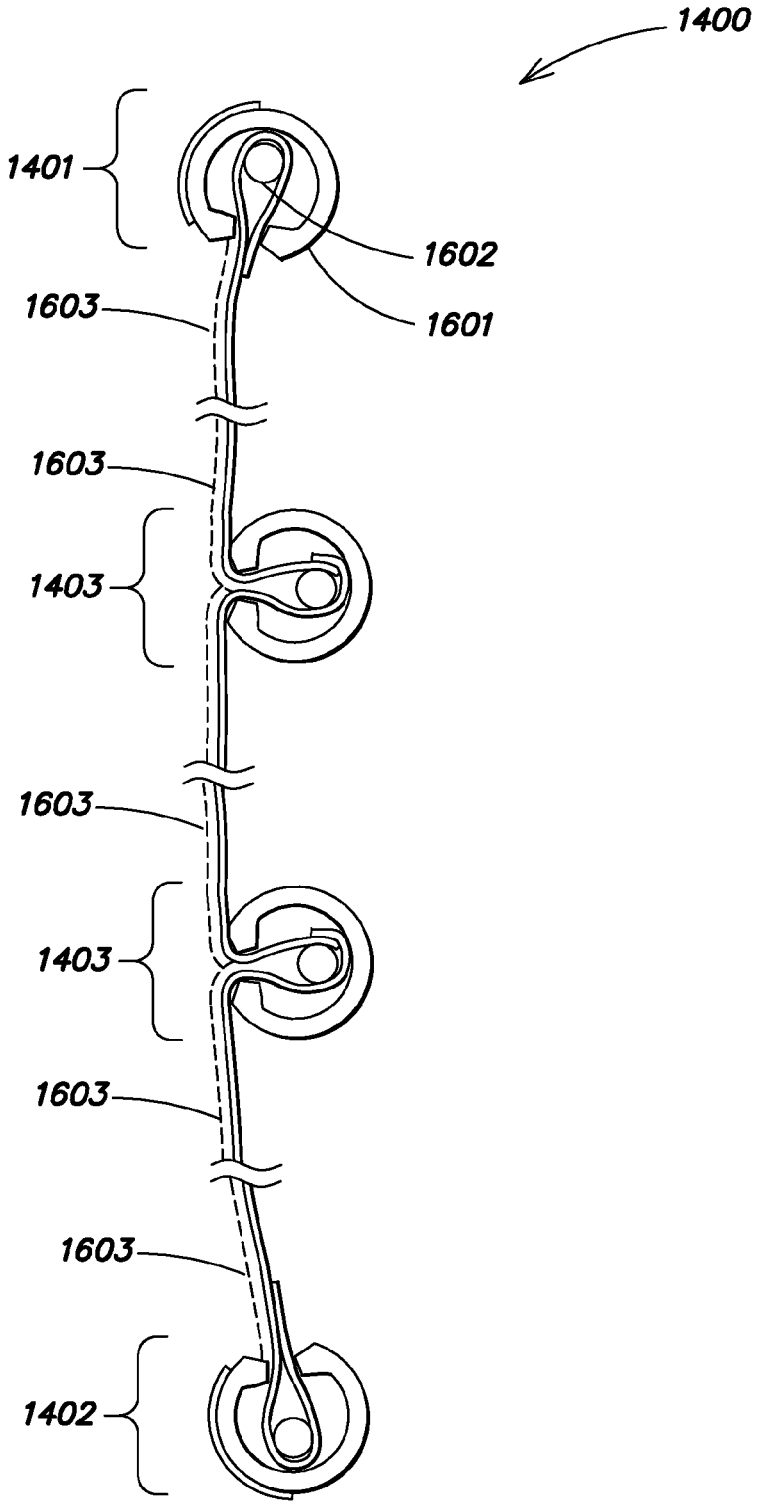
FIG. 16A is a side view of a modular roman shade utilizing a solid tube in accordance with an illustrative embodiment of the present invention.

FIG. 16A is a side view of the modular roman shade 1400. Specifically, FIG. 16A shows the individual slats (e.g., top slat component, intermediate slat component, and bottom slat component) being inserted in the head rail unit 1401, intermediate rail units 1403, and foot rail unit 1402. In one embodiment, the rail units are tubes 1601 what include a rod (e.g., a fastener) 1602 to hold the individual slat components within the tubes 1601. Specifically, the individual ends of the slat components may be inserted into the tubes 1601 and the rod 1602 may be snapped within the tube 1601 to hold the ends of the respective slat components within the tube 1601. For example, the head rail unit 1401 and foot rail unit 1402 may each hold an end of a single slat component, and specifically a first end of the top slat component 1404 and a second end of the bottom slat component 1407. In addition, each intermediate rail unit 1403 may hold or house respective ends of two slat components. Specifically, an intermediate rail unit 1403 may hold a second end of the top slat component 1404 and a first end of the intermediate slat component 1406, while the additional intermediate rail unit 1403 may hold a second end of the intermediate slat component 1406 and a first end of the bottom slat component 1407.

In addition, the slats of the modular roman shade 1400 may be layered and may include one or more additional slat components 1603 (shown in phantom). The additional slat components 1603 may be of any material, such as, but not limited to, vinyl or any other materials to add rigidity to the modular roman shade 1400, or to act as a liner to the modular roman shade 1400. It is noted that the one or more additional slat components 1603 can be any size and do not have to match the size of the other slat components (e.g., top slat component, intermediate slat component, and bottom slat component).

Figure 16B:
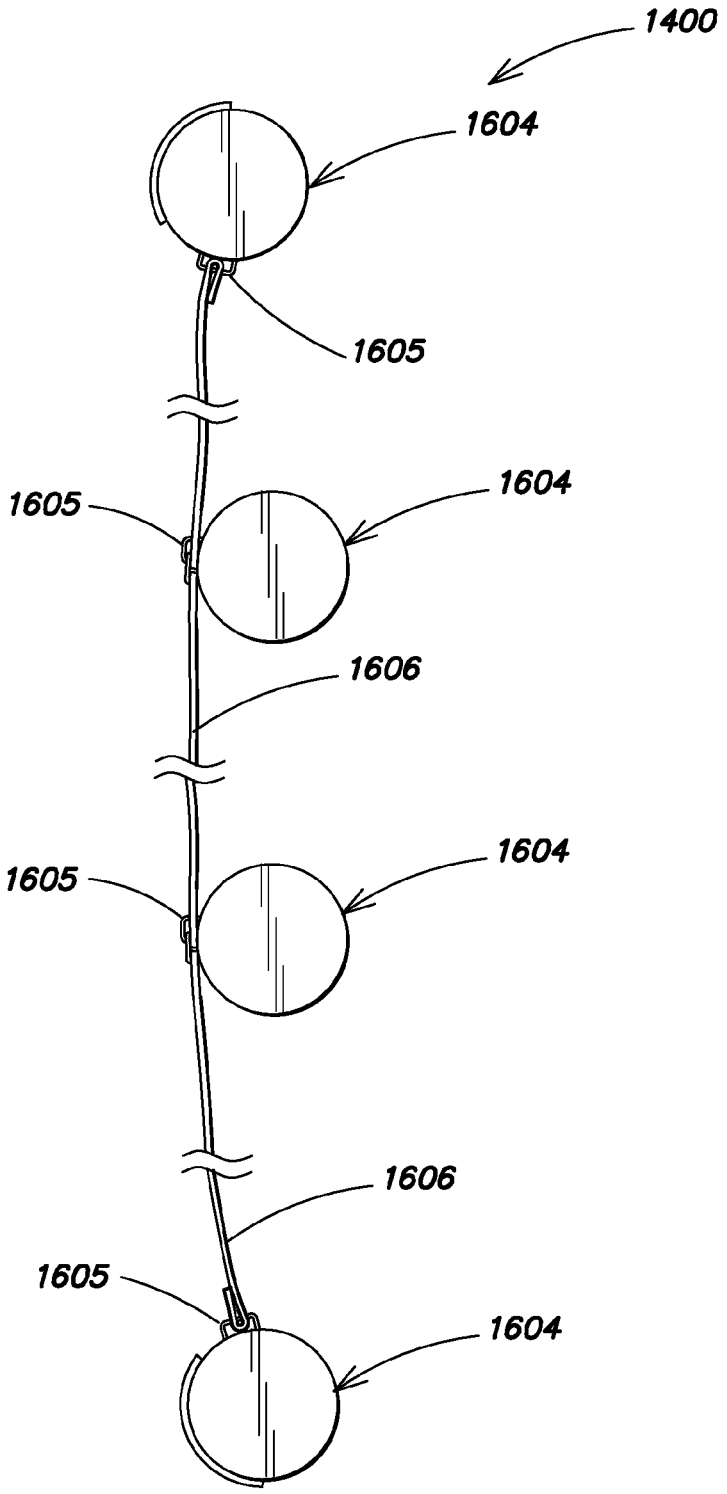
FIG. 16B is a side view of a modular roman shade utilizing a solid tube in accordance with an illustrative embodiment of the present invention.

Although reference is made to the rails units being hollow tubes, it is expressly contemplated that the rail units may be solid tubes, or any shaped rails where the respective slats may be coupled to the rail units. For example, the rail units may be solid tubes 1604 and have a clipping fastener 1605 on the front as shown in FIG. 16B, to allow for the respective slat components 1606 to be coupled to the rail units to form the entire modular roman shade 1400.

Figure 17A:
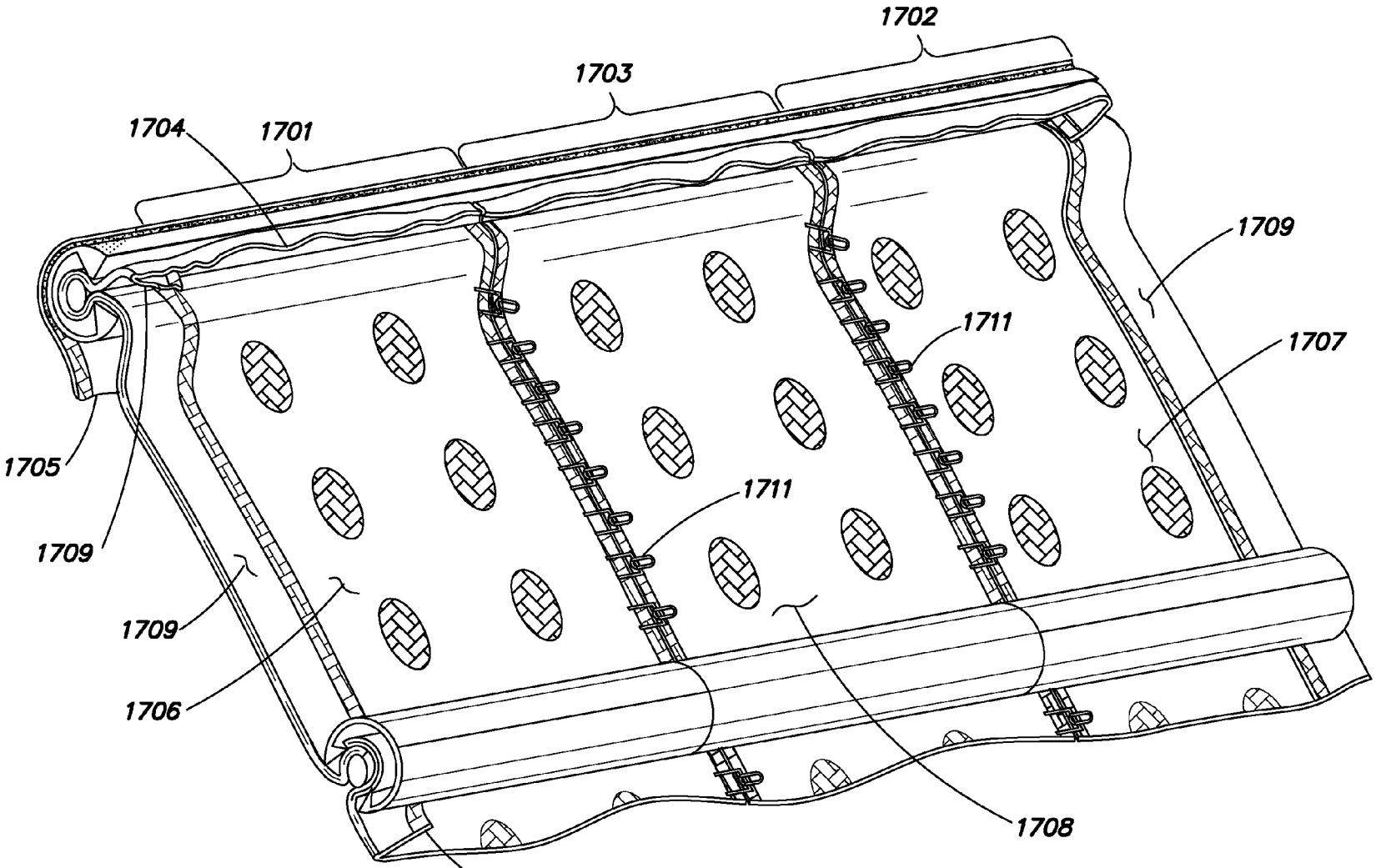
FIG. 17A is a detailed depiction of the connections between slat components and the manner in which the slat components may be coupled to each other through use of the rail units to form the modular roman shade in accordance with an illustrative embodiment of the present invention.

FIG. 17A is a detailed depiction of the connections between slat components and the manner in which the slat components may be coupled to each other through use of the rail units to form the modular roman shade 1400. Specifically, and with reference to FIG. 17A, it is noted that there may be excess material associated with the slat component 1706 of the left most module 1701 and the slat component 1707 of the right most module 1702. More specifically, there may be excess material 1709 on the left side of slat component 1706 of left most module 1701, and excess material 1704 at the top of the slat component 1706 of the left most module 1701. The excess material 1709 may be folded over to size the left side of the slat component 1706 to have the appropriate width to match the size of the head rail unit and intermediate rail unit of the left most module 1701. In addition, the excess material 1704 on the top of the slat component 1706 may be inserted within the respective rail unit such that the excess material is hidden within the respective rail unit.

Advantageously, the user can size the slat component to be any size by simply folding the side and/or "tucking" the top and/or bottom excess material within the rail units. In an alternative embodiment, the excess material 1709 may not be folded over such that the slat component is greater in length or shorter in length than the head rail unit. The slat component 1707 of the right most module 1702 may be altered in size in a similar manner as described with respect to the left most module 1701. In addition, the top and bottom excess material of middle module 1703 may be sized in a similar manner as described above, where the excess material is tucked into the rail units.

In addition, the slat component 1706 of the left most module 1701 and the slat component 1707 of the right most module 1702 are coupled to the slat component 1708 of middle module 1703 utilizing clipping fasteners 1711. Although reference is made to clipping fasteners 1711, it is expressly contemplated that a variety of fasteners may be utilized to couple the slat components together. In addition, and as depicted in the FIG. 17A, a valence 1705 may be attached to the adhesive or hook and loop fastener 1706 to add a decoration to the modular roman shade 1400. Although FIG. 17A depicts valence 1705 on the top of the modular roman shade 1400, it is expressly contemplated that the bottom of the modular roman shade 1400 (e.g., on foot rail unit(s)) may also include a valence 1705 to add a decoration to the bottom of the modular roman shade 1400.

Figure 17B:
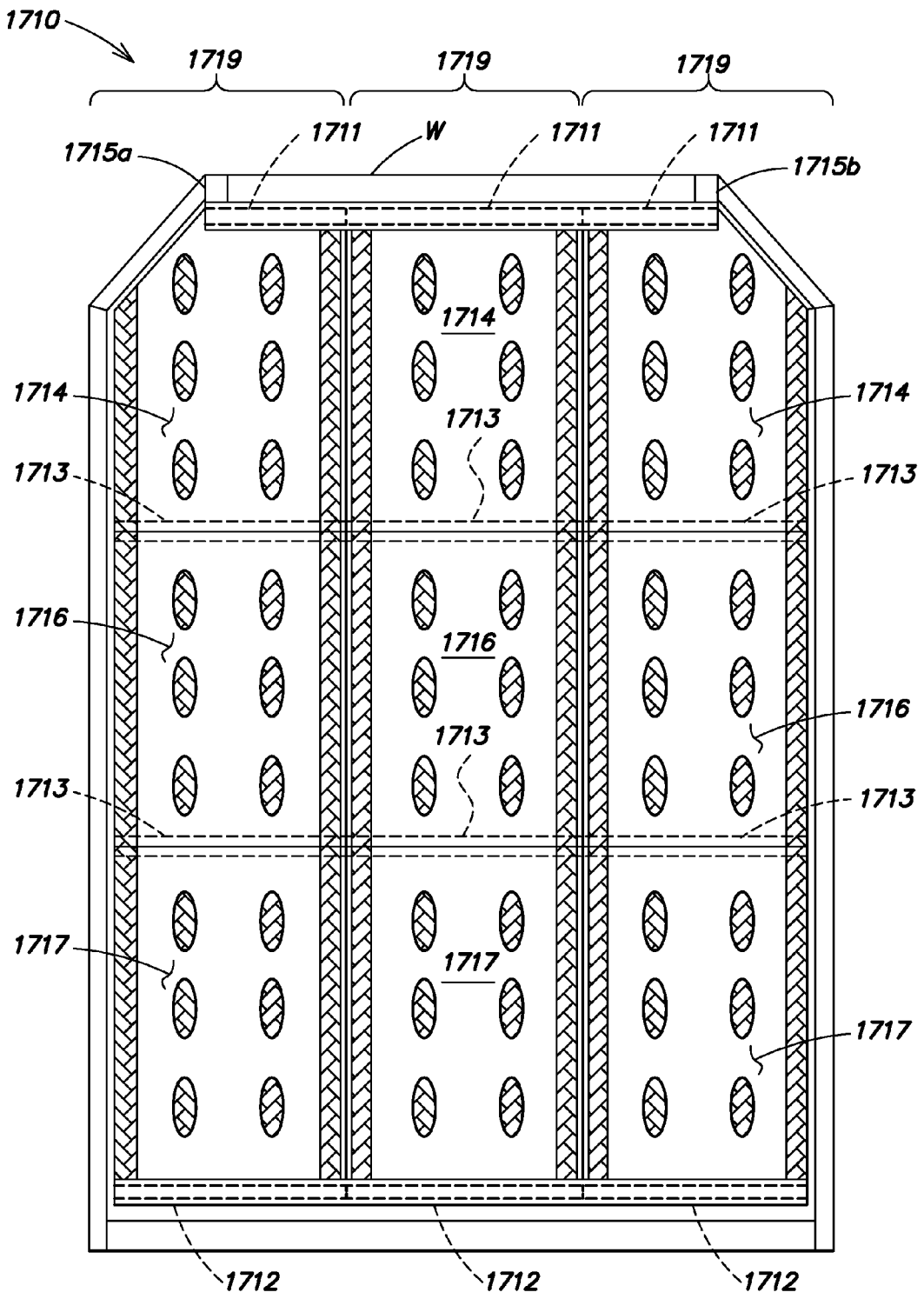
FIG. 17B is a detailed depiction of a front view of a modular roman shade that may be mounted at the top of a window in accordance with an illustrative embodiment of the present invention.

FIG. 17B is a detailed depiction of a front view of a modular roman shade 1710 that may be mounted at the top of a window W by means of brackets 1715*a* and 1715*b*. The modular roman shade 1710 includes a head rail unit 1711, a foot rail unit 1712, at least one intermediate rail unit(s) 1713, and a plurality of slat components. Each head rail unit 1711 is coupled to a top slat component 1714. For example, the head rail unit 1711 may be a tube, and portions of a first end of the top slat component 1714 may be inserted inside the head rail unit 1711. In another embodiment, the head rail unit 1711 may be substantially circular, substantially square, or any other shape. Alternatively, the first end of the top slat component 1714 may be clipped, zippered, or otherwise attached to the head rail unit 1711 in a variety of different ways, as known by those skilled in the art. It is expressly contemplated that head rail unit 1711 may be made of any material and may be any shape or size that can be coupled to the first end of the top slat component 1714.

In an embodiment, the two head rail units 1711 on the edges of the window may be smaller in length then head rail unit 1711 in the middle to accommodate the fact that the edges of the window W are angled. Specifically, and as will described in further detail with respect to FIG. 17D and FIG. 17E, the top slat components 1714 on the edges (i.e., excess material) may be folded over and attached to the back of the slat components 1714 to match the shape and/or size of the angled portions of window W.

In addition, the other end ("second end") of the top slat component 1714 and the first end of the intermediate slat component 1716 may be coupled together by use of a zipper or other connecting mechanism (e.g., such as, but not limited to, clips, magnets, hook and loop fastener (Velcro® brand) wherein the coupling together of the two ends forms the intermediate rail unit 1713. That is, the coupling of the second end of the top slat component 1714 and the first end of the intermediate slat component 1716 together, by, for example, a zipper, causes the zipper to provide rigidity and act as the intermediate rail unit 1713 (as shown in phantom). Alternatively, the intermediate rail unit 1713 may be a tube wherein portions of the second end of the top slat component 1714 and the first end of the intermediate slat component 1716 may be inserted into the intermediate rail unit 1713, in a similar manner as described above with reference to the head rail unit 1711. The coupling of the top slat component 1714 and the intermediate slat component 1716 to form the intermediate rail unit 1713 or coupled to the intermediate rail unit 1713 allows for the transition from the top slat component 1714 to the intermediate slat component 1716 to appear seamless and also appear as a single piece of fabric with a simple crease or fold when the shade is retracted to a selected distance as will be described with respect to FIG. 17C.

In addition, and as depicted in FIG. 17B, a second end of the intermediate slat component 1716 may be coupled to a first end of a bottom slat component 1717 to form the additional intermediate component 1703, in a similar manner as described above. Alternatively, the second end of the intermediate slat component 1716 may be coupled to the additional intermediate rail unit 1713, and a first end of a bottom slat component 1717 may also be coupled to the additional intermediate rail unit 1703, in a similar manner as described above. In addition, the coupling allows for the transitioning from the intermediate slat component 1716 to the bottom slat component 1717 to appear seamless and also appear as a single piece of fabric with a simple crease or fold when the shade is retracted to a selected distance as will be described with respect to FIG. 17C.

A second end of the bottom slat component 1717 may be coupled to the foot rail unit 1712 in a similar manner as described above with reference to the coupling of the first end of the top slat component 1714 to the head rail unit 1711. It is expressly contemplated that the slat components may be layered, such that, for example, the modular roman shade 1710 is thicker and includes a plurality or layers. In addition, the slat component would be of any material, such as, but not limited to, cloth, plastic, vinyl, etc.

Thus, the modular roman shade 1710 includes at least one module 1719 that consists of the head rail unit 1711, at least one intermediate head rail unit 1713, and the foot rail unit 1712. It is expressly contemplated that the head rail unit 1711, at least one intermediate rail unit 1713, and foot rail unit 1712 may be any size and/or shape, and that the individual rail units may be different sizes. For example, the head rail unit 1711 may be a different shape and/or size than that of the foot rail unit 1712, and the foot rail unit 1712 may be a different size and/or shape than the at least one intermediate rail unit 1713.

Further, and to accommodate the angles of the window W as illustrated in FIG. 17B, the head rail units 1711 on the sides of the window W are smaller than the foot rail units 1712, the intermediate rail units 1713, and the head rail unit 1711 of the center module 1719. It is expressly contemplated the rail units may be any of a variety of sizes to accommodate any patterned or shaped window, etc. For example, if the bottom and/or middle of window W was angled in any of a variety of ways, the intermediate rails 1713 and/or foot rails 1712 may be sized according to the window, and the slat components 1716 and 1717 may be folded over and attached to the back of the slat components 1716 and 1717, as will be described in further detail with respect to FIGS. 17D and 17E. In alternative embodiments, the excess material may be folded over and attached to the front of the slat components 1716 and 1717 (not shown).

In addition, although the modular roman shade 1710 as depicted in FIG. 17B includes two intermediate rail units 1713 and a single intermediate slat component 1716, it is expressly contemplated that the modular roman shade 1710 may include a single intermediate rail unit 1713 with no intermediate slat component where the top slat component 1714 and the bottom slat component 1717 are coupled to each other or to a single intermediate rail unit 1713. Alternatively, any additional number of intermediate rail units 1713 and intermediate slat components 1716 may be added to the module 1719 of the modular roman shade 1710. Further, although the modular roman shade 1710 as depicted in FIG. 17B includes three modules 1719 that are coupled together, it is expressly contemplated that the modular roman shade 1710 may include one module 1719, or any number of modules 1719 coupled with one or more adjacent modules 1719. For example, if the window W as depicted in FIG. 17B was larger, one or more modules 1719 may be inserted between the modules 1719 on the edge (that includes the shorter head rail unit 1711 to accommodate the angle of the window W) and the module 1709 in the middle.

Each slat component (e.g., the top slat component 1711, the bottom slat component 1717, and the intermediate slat component 1716) may be individually removed between the individual rail units. For example, the individual slat components may be removed to be cleaned, or to be substituted with a different slat component (e.g., having a different pattern and/or being of a different material). For example, a user may desire to have a particular design make up the entire modular roman shade 1710 and thus may select particular materials and/or patterns for each slat component of the modular roman shade 1710. Further, it is expressly contemplated that each slat component may be different sizes and/or shapes to fit any windows or enclosures.

In addition, it is noted that each head rail unit 1711 and foot rail unit 1712 may include a mechanism for attachment, such as an adhesive component or a hook and loop fastener (e.g., Velcro®) on a front portion of the head rail unit 1711 and a front portion of the foot rail unit 1712, as described at other portions of this application. The mechanism for attachment, may, for example, be utilized to allow a user to add a design to the top and bottom of the modular roman shade 1710 in the form of a valence.

Figure 17C:
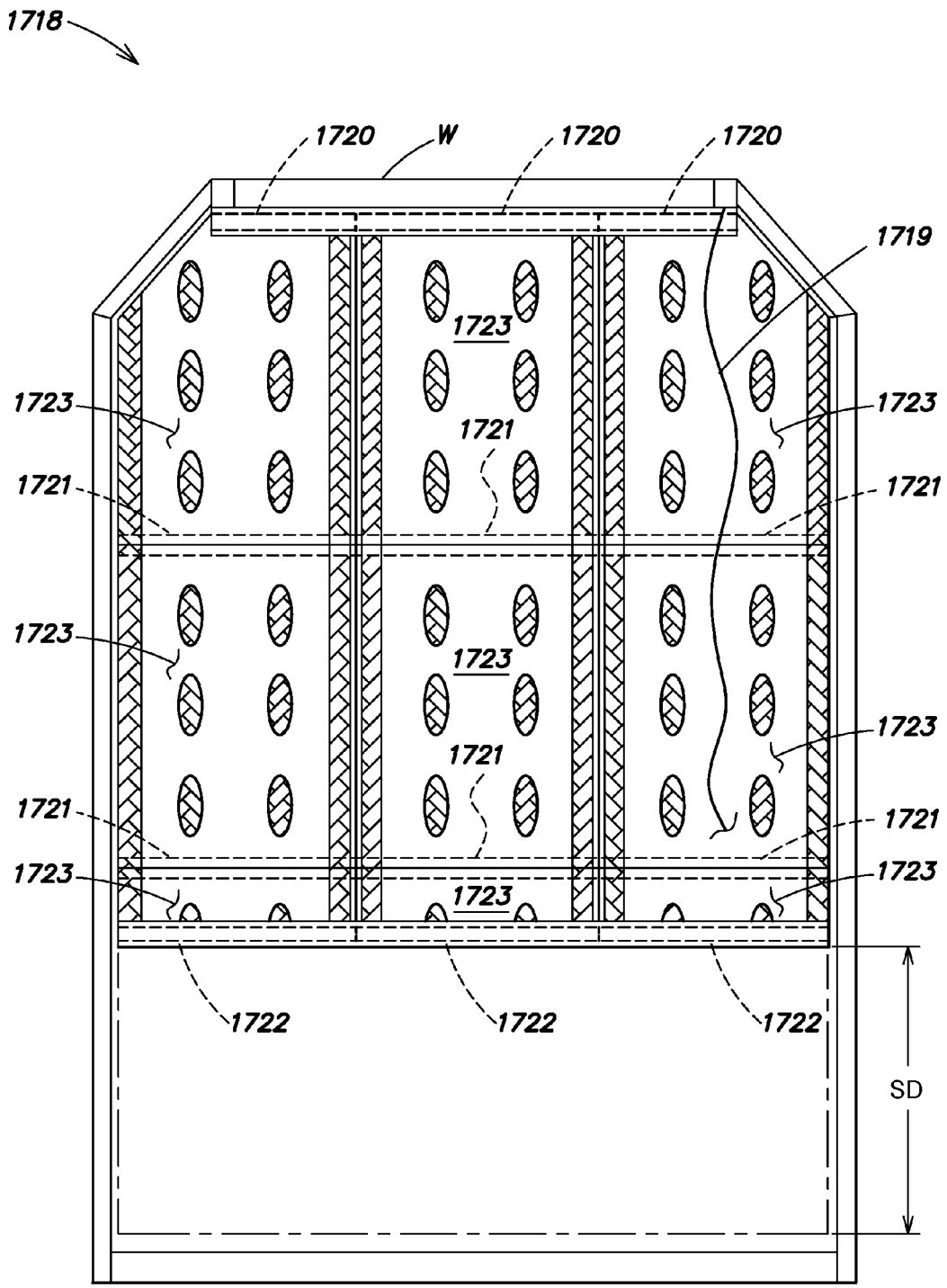
FIG. 17C is a detailed depiction of a front view of a modular roman shade that may be mounted at the top of a window and in a retracted position in accordance with an illustrative embodiment of the present invention.

FIG. 17C is a detailed depiction of a front view of a modular roman shade 1718 that may be mounted at the top of a window W and may also be retracted a selected distance. Specifically, the modular roman shade 1718 includes head rail units 1720, intermediate rail units 1721, foot rail units 1722, and slat components 1723. A user may pull on string 1719 to retract the roman shade 1718 a selected distance, to, for example, allow light to enter the bottom of the window W. When the user pull on the string 1719, a pulley system integrated on the back side of the roman shade 1718, as known by those skilled in the art, is initiated to raise the modular roman shade 1718 a selected distance SD, such that the foot rails units move towards the lowest intermediate rail units 1721, and the size of the slat components 1723 at the lowest portion of the window W decrease in size by folding or collapsing, as known by those skilled in the art.

Alternatively, each head rail unit may hold a bail retraction mechanism (not shown) to allow for the modular roman shade 1718 to be retracted or raised, by pulling or lifting the foot rail units 1722, as described at other portions of this application as known by those skilled in the art. Alternatively, a motor (not shown) may be housed in the head rail units to allow for the modular roman shade 1718 to be retracted or raised, as described at other portions of this application as known by those skilled in the art. When, for example, the modular roman shade is retracted the selected distance SD, a fold may be formed at intermediate rail units 1721. As depicted in FIG. 17C, the fold is formed at the lowest intermediate rail unit 1721 based on the pulley system as will be described with respect to FIG. 17E. It is expressly contemplated that the fold could occur at any number of different portions of the modular roman shade. For example, the fold could additionally or alternatively be formed at the highest intermediate rail units 1721 as will be described with reference to FIG. 17E.

Figure 17D:
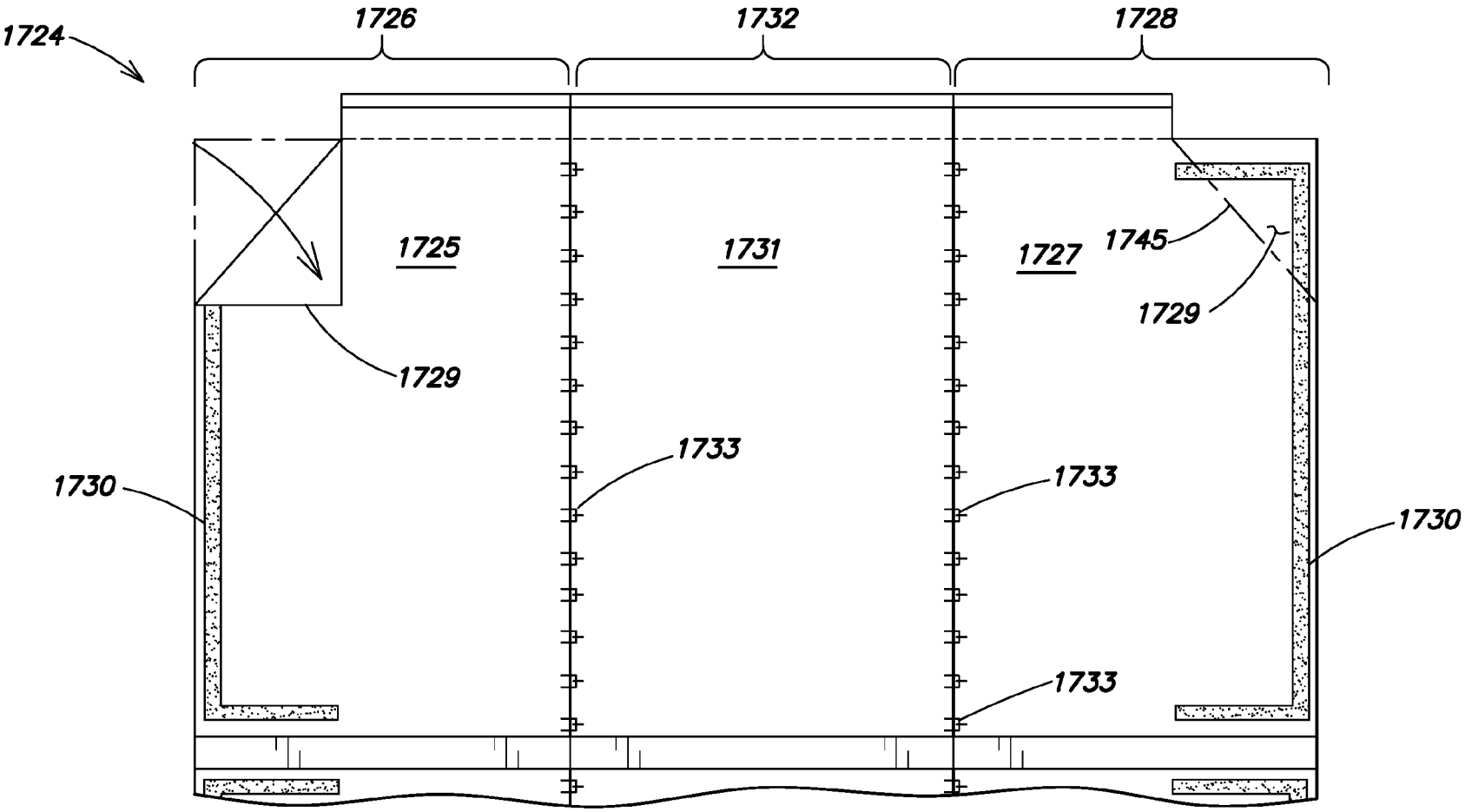
FIG. 17D is a detailed depiction of a back view of a modular roman shade depicting connections between slat components and the folding over of excess slat material to accommodate a window in accordance with an illustrative embodiment of the present invention.

FIG. 17D is a detailed depiction of a back view of a modular roman shade 1724 depicting connections between slat components and the fold over of excess slat material to accommodate a window that is, for example, angled. Specifically, and as depicted in FIG. 17D, the angled window W may cause there to be excess material associated with the slat component 1725 of the left most module 1726 and the slat component 1727 of the right most module 1728. More specifically, there may be excess material 1729 on the left side of slat component 1725 of left most module 1726, and excess material 1729 at the right side of the slat component 1727 of the right most module 1728. The excess material 1729 may be folded over and attached to the back side of the slat component.

For example, a user may attach attachment mechanism 1730 at any portion on the back of the slat components 1725 and 1727 and pull back or fold over the excess material to attach the excess material 1729 to the back of the slat such that a fold or crease 1745 is created. For illustratively purposes, FIG. 17D shows the excess material folded over on the left hand side and the excess material folded over on the right hand side in phantom. It is expressly contemplated that the excess material on both sides may or may not be folded over.

Specifically, although the attachment mechanisms 1730 are shown as to have particular shapes and sizes, and to be at particular locations on the back of the slat components, it is expressly contemplated that the attachment mechanisms 1730 may be of any shapes and sizes, and the user can move the attachment mechanism to any location on the back of the slat components 1725 and 1727 to fold over more or less of the slat components. It is noted that the attachment mechanism 1730 may be an adhesive component or a hook and loop fastener (e.g., Velcro® brand) as known by those skilled in the art and may be secured to the back of the slat component 1725 and 1727 in any number of a variety of ways, such as, but not limited to, staples, male/female connector, being woven into the back of the slat components 1725 and 1727. For example, the attachment mechanism 1730 may make contact with the back of the slat component 1725 to cause a coupling between the attachment mechanism 1730 and the back of the slat component 1725.

In addition, the slat component 1731 of the middle most module 1732 may also include the attachment mechanism 1730 to also fold excess material associated with the middle slat component 1731 in a similar manner, as described above with reference to the slat components 1725 and 1727.

Advantageously, the user can size the slat component to be any size or shape by simply folding the excess material and attaching the excess material to the back of slat component utilizing any of variety of attachment mechanisms, as described above. In an alternative embodiment, the excess material 1729 may not be folded over so that the slat component is greater in length than the head rail unit.

In addition, the slat component 1725 of the left most module 1729 and the slat component 1727 of the right most module 1728 are coupled to the slat component 1731 of middle module 1732 utilizing clipping fasteners 1733. Although reference is made to clipping fasteners 1733, it is expressly contemplated that a variety of fasteners may be utilized to couple the slat components together, such as zippers, adhesive materials, magnets, securing mechanism, etc.

Figure 17E:
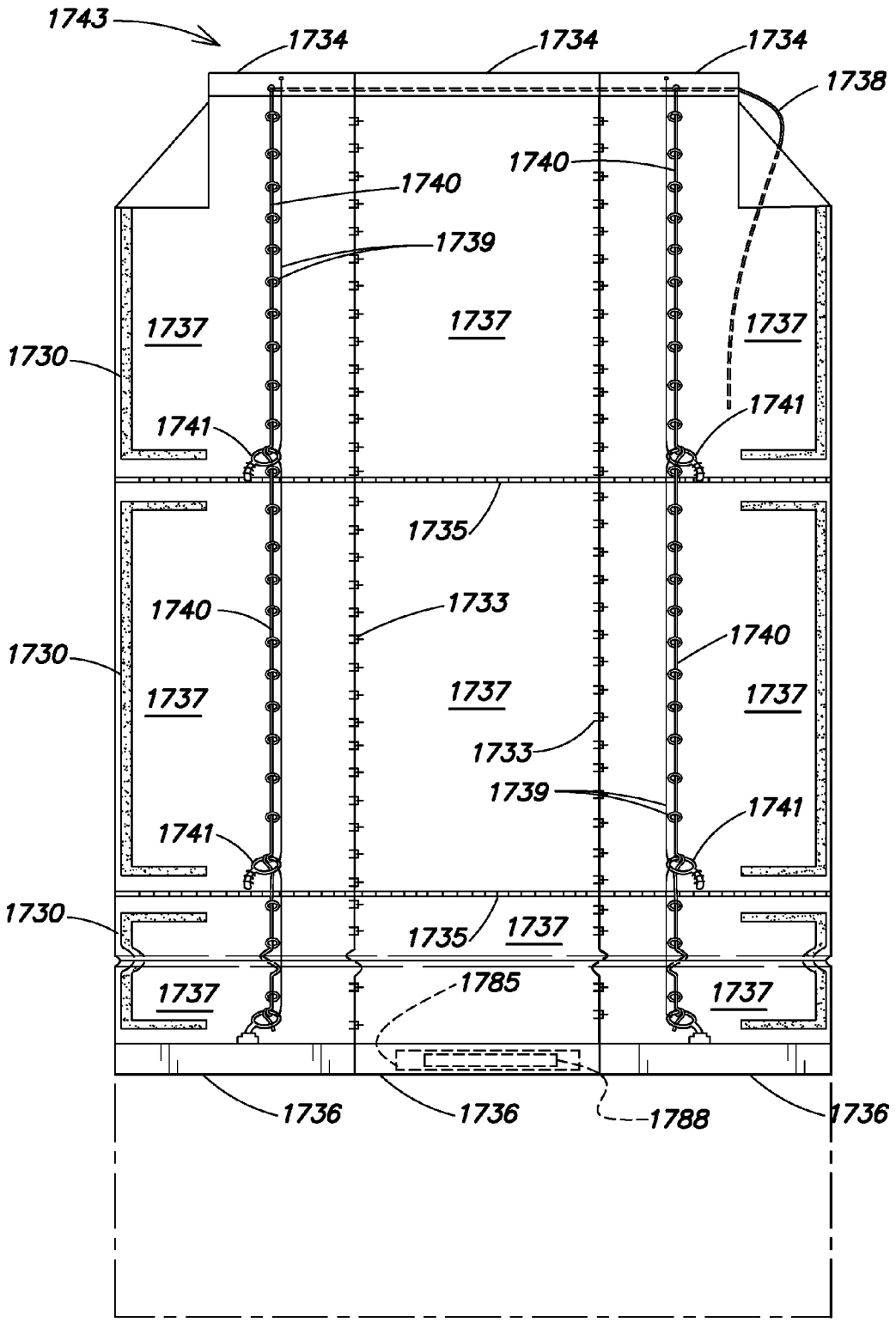
FIG. 17E is a detailed depiction of a back view of a modular roman shade with a pulley mechanism to raise and lower the modular roman shade in accordance with an illustrative embodiment of the present invention.

FIG. 17E is a detailed depiction of a back view of a modular roman shade 1743 with a pulley mechanism to raise and lower the modular roman shade 1743. The roman modular shade 1743 as depicted in FIG. 17E includes three head rail units 1734, three intermediate rail units 1735, three foot rail units 1736, and a plurality of slat components 1737, although in alternative embodiments any number of rail units may be utilized to make up the modular roman shade 1743. The pulley mechanism includes pull string 1738 (typically in the front of the modular roman shade 1743 and traveling through the head rail units 1734), that are coupled to straight strings 1740 that are positioned on the back of the modular roman shade 1743. In addition, one or more eye hooks 1741 are located at particular positions on the back of the modular shade 1743. For example, each eye hook 1741 may be located at each intermediate rail 1735, at one or more intermediate rails 1735, in close proximity to one or more intermediate rail 1735, and/or at the foot rail unit 1736. Alternatively, the modular roman shade 1743 may not include any eye hooks 1741.

A looped string 1739 may be attached to a head rail unit 1734 on the back of the modular roman shade 1743. The looped strings 1739 include one or more attachment loops. In addition, at least one attachment loop is attached to each eye hook 1741, by for example, being tied to or coupled to the eye hook 1741. The straight string 1740 is fed through each of the one or more attachment loops of the looped string 1739 and each eye hook 1741. Further, the looped string 1739 and the straight string 1740 are both coupled to the bottom most eye hook 1741, that may be, for example, coupled to an intermediate rail 1735 or the foot rail unit 1734. It is noted that the looped string 1739 and the straight string 1740 may be positioned at any location on the back of the modular roman shade 1743. Specifically, a user may move the strings to any desired location on the back of the modular roman shade 1743.

In operation, for example, a user may pull on pull string 1738 that causes the straight string 1740 to retract and raise, which in turn causes the looped string 1739 to retract since both the straight string 1740 and looped string 1739 are coupled to the bottom most eye hook 1741. This in turn causes the modular roman shade 1743 to retract or shorten in length, as known by those skilled in the art. As depicted in FIG. 17E, the bottom most slat components 1737 have folded or collapsed a selected distance due to the user pulling on the pull string 1738. It is noted that a crease is formed or created at each location where the eye hook 1741 is positioned, and is expressly contemplated that each eye hook 1741 may be attached to the back of the modular roman shade 1743 utilizing any of a variety of fasteners (e.g., magnet, hook and loop fastener), such that a user can readily and easily move each eye hook 1741.

Although reference is made to a pulley system in FIG. 17E, it is expressly contemplated that a motor or bail retraction mechanism (not shown) may be utilized with the looped strings 1739 and straight strings 1740 to raise and lower the modular roman shade 1743. Alternatively, no raising mechanism may be utilized and a user may simply roll or raise the bottom of the shade and manually tie or clip the raised modular roman shade 1743 to secure the modular roman shade 1743 at a desired height.

In addition, the foot rail units 1736 may include a compartment 1785, on the back side of the modular roman shade 1743 to hold one or more weights 1788. The one or more weights 1788 may be placed in the compartment, by a user, to provide, for example, increased weight to the overall modular roman shade 1743. In addition, and for a modular roman shade 1743 that utilizes a bail retraction mechanism, the weights 1788 in the compartment may act as counterbalancing effect for the bail retraction mechanism housed in, for example, the head rail units. Specifically, and instead of adjusting the bail retraction mechanism in the head rail units, the modular roman shade 1743 utilizes the weights to adjust the counterbalancing effect for the bail retraction mechanism. Specifically, as the modular roman shade 1743 gets larger, the user can simply add more weights 1788 to the compartment 1785 without actually adjusting the bail retraction mechanism in the head rail units.

Figure 18:
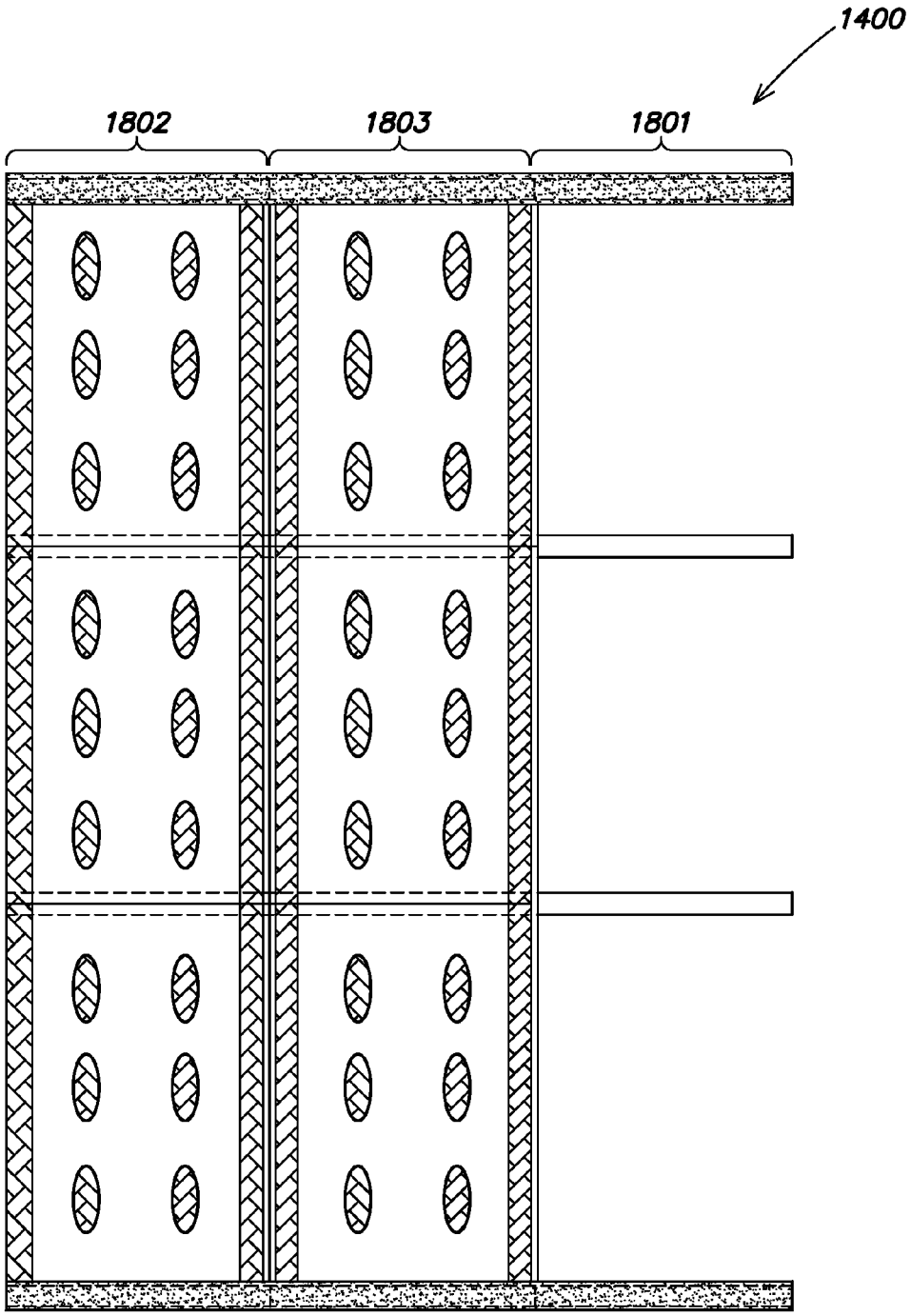
FIG. 18 is a front view of the modular roman shade where particular slat components have been removed in accordance with an illustrative embodiment of the present invention.

FIG. 18 is a front view of the modular roman shade 1400 where particular slat components have been removed. Specifically, and as shown in FIG. 18, the three individual slat component of the right most module 1801 have been removed, while the individual slat components of the left most module 1802 and the middle module 1803 remain intact. Advantageously, a user can remove any number of slat components and have those slat components washed, for example, and/or replaced with a different slat having a different pattern. Thus, a user can design the modular roman shade 1400 to have any number of patterns, materials etc. In addition, for example, a window opening may include an object, such as an air conditioner, and the user can remove the particular slat components where the air condition is positioned, such that the modular roman shade 1400 surrounds the air condition that is in the window. Advantageously, the size and shape of the modular roman shade 1400 can be dynamically altered in a user friendly way by allowing the user to simply attach or remove particular slat components.

Figure 19:
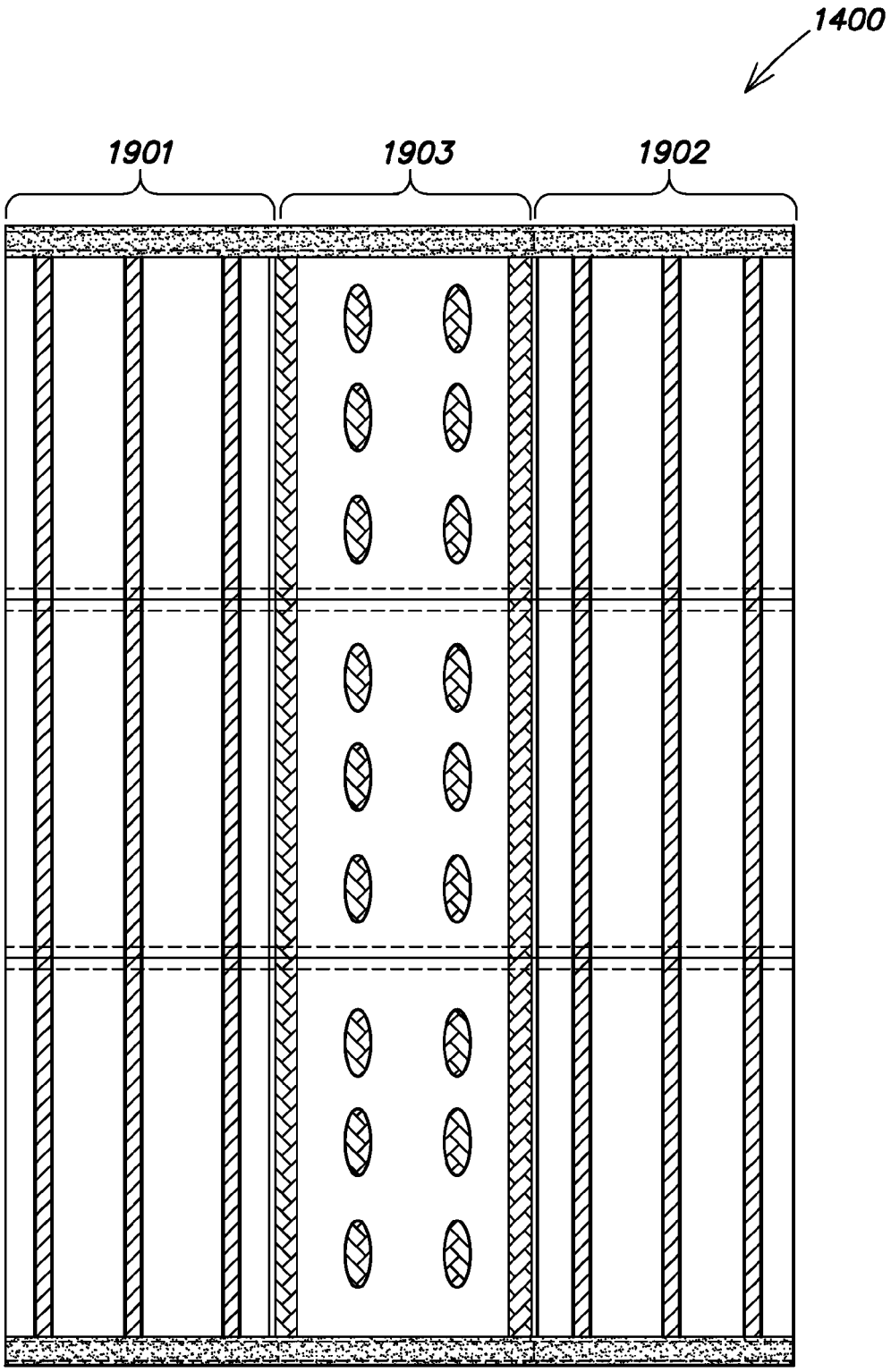
FIG. 19 is a front view of the modular roman shade where particular slat components have a different pattern than other slat components in accordance with an illustrative embodiment of the present invention.

FIG. 19 is a front view of the modular roman shade 1400 where particular slat components have a different pattern than other slat components. Specifically, and as shown in FIG. 19, the left most module 1901 and the right most module 1902 includes slat components with a first pattern, while the middle module 1903 includes slat components with a second pattern. Advantageously, a user can easily and efficiently change the overall look and appearance of the modular roman shade 1400. Although FIG. 19 depicts particular patterns with respect to particular slat components, it is expressly contemplated that any pattern or material may be used for each slat component.

Figure 20A:
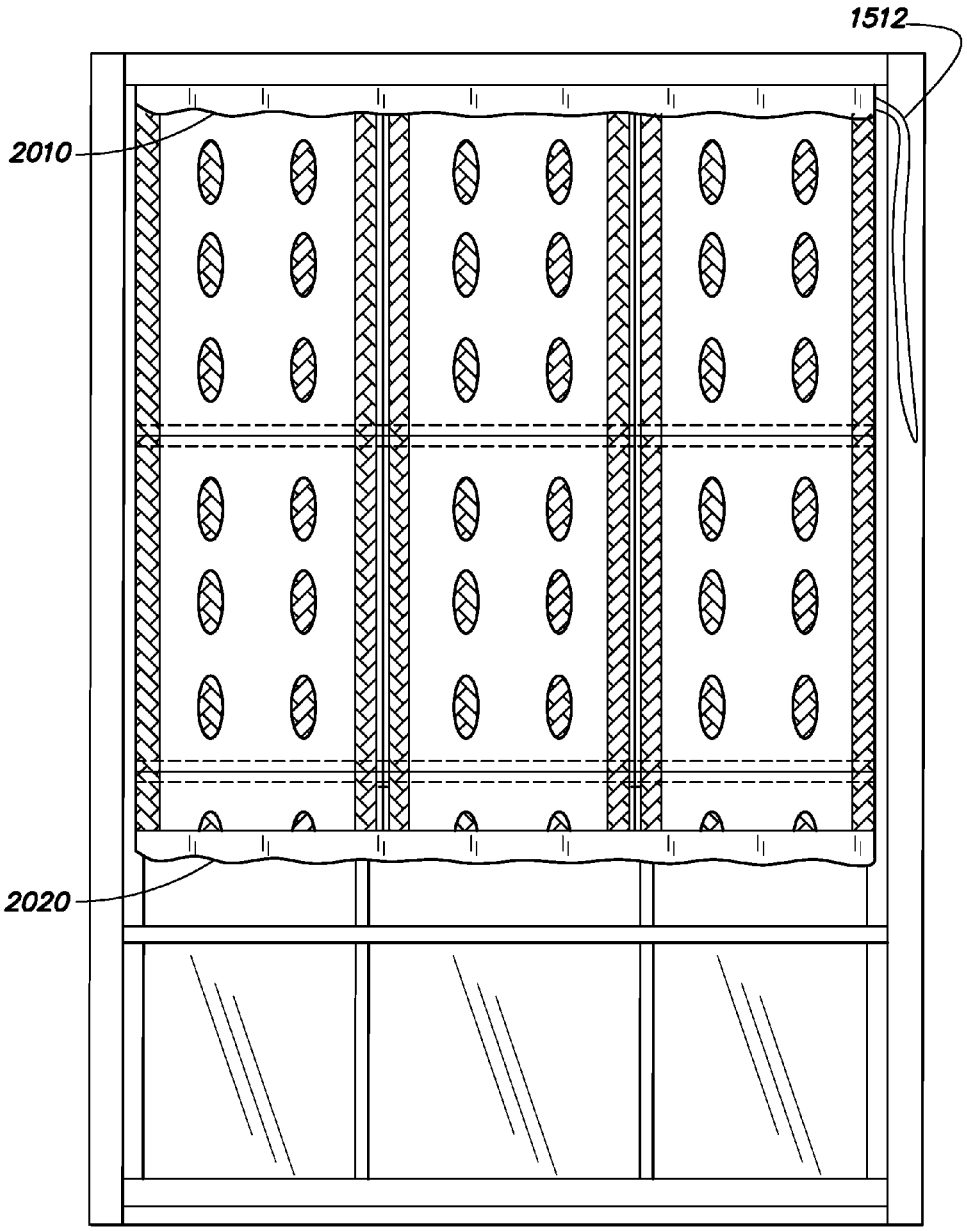
FIG. 20A is a front view of the modular roman shade in a retracted or raised position in accordance with an illustrative embodiment of the present invention.
Figure 20B:
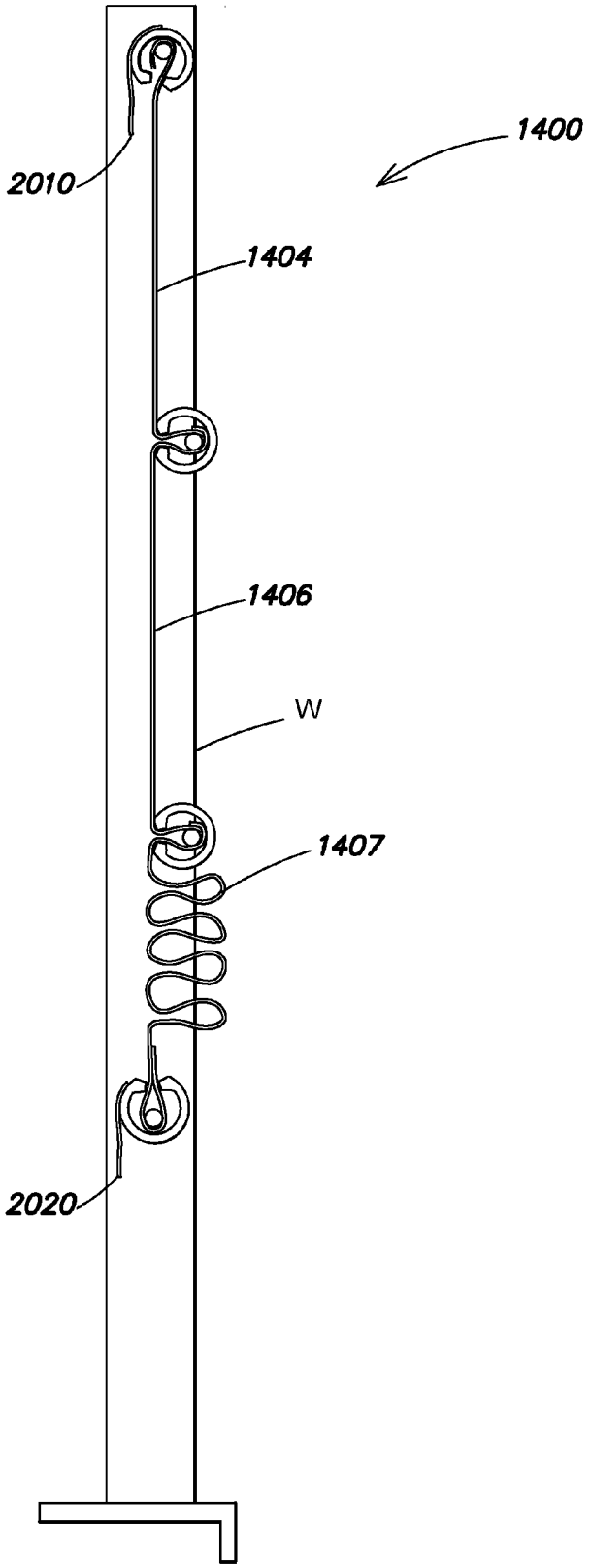
FIG. 20B is a side view of the modular roman shade in a retracted or raised position in accordance with an illustrative embodiment of the present invention.

FIGS. 20A and 20B are respectively a front view and a side view of the modular roman shade 1400 in a retracted or raised position. Specifically, a user may pull initiator cord 1512 to initiate the pulley system, as described with respect to FIG. 15, to cause the modular roman shade 1400 to raise or lower as shown in FIG. 20A, thereby allowing light to enter at the bottom of the window W. It is noted that FIG. 20A shows a top valence 2010 and a bottom valence 2020 that are added for decoration. Alternatively (not shown), a bail retraction mechanism may be utilized to allow the user to simply pull or push the foot rail unit(s) to raise and lower the modular roman shade 1400. FIG. 20B show the modular roman shade 1400 raised from the side view. As shown in FIG. 20B, the modular roman shade 1400 includes valences 2010 and 2020. In addition, the bottom slat 1407 is raised shortened based on the raising of the modular roman shade 1400.

Figure 21:
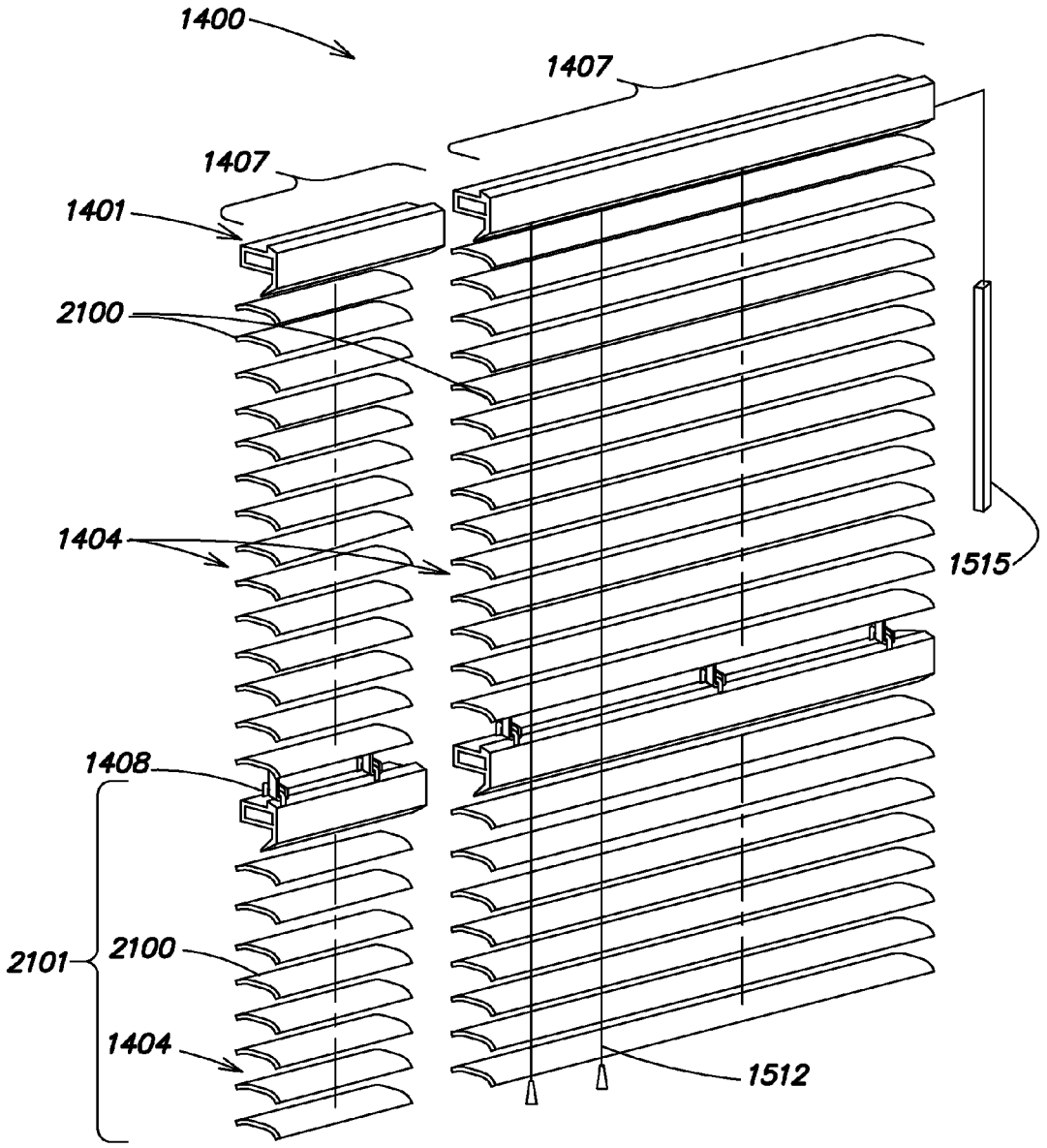
FIG. 21 is a front view of the modular shade in accordance with an illustrative embodiment of the present invention.

FIG. 21 is a front view of the modular shade 1400 that includes head rail units 1401 that may be coupled together and slat components 1404 that may be coupled together. For example, each slat component 1404 of module 1407 (that includes the head rail unit 1401 and slat component 1404) may be a venetian type blind including a plurality of elements 2100. Specifically, each of the plurality of elements 2100 may be coupled to an element 2100 of an adjacent slat component 1404. That is, each of the plurality of elements 2100 may "snap into" or "slide into" an element 2100 of an adjacent slat component 1404. Advantageously, the overall width or size of the modular shade 1400 may be altered, by a user, for example, by simply sliding an element 2100 of slat component 1404 a selected distance within an element 2100 of an adjacent slat component 1404. Alternatively, any of a variety of coupling mechanisms may be utilized to couple an element 2100 to an element 2100 of an adjacent slat component 1404. Although the modular shade 1400 as described with reference to FIG. 21 includes head rail units 1401 and slat components 1404, it is expressly contemplated that the modular shade 1400 may also include intermediate rail units and foot rail units.

In addition, additional module 2101 (including a head rail unit 1401 and a slat component 1404) may be added to the module 1407 to increase the size of the modular shade 1400. For example, and with reference to FIG. 21, the additional module 2101 may be attached to the slat component 1404 of the module 1407 utilizing a male/female connector 1408. Alternatively, the additional module 2101 may be attached to a bottom of the slat component 1404 of the module 1407 utilizing a clipping mechanism (not shown). It is expressly contemplated that a variety of different connecting mechanisms may be utilized to couple the additional module 2101 to the bottom of the slat component 1404 of the module 1407. Further, wand 1515 may be utilized to open/close the elements 2100 of the slat components 1404, as known by those skilled in the art. In addition, the modular shade 1400 may be raised and lowered by pulling on initiator cord 1512, as described above.

Figure 22:
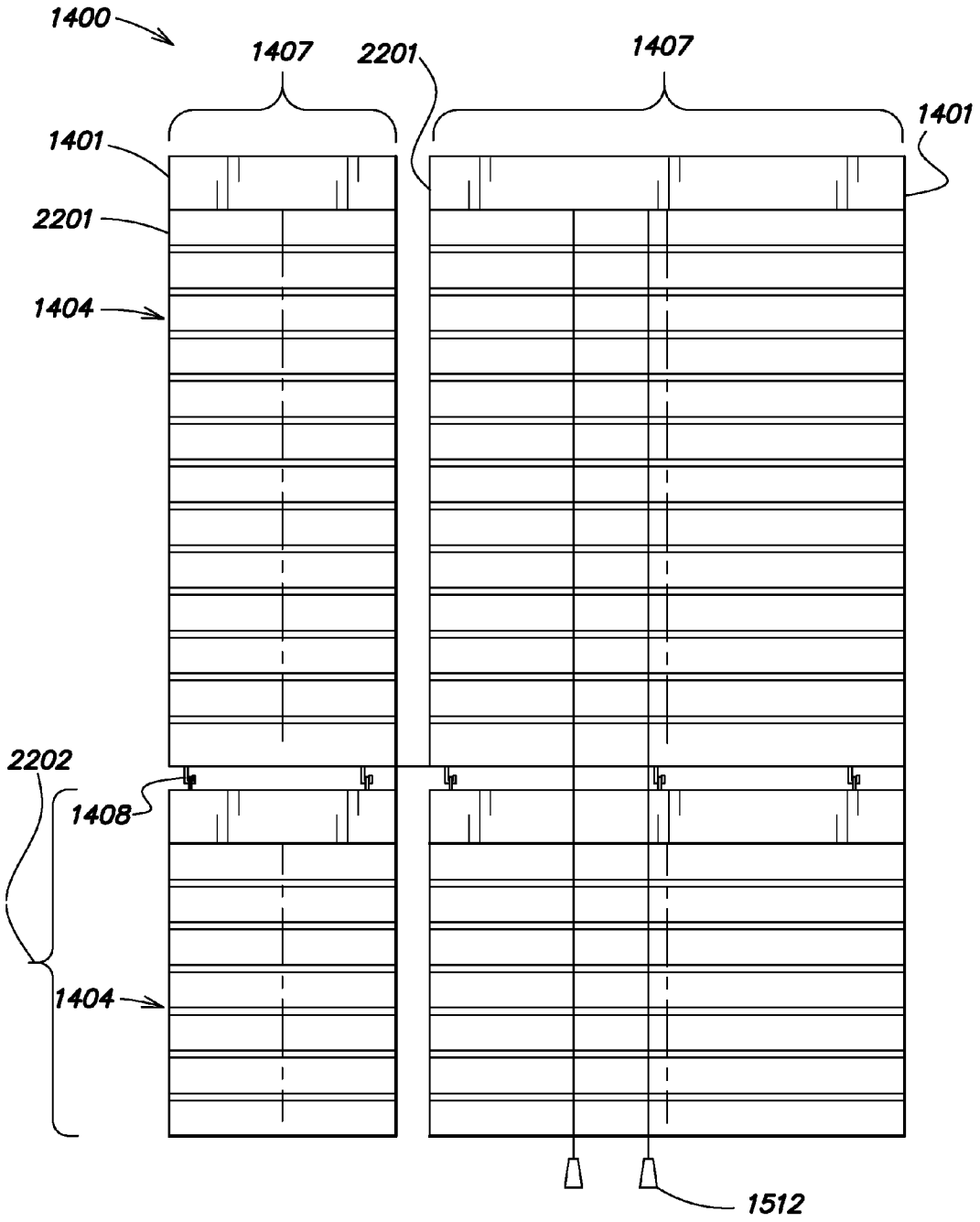
FIG. 22 is a front view of the modular shade in accordance with an illustrative embodiment of the present invention.

FIG. 22 is a front view of the modular shade 1400 that includes head rail units 1401 that may be coupled together and slat components 1404 that may be coupled together. For example, each slat component 1404 of module 1407 may include one or more element 2201. It is expressly contemplated that the one or more elements 2201 may be bamboo, wood, faux wood, plastic, or any number of materials. Specifically, the one or more elements 2201 of the slat component 1404 may be coupled to the one or more elements 2201 of an adjacent slat component 1404. That is, each of the one or more elements 2201 may "snap into" or "slide into" an element 2201 of an adjacent slat component 1404. Alternatively, any of a variety of coupling mechanisms may be utilized to couple the one or more elements 2201 to an element 2201 of an adjacent slat component 1404.

In addition, additional module 2202 (including a head rail unit 1401 and a slat component 1404) may be added to the module 1407 to increase the size of the modular shade 1400. For example, and with reference to FIG. 22, the additional module 2202 may be attached to a bottom of the slat component 1404 of the module 1407 utilizing a male/female connector 1408. Alternatively, the additional module 2202 may be attached to the slat component 1404 of the module 1407 utilizing a clipping mechanism (not shown). It is expressly contemplated that a variety of different connecting mechanisms may be utilized to couple the additional module 2202 to the slat component 1404 of the module 1407. Further, the modular shade 1400 may be raised and lowered by pulling on initiator cord 1512, as described above. Although the modular 1400 as described with reference to FIG. 22 includes head rail units 1401 and slat components 1404, it is expressly contemplated that the modular shade 1400 may also include intermediate rail units and foot rail units.

It should be apparent from the foregoing that all of my vertical blind assembly embodiments have great versatility and can be adapted to many window configurations. The various modules comprising the blind assembly can be made and sold separately and connected together to fit most window dimensions and shapes. Also, since the assembly can be sold in a knock down condition, it can be packaged and stored in a minimum amount of space for easy shipment. Moreover, it is easy to install by the average homeowner without requiring any special tools. In addition, although reference is made to the foot rail being lowered and raised to expand and retract the one or more slats, it is expressly contemplated that the foot rail may remain stationary, and the housing units may be lowered (to retract the slat) and raised (to extend the slat) to manipulate the slats.

It will thus be seen that the objects set forth above among those made apparent from the preceding description are efficiently attained. Also, since certain changes may be made to the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention described herein.

The invention claimed is:

1. A modular shade comprising:

a head rail unit;

an intermediate rail unit;

a top slat component, wherein a top slat first end of the top slat component is coupled to the head rail unit and wherein a top slat second end of the top slat component is coupled to the intermediate rail unit;

a foot rail unit; and a bottom slat component, wherein a bottom slat first end of the bottom slat component is coupled to the intermediate rail unit and a bottom slat second end of the bottom slat component is coupled to the foot rail unit;

wherein the head rail unit, the intermediate rail unit, the top slat component, the foot rail unit, and the bottom slat component form a module, wherein a side end of the top slat component includes excess material that is folded over and attached to a back of the modular shade such that the top slat component can be altered in size to match the size of the head rail unit and the intermediate rail unit and other excess material of the top slat component running substantially horizontally is configured to be inserted within the head rail unit or the intermediate rail unit of the module such that the top slat component can be altered in vertical length, and wherein the module is coupled to at least one second module that includes a second head rail unit, a second intermediate rail unit, a second top slat component, a second foot rail unit, and a second bottom slat component, where the second head rail unit of the at least one second module is smaller in length than the head rail unit of the module to accommodate an angled window and wherein at least the top slat component of the module is coupled to the second top slat component of the second module.

2. The modular shade as defined in claim 1 further comprising at least one additional intermediate rail unit positioned between the head rail unit and the intermediate rail unit; and at least one additional intermediate slat component positioned between the top slat component and the bottom slat component.

3. The modular shade as defined in claim 1 further comprising at least one additional intermediate rail unit positioned between the foot rail unit and the intermediate rail unit; and at least one additional intermediate slat component positioned between the bottom slat component and the top slat component.

4. The modular shade as defined in claim 1, wherein the top slat first end of the top slat component is coupled to the head rail unit and secured to the head rail unit utilizing a head rail unit fastener, wherein the top slat second end of the top slat component and the bottom slat first end of the bottom slat component are coupled to the intermediate rail unit and secured to the intermediate rail unit utilizing a intermediate rail unit fastener; and wherein the bottom slat second end of the bottom slat component is coupled to the foot rail unit and secured to the foot rail unit utilizing a foot rail unit fastener.

5. The modular shade as defined in claim 4, wherein the head rail unit, the intermediate rail unit, and the foot rail unit are hollow tubes and the head rail unit fastener, the intermediate rail unit fastener, and the foot rail unit fastener are rods that are snapped into the hollow tubes.

6. The modular shade as defined in claim 4, wherein the head rail unit, the intermediate rail unit, and the foot rail unit are solid and the head rail unit fastener, the intermediate rail unit fastener, and the foot rail unit fastener are clips.

7. The modular shade as defined in claim 1, wherein a head rail unit front portion of the head rail unit includes an adhesive layer configured to attach to a top valence and wherein a foot rail unit front portion of the foot rail unit includes the adhesive layer configured to attach to a bottom valence.

8. The modular shade as defined in claim 1, wherein the top slat component is coupled to the second top slat component utilizing male/female coupling system, clips, a zipper, or adhesive.

9. The modular shade as defined in claim 1, further comprising a pulley system configured to raise and lower at least one of the intermediate rail unit and the foot rail unit.

10. The modular shade as defined in claim 1, further comprising a bail retraction mechanism configured to raise and lower at least one of the intermediate rail unit and the foot rail unit.

11. The modular shade as defined in claim 1, further comprising a third top slat component, wherein a second top slat first end of the third top slat component is coupled to the head rail unit and a second top slat second end of the third top slat component is coupled to the intermediate rail unit, wherein the top slat component and the third top slat component are layered.

12. The modular shade as defined in claim 1, wherein the excess material is attached to the back of the modular shade utilizing a first slat component attachment mechanism.

13. A modular shade comprising:

a first module including:

a first head rail unit, a first intermediate rail unit, a first top slat component, wherein a first top slat first end of the first top slat component is coupled to the first head rail unit and wherein a first top slat second end of the first top slat component is coupled to the first intermediate rail unit;

a first foot rail unit, and a first bottom slat component, wherein a first bottom slat first end of the first bottom slat component is coupled to the first intermediate rail unit and wherein a first bottom slat second end of the first bottom slat is coupled to the first foot rail unit, wherein a side end of the first top slat component includes excess material that is folded over and attached to a back of the modular shade such that the first top slat component can be altered in size to match the size of the first head rail unit and the first intermediate rail unit and other excess material of the first tope slat component running substantially horizontally is configured to be inserted within the first head rail unit or the intermediate rail unit of the first module such that the first top slat component can be altered in vertical length;

a second module coupled to the first module and including:

a second head rail unit that is smaller in length than the first head rail unit to accommodate a window that is angled, a second intermediate rail unit, a second top slat component, wherein a second top slat first end of the second top slat component is coupled to the second head rail unit and wherein a second top slat second end of the second top slat component is coupled to the second intermediate rail unit, and wherein the second top slat component is coupled to the first top slat component;

a second foot rail unit, and a second bottom slat component, wherein a second bottom slat first end of the second bottom slat component is coupled to the second intermediate rail unit and wherein a second bottom slat second end of the second bottoms slat component is coupled to the second foot rail unit.

14. The modular shade as defined in claim 13, further comprising:

at least one additional intermediate rail unit positioned between the first head rail unit and the first intermediate rail unit; and at least one additional intermediate slat component positioned between the first top slat component and the first bottom slat component.

15. The modular shade as defined in claim 13, wherein the first head rail unit, the first intermediate rail unit, and the first foot rail unit are hollow tubes and wherein rail unit fasteners are utilized to couple the first top slat and the first bottom slat to the first head rail unit, the first intermediate rail unit, and the foot rail unit.

16. The modular shade as defined in claim 13, wherein the first head rail unit and the first foot rail unit include an adhesive layer configured to attach a top valence and a bottom valence.

17. The modular shade as defined in claim 13, further comprising a pulley system configured to raise and lower at least one of the first intermediate rail unit and the first foot rail unit.

18. A modular shade comprising:

a head rail unit;

a foot rail unit;

a top slat component, wherein a top slat first end of the top slat component is coupled to the head rail unit; and a bottom slat component, wherein a bottom slat second end of the bottom slat component is coupled to the foot rail unit, wherein a top slat second end of the top slat component is coupled to a bottom slat first end of the bottom slat component slat component to form an intermediate rail unit, wherein the head rail unit, foot rail unit, top slat component, and bottom slat component form a first module, wherein a side end of the top slat component includes excess material that is folded over and attached to a back of the modular shade and other excess material of the top slat component running substantially horizontally is configured to be inserted within the head rail unit or the foot rail unit such that the top slat component can be altered in vertical length, and wherein the first module is coupled to at least one second module that includes a second head rail unit, a second foot rail unit, a second top slat component, and a second bottom slat component, where the second head rail unit of the second module is smaller in length than the head rail unit of the module to accommodate an angled window, wherein the first bottom slat component is at least coupled to the second bottom slat component.

19. The modular shade as defined in 18, further comprising a compartment in the foot rail unit configured to store one or more weights that act as a counterbalance.

20. The modular shade as defined in 18, further comprising:

a looped string coupled to the head rail unit on a back side of the modular shade, the looped string including one or more attachment loops, wherein at least one attachment loop of the one or more attachment loops is coupled to an eye hook attached to the back side of the modular shade; and a straight string that is fed through each attachment loop of the one or more attachment loops, wherein the straight string and the looped string are coupled to a bottom most eye hook attached to the back side of the modular shade.

* * * * *